US011398181B2

(12) United States Patent
Kim et al.

(10) Patent No.: US 11,398,181 B2
(45) Date of Patent: Jul. 26, 2022

(54) DISPLAY MODULE AND DRIVING METHOD THEREOF

(71) Applicants: SAMSUNG ELECTRONICS CO., LTD., Suwon-si (KR); RESEARCH & BUSINESS FOUNDATION SUNGKYUNKWAN UNIVERSITY, Suwon-si (KR)

(72) Inventors: Jinho Kim, Suwon-si (KR); Yong-Sang Kim, Suwon-si (KR); Daisuke Kawae, Yokohama (JP); Junichi Yamashita, Yokohama (JP); Takashige Fujimori, Yokohama (JP); Donggun Oh, Suwon-si (KR); Jongsu Oh, Suwon-si (KR); Tetsuya Shigeta, Suwon-si (KR)

(73) Assignees: SAMSUNG ELECTRONICS CO., LTD., Suwon-si (KR); RESEARCH & BUSINESS FOUNDATION SUNGKYUNKWAN UNIVERSITY, Suwon-si (KR)

( * ) Notice: Subject to any disclaimer, the term of this patent is extended or adjusted under 35 U.S.C. 154(b) by 0 days.

(21) Appl. No.: 17/140,776

(22) Filed: Jan. 4, 2021

(65) Prior Publication Data

US 2021/0210003 A1 Jul. 8, 2021

Related U.S. Application Data

(60) Provisional application No. 62/956,712, filed on Jan. 3, 2020.

(30) Foreign Application Priority Data

Jun. 19, 2020 (KR) ..... 10-2020-0075318

(51) Int. Cl.
*G09G 3/32* (2016.01)

(52) U.S. Cl.
CPC ..... *G09G 3/32* (2013.01); *G09G 2300/0809* (2013.01); *G09G 2320/0242* (2013.01); *G09G 2320/064* (2013.01)

(58) Field of Classification Search
CPC ..... G09G 3/32; G09G 2320/0242; G09G 2300/0809; G09G 2320/064
See application file for complete search history.

(56) References Cited

U.S. PATENT DOCUMENTS 6,498,592 B1 * 12/2002 Matthies ..... G02F 1/13336 257/E25.032
6,850,251 B1 * 2/2005 Yasunishi ..... G09G 3/2051 345/691

(Continued)

FOREIGN PATENT DOCUMENTS

JP 5894990 B2 3/2016
KR 10-1503823 B1 3/2015

(Continued)

OTHER PUBLICATIONS

International Search Report (PCT/ISA/210) issued by the International Searching Authority in International Application No. PCT/KR2020/019501, dated Apr. 8, 2021.

(Continued)

*Primary Examiner* — Michael J Jansen, II
(74) *Attorney, Agent, or Firm* — Sughrue Mion, PLLC

(57) ABSTRACT

A display module including a display panel comprising a plurality of pixels each comprising a plurality of sub pixels, the pixels being disposed on a plurality of row lines of the display panel and a driver. The driver being configured to apply a pulse width modulation (PWM) data voltage to the sub pixels in a sequential order of the row lines; and drive the display panel such that the sub pixels included in a plurality of consecutive row lines among the plurality of row (Continued)

lines emit light, in the sequential order of the row lines, for a time corresponding to the applied PWM data voltage.

17 Claims, 48 Drawing Sheets

(56) References Cited

U.S. PATENT DOCUMENTS 6,985,141 B2 * 1/2006 Abe ..... G09G 3/20 345/204
7,154,489 B2 * 12/2006 Abe ..... G09G 3/22 345/94
7,167,169 B2 * 1/2007 Libsch ..... G09G 3/3233 345/211
7,277,105 B2 * 10/2007 Abe ..... G09G 3/2081 345/691
7,595,785 B2 * 9/2009 Jang ..... H05B 41/2858 315/291
7,808,497 B2 * 10/2010 Lo ..... G09G 3/3233 345/212
8,063,858 B2 * 11/2011 Ishizuka ..... G09G 3/3258 345/55
8,730,271 B2 * 5/2014 Kim ..... G09G 3/3225 345/690
9,007,298 B2 * 4/2015 Moyse ..... G09G 3/02 345/107
9,295,112 B2 * 3/2016 Knapp ..... H05B 45/20
9,349,313 B2 * 5/2016 Kawae ..... G09G 3/2022
9,589,540 B2 * 3/2017 Wu ..... G06F 3/1407
10,249,229 B2 * 4/2019 Shin ..... G09G 3/2014
10,475,393 B2 * 11/2019 Lee ..... G09G 3/30
10,504,406 B2 * 12/2019 Shigeta ..... G09G 3/2081
10,593,251 B2 * 3/2020 Shigeta ..... G09G 3/2018
10,706,766 B2 * 7/2020 Kim ..... G09G 3/2003
10,825,380 B2 * 11/2020 Kim ..... H01L 27/156
10,832,615 B2 * 11/2020 Kim ..... G09G 3/2003
10,847,077 B2 * 11/2020 Sakariya ..... G09G 3/32
10,885,844 B2 1/2021 Koh
11,056,047 B2 * 7/2021 Shigeta ..... G09G 3/3283
11,120,771 B2 * 9/2021 Callway ..... G09G 5/12
2003/0016189 A1 * 1/2003 Abe ..... G09G 3/2014 345/55
2003/0107565 A1 * 6/2003 Libsch ..... G09G 3/3233 345/211
2004/0150660 A1 * 8/2004 Abe ..... G09G 3/22 345/691
2005/0001827 A1 * 1/2005 Abe ..... G09G 3/22 345/204
2006/0017404 A1 * 1/2006 Jang ..... G09G 3/3406 315/291
2006/0055660 A1 * 3/2006 Teranishi ..... G09G 3/3648 345/102
2006/0170639 A1 * 8/2006 Kawaguchi ..... G09G 3/342 345/98
2008/0094335 A1 * 4/2008 Kim ..... G09G 3/3611 345/89
2008/0111809 A1 * 5/2008 Lo ..... G09G 3/3233 345/212
2009/0167649 A1 * 7/2009 Ishizuka ..... G09G 3/3258 345/80
2010/0164937 A1 * 7/2010 Kim ..... G09G 3/3225 345/212
2011/0084993 A1 * 4/2011 Kawabe ..... G09G 3/3233 345/691
2011/0205259 A1 * 8/2011 Hagood, IV ..... G09G 3/3413 345/690
2013/0141642 A1 * 6/2013 Wu ..... G09G 5/363 348/441
2013/0169605 A1 * 7/2013 Moyse ..... G09G 3/3433 345/204
2014/0152709 A1 * 6/2014 Kawae ..... G09G 3/3225 345/690
2014/0240368 A1 8/2014 Koh
2014/0333516 A1 * 11/2014 Park ..... G09G 3/3614 345/89
2015/0015147 A1 * 1/2015 Knapp ..... H05B 45/20 315/155
2015/0022098 A1 * 1/2015 Knapp ..... G09G 3/2018 315/161
2016/0021328 A1 * 1/2016 Shen ..... H04N 21/440281 348/448
2016/0335988 A1 * 11/2016 Shin ..... G09G 3/2014
2017/0263183 A1 9/2017 Lin et al.
2017/0301296 A1 * 10/2017 Pappas ..... G09G 3/3266
2018/0012548 A1 1/2018 Koh
2018/0151132 A1 * 5/2018 Lee ..... G09G 3/3406
2018/0182279 A1 * 6/2018 Sakariya ..... G09G 3/32
2018/0197471 A1 * 7/2018 Rotzoll ..... H01L 25/167
2018/0301080 A1 * 10/2018 Shigeta ..... G09G 3/3208
2019/0371231 A1 * 12/2019 Kim ..... G09G 3/2011
2019/0371232 A1 * 12/2019 Kim ..... G09G 3/32
2020/0111404 A1 * 4/2020 Kim ..... G09G 3/32
2020/0219463 A1 * 7/2020 Callway ..... G09G 5/12
2020/0265777 A1 * 8/2020 Shigeta ..... G09G 3/2011
2021/0210002 A1 * 7/2021 Kim ..... G09G 3/32
2021/0210003 A1 * 7/2021 Kim ..... G09G 3/32

FOREIGN PATENT DOCUMENTS

KR 10-1818247 B1 1/2018
KR 10-2018-0062048 A 6/2018
KR 10-2018-0115615 A 10/2018
KR 10-1923718 B1 11/2018
KR 10-2019-0007727 A 1/2019
KR 10-2019-0069114 A 6/2019
KR 10-2033611 B1 10/2019

OTHER PUBLICATIONS

Written Opinion (PCT/ISA/237) issued by the International Searching Authority in International Application No. PCT/KR2020/019501, dated Apr. 8, 2021.

* cited by examiner

--Prior Art--

DISPLAY MODULE AND DRIVING METHOD THEREOF

CROSS-REFERENCE TO RELATED APPLICATION(S)

This application is based on and claims priority under 35 U.S.C. § 119 to U.S. Provisional No. 62/956,712, filed on Jan. 3, 2020 in the United States Patent and Trademark Office, and Korean Patent Application No. 10-2020-0075318, filed on Jun. 19, 2020, in the Korean Intellectual Property Office, the disclosures of which are incorporated by reference herein in their entireties.

BACKGROUND

1. Field

The disclosure relates to a display module and a driving method thereof, and more particularly, to a display module in which a self-luminous element constitutes a sub pixel, and a driving method thereof.

2. Description of Related Art

In a display panel that drives an inorganic light emitting element such as a red light emitting diode (LED), a green LED, and a blue LED (hereinafter, an LED refers to an inorganic light emitting element) as a sub pixel according to the related art, a grayscale of the sub pixel may be expressed by a pulse amplitude modulation (PAM) driving method.

In this case, according to the magnitude of a driving current, a grayscale of an emitted light and also a wavelength of the emitted light change together, and thus the color reproducibility of an image is reduced. FIG. 1 shows a wavelength change according to the magnitude of the driving current flowing through the blue LED, the green LED, and the red LED.

SUMMARY

According to an aspect of the disclosure, a display module may include a display panel including a plurality of pixels each including a plurality of sub pixels, the pixels being disposed on a plurality of row lines of the display panel. The display panel may also include a driver configured to apply a pulse width modulation (PWM) data voltage to the sub pixels in a sequential order of the row lines; and drive the display panel such that the sub pixels included in a plurality of consecutive row lines among the plurality of row lines emit light, in the sequential order of the row lines, for a time corresponding to the applied PWM data voltage.

The driver may be further configured to: apply the PWM data voltage to the sub pixels included in each of the row lines during a data setting period for each of the row lines; and drive the display panel such that the sub pixels included in each of the the plurality of consecutive row lines emit light for a time corresponding to the applied PWM data voltage during a plurality of light emission periods for each of the row lines.

A first light emission period of the plurality of light emission periods may be temporally consecutive with the data setting period, and each of the plurality of light emission periods may have a predetermined time interval.

The plurality of row lines may be divided into a plurality of groups, each group comprising consecutive row lines. The driver may be further configured to: apply a second PWM data voltage to the sub pixels included in each of the row lines in the sequential order of the row lines from a first row line to a last row line of the plurality of row lines during a second image frame period; and drive the display panel such that during the second image frame period, the sub pixels included in a first group of the plurality of groups emit light in the sequential order of the row lines, and then the sub pixels included in each of a plurality of consecutive groups emit light in the sequential order of the row lines based on the applied second PWM data voltage. The plurality of consecutive groups may include the first group.

The driver may be further configured to apply a first PWM data voltage to the sub pixels included in each of the row lines in the sequential order of the row lines from the first row line to the last row line of the plurality of row lines during a first image frame period before the second image frame period; and drive the display panel such that during the second image frame period, the sub pixels included in each of the groups except for at least one group driven based on the second PWM data voltage among the plurality of groups emit light in the sequential order of the row lines based on the first PWM data voltage.

The driver may be further configured to drive the display panel such that during the second image frame period, the sub pixels included in each of the row lines of each of the plurality of groups emit light multiple times during the plurality of light emission periods for each of the row lines based on one or more of the first PWM data voltage and the second PWM data voltage.

Each of the plurality of sub pixels may include an inorganic light emitting element; and a sub pixel circuit configured to control a light emission time of the inorganic light emitting element during each of the plurality of light emission periods according to driving of the driver. The sub pixel circuit may include a constant current generator circuit configured to provide a constant current to the inorganic light emitting element based on an applied constant current generator voltage; and a PWM circuit configured to provide the constant current to the inorganic light emitting element for a time corresponding to the applied PWM data voltage.

The constant current generator circuit may include a first driving transistor, and, based on the constant current generator voltage being applied, the constant current generator circuit is configured to apply a first voltage based on the applied constant current generator voltage and a threshold voltage of the first driving transistor to a gate terminal of the first driving transistor. The PWM circuit may include a second driving transistor, and, based on the PWM data voltage being applied, the PWM circuit is configured to apply a second voltage based on the applied PWM data voltage and a threshold voltage of the second driving transistor to a gate terminal of the second driving transistor.

The constant current generator circuit may further include a first transistor connected between a drain terminal and a gate terminal of the first driving transistor; and a second transistor having a drain terminal connected to a source terminal of the first driving transistor and a gate terminal connected to a gate terminal of the first transistor. Tn a state in which the constant current generator voltage is applied through a source terminal of the second transistor while the first and second transistors are turned on, the first voltage may be applied to the gate terminal of the first driving transistor through the turned-on first driving transistor.

The PWM circuit may further include a third transistor connected between the drain terminal and the gate terminal of the second driving transistor; and a fourth transistor having a drain terminal connected to a source terminal of the second driving transistor and a gate terminal connected to a gate terminal of the third transistor. Tn a state in which the PWM data voltage is applied through a source terminal of the fourth transistor while the third and fourth transistors are turned on, the second voltage may be applied to the gate terminal of the second driving transistor through the turned-on second driving transistor.

The constant current generator circuit may be further configured to provide the inorganic light emitting element with the constant current, the constant current having a magnitude based on a first driving voltage applied to a source terminal of the first driving transistor and the first voltage applied to the gate terminal of the first driving transistor.

The sub pixel circuit may include a first switching transistor having a gate terminal connected to a drain terminal of the second driving transistor and a source terminal connected to a drain terminal of the first driving transistor. The constant current generator circuit may be further configured to, in a state in which a first driving voltage is applied to the source terminal of the first switching transistor through the first driving transistor, provide the constant current to the inorganic light emitting element through the turned-on first switching transistor. The PWM circuit may be further configured to, in a state in which the second driving transistor is turned on based on the second voltage applied to the gate terminal of the second driving transistor and a second driving voltage applied to the source terminal of the second driving transistor, apply the second driving voltage to the gate terminal of the first switching transistor to turn off the first switching transistor.

The second driving transistor may be turned on based on the second voltage applied to the gate terminal of the second driving transistor changing according to a sweep voltage applied to the PWM circuit and a voltage between the gate terminal and the source terminal of the second driving transistor becoming the threshold voltage of the second driving transistor.

The sub pixel circuit may further include a second switching transistor having a source terminal connected to a drain terminal of the first switching transistor and a drain terminal connected to an anode terminal of the inorganic light emitting element. The second switching transistor may be turned on after a predetermined time elapses from a time when the second driving voltage is applied to the source terminal of the second driving transistor.

The PWM circuit may further include a resetter configured to turn on the first switching transistor before the first driving voltage is applied to the source terminal of the first switching transistor through the first driving transistor.

A voltage of the gate terminal of the second driving transistor, that has linearly changed according to a sweep voltage in a first light emission period among the plurality of light emission periods, may be restored to the second voltage by the sweep voltage before a second light emission period after the first light emission period among the plurality of light emission periods. The resetter may be further configured to, based on the second light emission period beginning, turn on the first switching transistor that is turned off in the first light emission period.

The constant current generator circuit may be driven based on the second driving voltage during the data setting period and is driven based on the first driving voltage during the plurality of light emission periods.

According to another aspect of the disclosure, a driving method of a display module including a display panel having a plurality of pixels each including a plurality of sub pixels, the pixels being disposed on a plurality of row lines of the display panel may include applying a pulse width modulation (PWM) data voltage to the sub pixels in a sequential order of the row lines; and driving the display panel such that the sub pixels included in a plurality of consecutive row lines among the plurality of row lines emit light, in the sequential order of the row lines, for a time corresponding to the applied PWM data voltage.

BRIEF DESCRIPTION OF THE DRAWINGS

The above and other aspects and features of certain embodiments of the disclosure will be more apparent from the following description, taken in conjunction with the accompanying drawings, in which.

DETAILED DESCRIPTION

Provided is a display module that provides an improved color reproducibility for an input image signal and a driving method thereof.

Provided is a display module including a sub pixel circuit capable of more efficiently and stably driving an inorganic light emitting element constituting a sub pixel and a driving method thereof.

Provided is a display module including a driving circuit suitable for high density integration by optimizing the design of various driving circuits driving an inorganic light emitting element and a driving method thereof.

Hereinafter, various embodiments of the disclosure will be described in detail with reference to the accompanying drawings.

In the description of the disclosure, a detailed description of known related art will be omitted if it is determined that the gist of the disclosure may be unnecessarily obscured. Further, redundant description of the same constitution will be omitted.

The suffix "unit" for the constituent elements used in the following description is given or mixed only in consideration of easy drafting of the specification, and does not have its own meaning or function to distinguish from each other.

The terms used in the disclosure are used to illustrate the embodiments and are not intended to limit and/or restrict the disclosure. The singular forms "a," "an," and "the" include plural expressions unless the context clearly dictates otherwise.

In the present specification, terms such as "including" or "having" are used to designate the presence of stated features, integers, steps, operations, components, parts, or combinations thereof, but do not preclude the presence or addition of one or more other features, integers, steps, operations, components, parts, or combinations thereof.

The expressions "$1^{st}$,", "$2^{nd}$,", "first,", "second," etc. used in the disclosure may be used to express various components irrespective of order and/or importance, but are used to distinguish one component from other components and do not limit the components.

When it is mentioned that a component (e.g., a first component) is "(operatively or communicatively) coupled with/to" or "connected to" another component (e.g., a second component), it is to be understood that the one component may be directly coupled with/to the other component or may be coupled with/to the other component via another component (e.g., a third component).

When it is mentioned that a component (e.g., a first component) is "directly coupled with/to" or "directly connected to" another element (e.g., a second component), it is to be understood that there is no other component (e.g., a third component) between one component and the other component.

Terms used in the embodiments of the disclosure may be interpreted as meanings commonly known to those of ordinary skill in the art, unless otherwise defined.

Various embodiments of the disclosure will now be described in detail with reference to the accompanying drawings.

Figure 1:
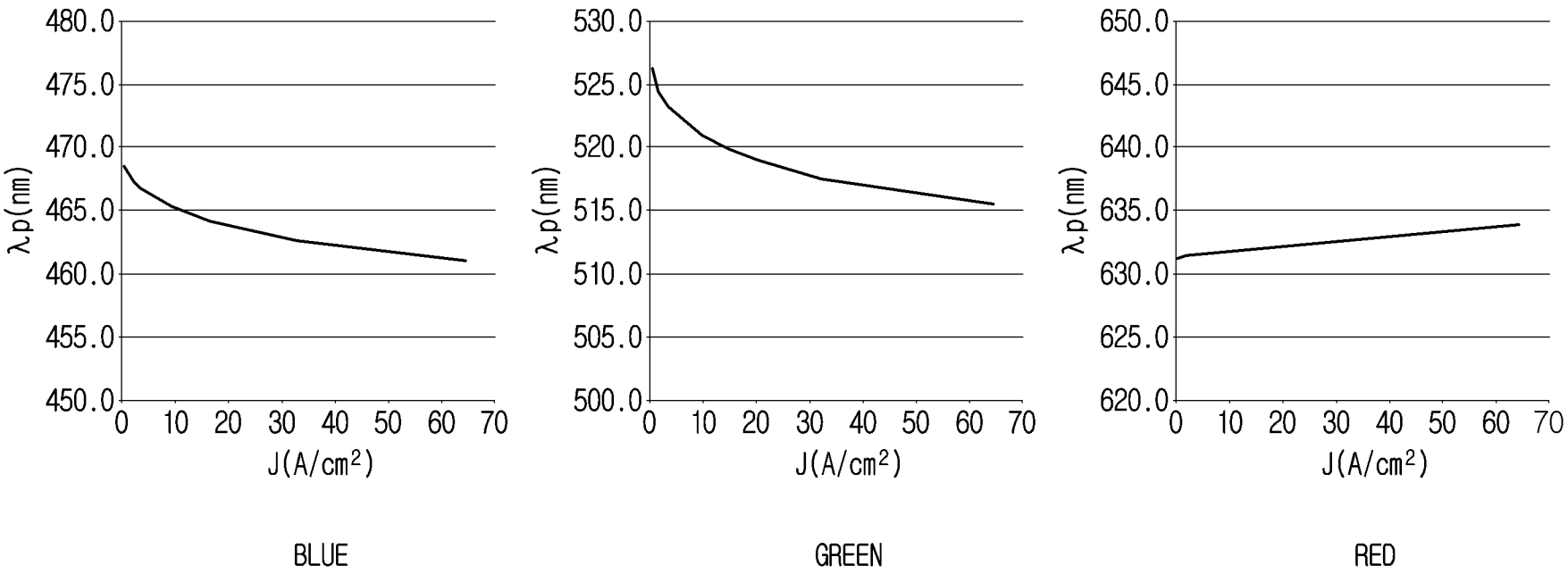
FIG. 1 is a graph showing a wavelength change according to the magnitude of a driving current flowing through a blue light emitting diode (LED), a green LED, and a red LED.
Figure 2:
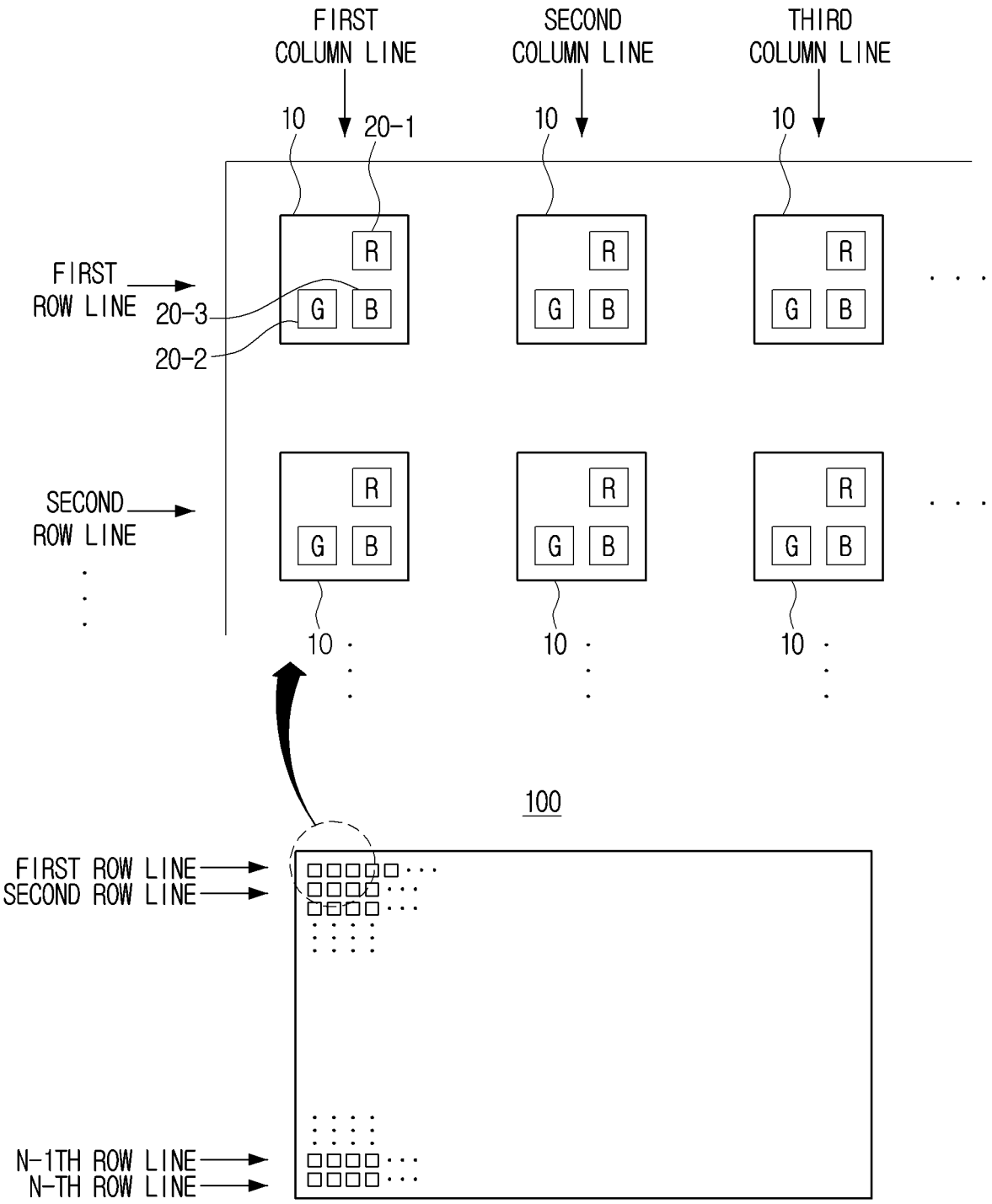
FIG. 2 is a diagram showing a pixel structure of a display module according to an embodiment.

FIG. 2 is a diagram showing a pixel structure of a display panel according to an embodiment.

Referring to FIG. 2, a display panel 100 may include a plurality of pixels 10 disposed (or arranged) in a matrix form. In this regard, the matrix form includes a plurality of row lines or a plurality of column lines.

In some cases, the row line may be referred to as a horizontal line, a scan line, or a gate line, and the column line may be referred to as a vertical line or a data line.

Each pixel 10 included in the display panel 100 may include three types of sub pixels such as a red (R) sub pixel 20-1, a green (G) sub pixel 20-2, and a blue (B) sub pixel 20-3.

Each of the sub pixels 20-1 to 20-3 may include an inorganic light emitting element corresponding to a type of the sub pixel and a sub pixel circuit for controlling a light emission time of the inorganic light emitting element.

That is, the R sub pixel 20-1 may include an R inorganic light emitting element and a sub pixel circuit for controlling the light emission time of the R inorganic light emitting element, the G sub pixel 20-2 may include a G inorganic light emitting element and a sub pixel circuit for controlling the light emission time of the G inorganic light emitting element, and the B sub pixel 20-3 may include a B inorganic light emitting element and a sub pixel circuit for controlling the light emission time of the B inorganic light emitting element.

Each sub pixel circuit may express a grayscale of each sub pixel by controlling the emission time of the corresponding inorganic light emitting element based on an applied pulse width modulation (PWM) data voltage, which will be described in detail later.

Sub pixels included in each row line of the display panel 100 may be driven in the order of setting (or programming) the PWM data voltage and light emitting based on the set PWM data voltage. In this regard, according to an embodiment, the sub pixels included in each row line of the display panel 100 may be driven in the order of row lines.

That is, for example, PWM data voltage setting and light emitting operations of sub pixels included in one row line (e.g., a first row line), and PWM data voltage setting and light emitting operations of sub pixels included in a next row line (e.g., a second row line) may be sequentially performed in the order of row lines.

Here, sequentially performing does not mean that operations related to a next row line need to be started after all operations related to one row line are completed. That is, in the above example, after the PWM data voltage is set to the sub pixels included in the first row line, the PWM data voltage may be set to the sub pixels included in the second row line, and the PWM data voltage does not need to be necessarily set to the sub pixels included in the second row line after the light emitting operations of the sub pixels included in the first row line are completed.

Figure 3A:
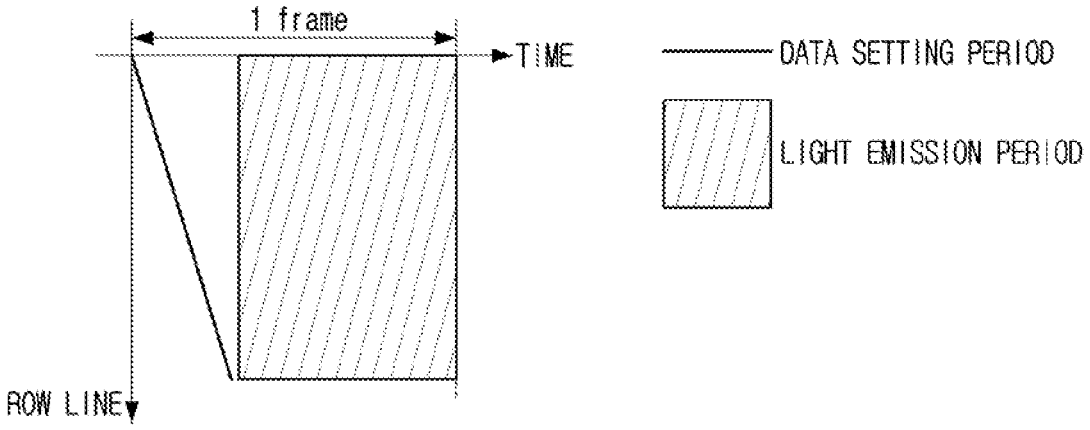
FIG. 3A is a conceptual diagram showing a driving method of a display panel according to related art.
Figure 3B:
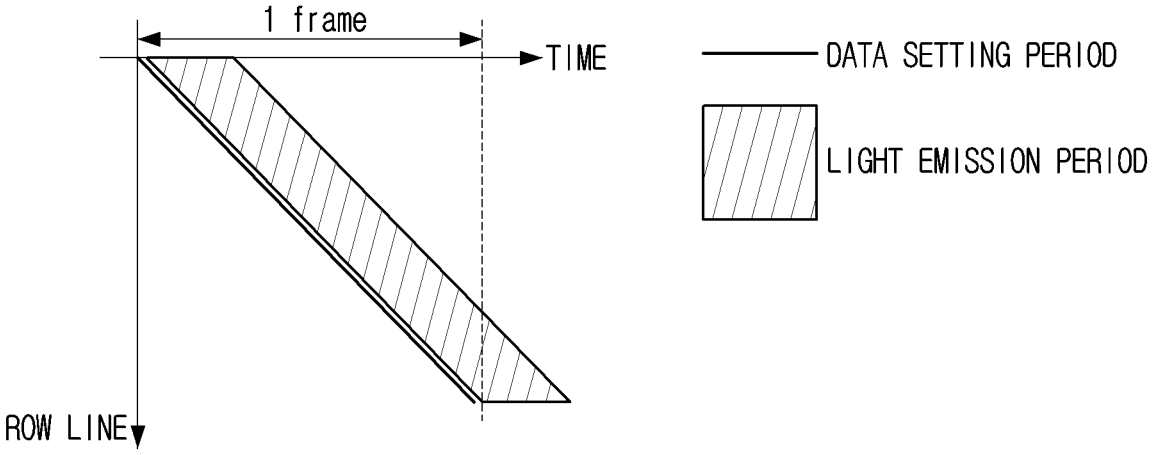
FIG. 3B is a conceptual diagram showing a driving method of a display panel according to an embodiment.
Figure 3C:
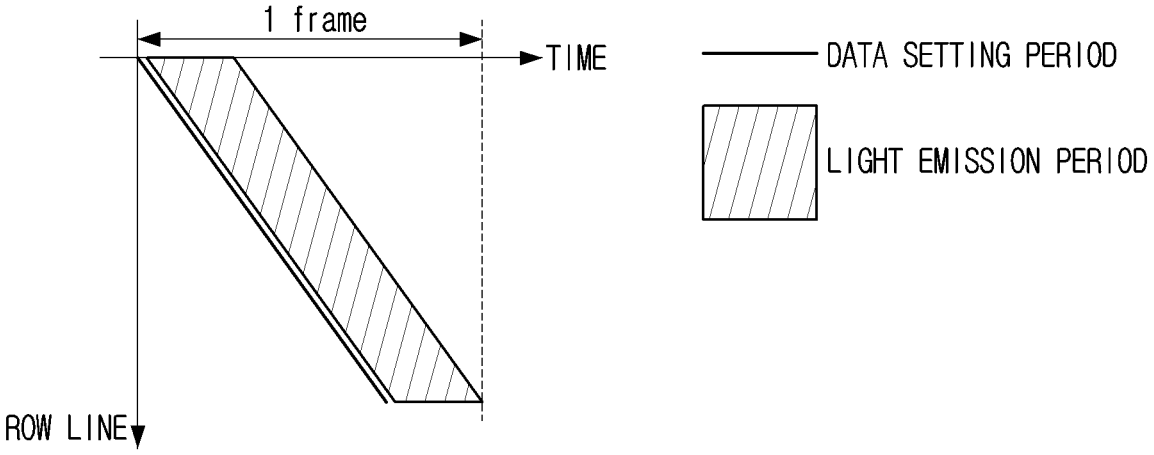
FIG. 3C is a conceptual diagram showing a driving method of a display panel according to an embodiment.
Figure 3D:
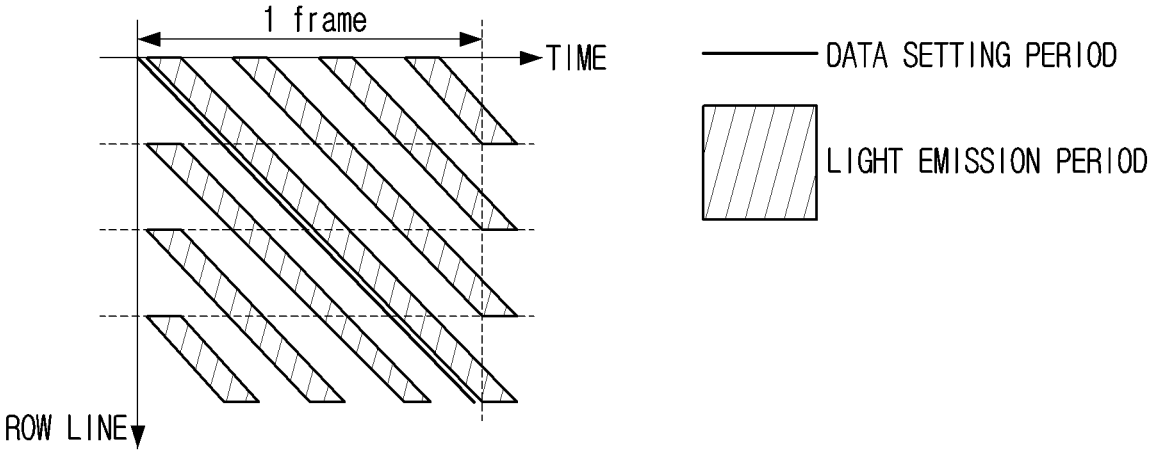
FIG. 3D is a conceptual diagram showing a driving method of a display panel according to an embodiment.

FIG. 3A is a conceptual diagram showing a driving method of a display panel according to the related art, and FIGS. 3B to 3D are conceptual diagrams showing a driving method of a display panel according to various embodiments.

FIGS. 3A to 3D show various methods of driving the display panel during one image frame time. In FIGS. 3A to 3D, the vertical axis indicates a row line and the horizontal axis indicates time. In addition, a data setting period indicates a driving period of the display panel 100 that is set by applying a PWM data voltage to sub pixels included in each row line, and a light emission period indicates a driving period of the display panel 100 in which the sub pixels emit light during a time corresponding to the PWM data voltage within the period.

According to FIG. 3A, in the related art, it may be seen that after completely setting the PWM data voltage to all row lines of the display panel first, the light emission period collectively proceeds.

In this case, because all row lines of the display panel simultaneously emit light during the light emission period, a high peak current is required, and thus, there is a problem in that peak power consumption required for the product is increased. When the peak power consumption increases, the capacity of a power supply device such as a switched mode power supply (SMPS) installed in the product increases, resulting in an increase in cost and volume, which causes design restrictions.

In the embodiment of FIGS. 3B to 3D, there may be merely a difference of only whether the PWM data voltage setting is completed for all row lines during one image frame time (in the case of FIG. 3B), whether the light emission period for all row lines during one image frame time completely proceeds (in the case of FIG. 3C) or whether a plurality of light emission periods exist during one image frame time (in the case of FIG. 3D), it may be seen that the PWM data voltage setting period and the light emission period of each row line proceed sequentially in the order of row lines.

As described above, when the light emission periods for each row line are sequentially driven in the order of row lines according to various embodiments, because the number of row lines that simultaneously emit light is reduced, a required peak current amount is lowered compared with the prior art, and accordingly, the peak power consumption may be reduced.

As described above, according to various embodiments, an occurrence in which a wavelength of light emitted by the inorganic light emitting element changes according to a grayscale may be prevented by PWM driving an inorganic light emitting element in an active matrix (AM) method. In addition, instantaneous peak power consumption may be reduced by driving the display panel 100 such that the sub pixels emit light sequentially in the order of row lines.

FIG. 2 shows an example where the sub pixels 20-1 to 20-3 are arranged in the L shape with the left and right inverted in one pixel region. However, the embodiments are not limited thereto, and the R, G, and B sub pixels 20-1 to 20-3 may be arranged in a line within the pixel region, or may be arranged in various shapes according to embodiments.

In addition, in FIG. 2, it is described by way of an example that three types of sub pixels constitute one pixel. However, according to embodiments, four types of sub pixels such as R, G, B, and W (white) may constitute one pixel, or any number of different sub pixels may constitute one pixel.

Figure 4:
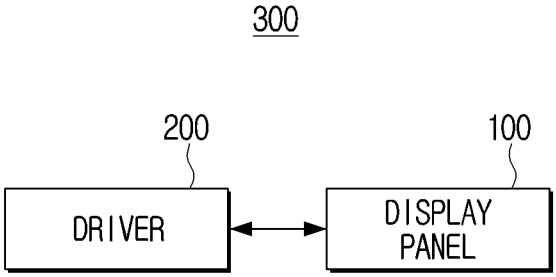
FIG. 4 is a block diagram showing a configuration of a display module according to an embodiment.

FIG. 4 is a block diagram showing a configuration of a display module according to an embodiment. Referring to FIG. 4, a display module 300 may include a display panel 100 and a driver 200.

The driver 200 may drive the display panel 100. Specifically, the driver 200 may provide various control signals, data signals, and power signals to the display panel 100 to drive the display panel 100.

To this end, the driver 200 may include at least one gate driver circuit (or a scan driver circuit) for providing a control signal for driving pixels of the display panel 100 arranged in a matrix form in units of row lines.

Further, the driver 200 may include a source driver circuit (or a data driver circuit) for providing a PWM data voltage to each pixel (or each sub pixel) of the display panel 100 arranged in the matrix form.

In addition, the driver 200 may include a MUX circuit for selecting each of the plurality of sub pixels 20-1 to 20-3 constituting the pixel 10.

In addition, the driver 200 may include a driving voltage providing circuit for providing various driving voltages (e.g., a first driving voltage, a second driving voltage, a ground voltage, a test voltage, a Vset voltage, etc. to be described later) or a constant current generator voltage to be described later to each sub pixel circuit included in the display panel 100.

In addition, the driver 200 may include a clock signal providing circuit that provides various clock signals for driving a gate driver or a data driver circuit, and may include a sweep voltage providing circuit for providing a sweep voltage to be described later.

According to an embodiment, at least some of the various circuits of the driver 200 described above may be implemented in the form of a separate chip and mounted on an external printed circuit board (PCB) together with a timing controller (TCON), and may be connected to sub pixel circuits formed in a TFT layer of the display panel 100 through a film on glass (FOG) wiring.

According to an embodiment, at least some of the various circuits of the driver 200 described above may be implemented in a separate chip form and disposed on a film in a chip on film (COF) form, and may be connected to the sub pixel circuits formed in the TFT layer of the display panel 100 through the FOG wiring.

According to an embodiment, at least some of the various circuits of the driver 200 described above may be implemented in a separate chip form and disposed in the COG form (that is, disposed on a rear surface (on the opposite surface of a surface on which the TFT layer is formed with respect to a glass substrate (to be described later)) of the glass substrate of the display panel 100), and may be connected to the sub pixel circuits formed in the TFT layer of the display panel 100 through a connection wiring.

According to an embodiment, at least some of the various circuits of the driver 200 described above may be formed in the TFT layer together with the sub pixel circuits formed in the TFT layer in the display panel 100 and connected to the sub pixel circuits.

For example, among the various circuits of the driver 200 described above, the gate driver circuit, the sweep voltage providing circuit, and the MUX circuit may be formed in the TFT layer of the display panel 100, the data driver circuit may be disposed on the rear surface of the glass substrate of the display panel 100, and the driving voltage providing circuit, the clock signal providing circuit, and the timing controller (TCON) may be disposed on an external printed circuit board (PCB), but are not limited thereto.

In particular, according to an embodiment, the driver 200 may apply the PWM data voltage to sub pixels included in each row line of the display panel 100 in the order of row lines, and drive the display panel 100 such that sub pixels included in at least some consecutive row lines among a plurality of row lines emit light for a time corresponding to the applied PWM data voltage in the order of row lines.

Here, the at least some consecutive row lines may refer to all row lines of the display panel 100 or, consecutive row lines of each group when all row lines of the display panel 100 are divided into a plurality of groups including some consecutive row lines.

Accordingly, the driver 200 may drive the display panel 100 such that the sub pixels included in all row lines of the display panel 100 emit light in the order of row lines, as shown in FIGS. 3B and 3C.

In addition, as shown in FIG. 3D, the driver 200 may drive the display panel 100 such that sub pixels included in row lines belonging to each group emit light in the order of row lines for each group of the row line including consecutive row lines.

Hereinafter, a driving method of the display panel 100 as shown in FIG. 3D will be described in detail with reference to FIGS. 5 to 9.

Figure 5:
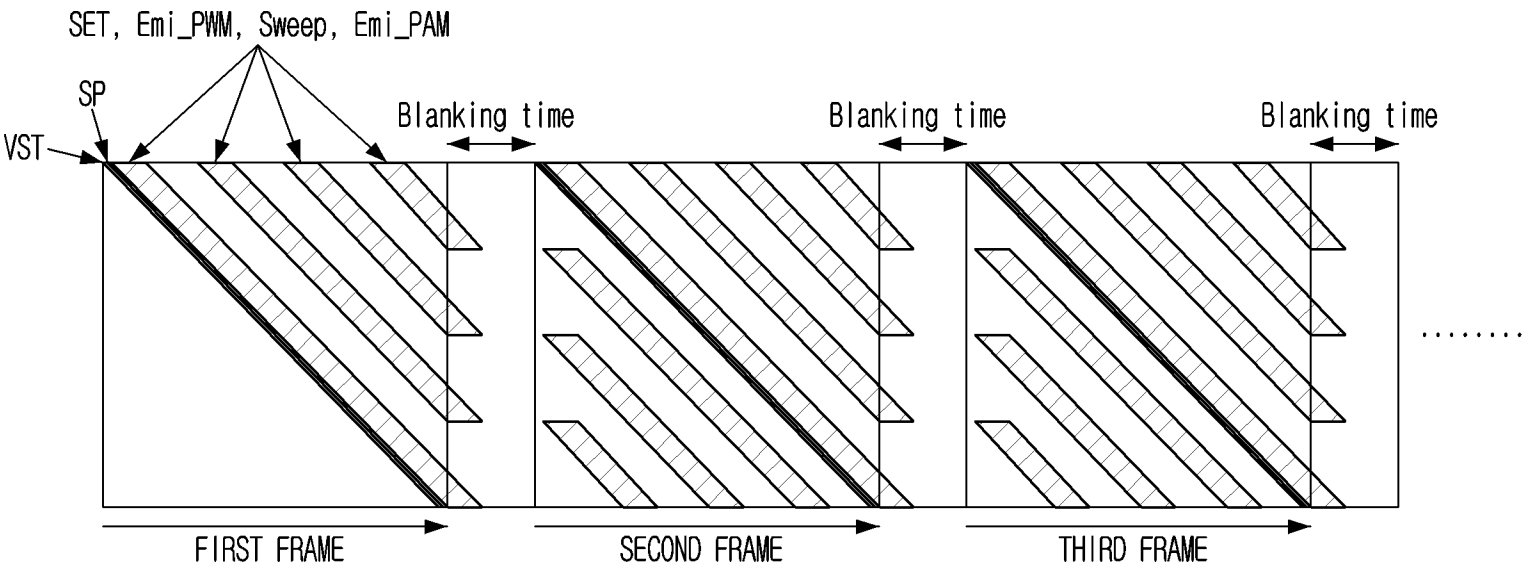
FIG. 5 is a diagram showing a driving method of a display panel for a plurality of image frames according to an embodiment.

FIG. 5 shows a driving method of the display panel 100 for a plurality of image frames. In each frame of FIG. 5, the vertical axis indicates a row line and the horizontal axis indicates time. In addition, a blanking time indicates a time period between frames to which valid image data is not applied.

VST and SP denote control signals of the driver 200 applied to the sub pixels included in each row line for a data setting operation, and SET, Emi_PWM, Sweep, and Emi_PAM denote control signals of the driver 200 applied to the sub pixels included in each row line for a light emitting operation. Such various control signals of the driver 200 will be described in detail later.

Referring to FIG. 5, it may be seen that during one image frame time, for each row line, the data setting period (i.e., a time period to which the control signals VST and SP are applied) proceeds once, and the light emission period (i.e., a time period to which the control signals SET, Emi_PWM, Sweep, and Emi_PAM are applied) proceeds multiple times.

That is, according to an embodiment, the driver 200 may apply a PWM data voltage to sub pixels included in each row line during the data setting period for each row line, and drive the display panel 100 such that in a plurality of light emission periods for each row line, the sub pixels included in each row line emit light for a time corresponding to the applied PWM data voltage.

Figure 6:
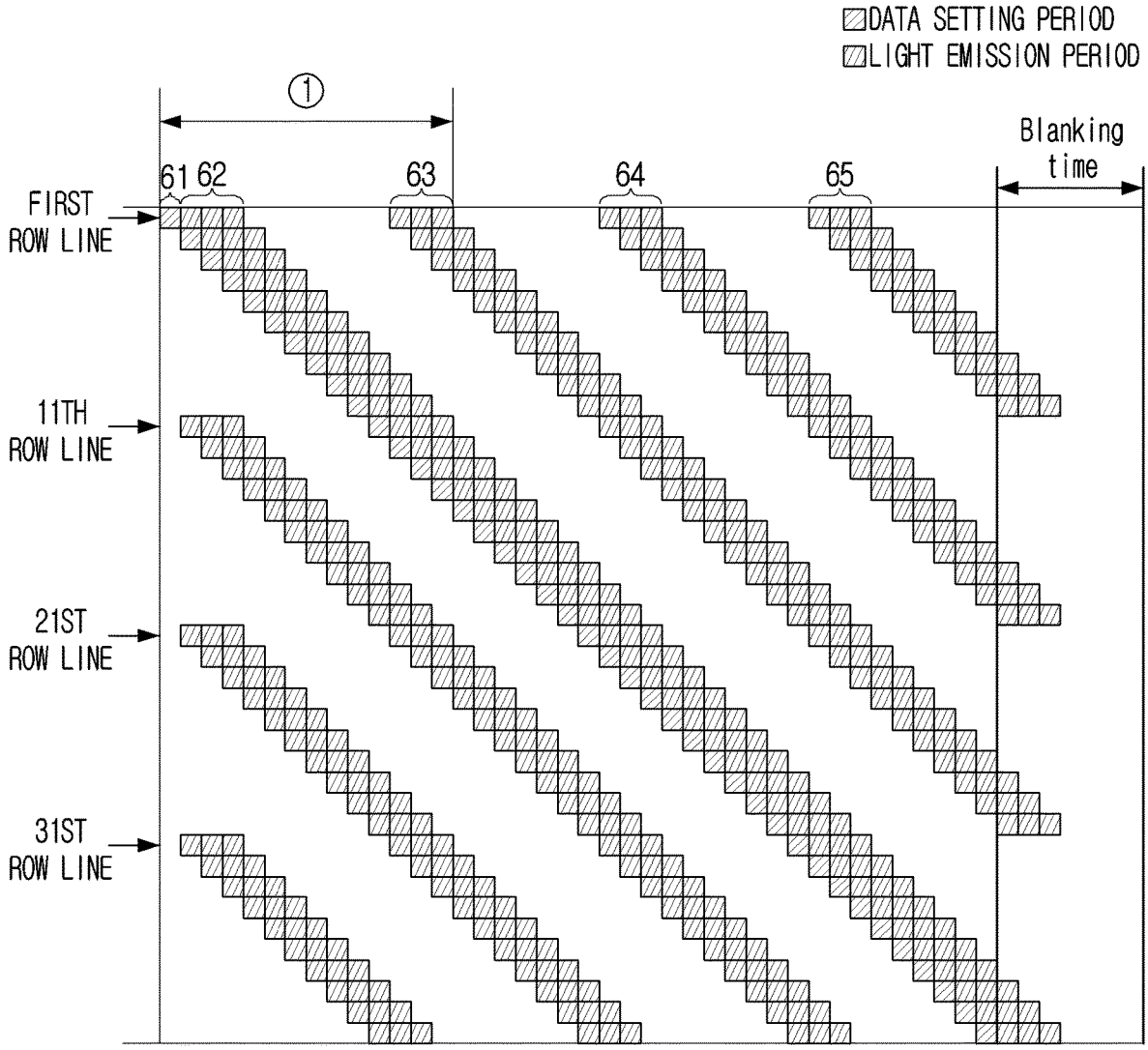
FIG. 6 is a diagram showing a second frame shown in FIG. 5 in more detail.

FIG. 6 is a diagram showing a second frame shown in FIG. 5 in more detail. In FIG. 6, the vertical axis indicates a row line and the horizontal axis indicates time. In FIG. 6, for convenience of description, the display panel 100 includes 40 row lines by way of an example.

Referring to FIG. 6, the driver 200 applies the control signals VST and SP to sub pixels included in a first row line, for example, during a data setting period 61 for the first row line. Accordingly, PWM data voltages provided from a data driver are set (or programmed) to the sub pixels included in the first row line, respectively.

Thereafter, the driver 200 applies the control signals (SET, Emi_PWM, Sweep, and Emi_PAM) to the sub pixels included in the first row line during a first light emission period 62 for the first row line. Accordingly, the sub pixels included in the first row line emit light for a time corresponding to the PWM data voltage that is set in the data setting period 61, in the first light emission period 62.

Thereafter, even during a second light emission period 63 for the first row line, as in the first light emission period 62, the driver 200 applies the control signals (SET, Emi_PWM, Sweep, and Emi_PAM) to the sub pixels included in the first row line. Accordingly, the sub pixels included in the first row line emit light for a time corresponding to the PWM data voltage that is set in the data setting period 61, even in the second light emission period 63.

This is also the same in a third light emission period 64 and a fourth light emission period 65 for the first row line.

As shown in FIG. 6, the driver 200 may perform the above-described operation for the first row line on sub pixels included in the remaining row lines (a second row line to a 40throw line) sequentially in the order of row lines.

In FIG. 6, because only one frame period (i.e., the second frame period) is shown, it is shown that a light emission period only proceeds three times after the data setting period proceeds from an 11th row line to a 20th row line, only a light emission period proceeds two times after the data setting period proceeds from a 21st row line to a 30th row line, and only a light emission period proceeds once after the data setting period proceeds from a 31st row line to a 40th row line. However, it may be seen in a second frame period and a third frame period shown in FIG. 5 together that a light emission period proceeds four times, respectively, after the data setting period also proceeds from the 11th row line to the 40th row line.

According to the example shown in FIG. 6, it may be seen that the first light emission period 62 among a plurality of light emission periods for the first row line is temporally consecutive with the data setting period 61 for the first row line, and each of the plurality of light emission periods 62 to 65 has a predetermined time interval. This is the same for the remaining row lines.

In this regard, according to an embodiment, the number of light emission periods proceeding in each row line during one image frame period and a predetermined time interval between the light emission periods may be set based on the size of the display panel 100 and/or a shutter speed of a camera or the like. However, the embodiment is not limited thereto.

In general, because the shutter speed of the camera is several times faster than that of one image frame time, as shown in FIG. 3B or 3C, when the display panel 100 is driven such that a light emission period proceeds once in the order of row lines over one image frame time, an image displayed on the display panel 100 taken by the camera may be distorted.

Accordingly, as shown in FIG. 3D, while the display panel 100 is driven such that a plurality of light emission periods proceed at a predetermined time interval during one image frame time, the predetermined time interval is set based on the speed of the camera, and thus even though the display panel 100 is captured at any moment, the image displayed on the display panel 100 taken by the camera may not be distorted.

The data setting periods and the light emission periods shown in FIG. 6 are merely shown to conceptually explain a data setting operation and a light emitting operation performed in the order of row lines over time, and the specific driving timing of the control signals VST and SP for data setting or the control signals SET, Emi_PWM, Sweep, and Emi_PAM for the light emitting operation are not limited to those shown in FIG. 6. The specific driving timing of the control signals will be described in detail later after FIG. 13.

Figure 7:
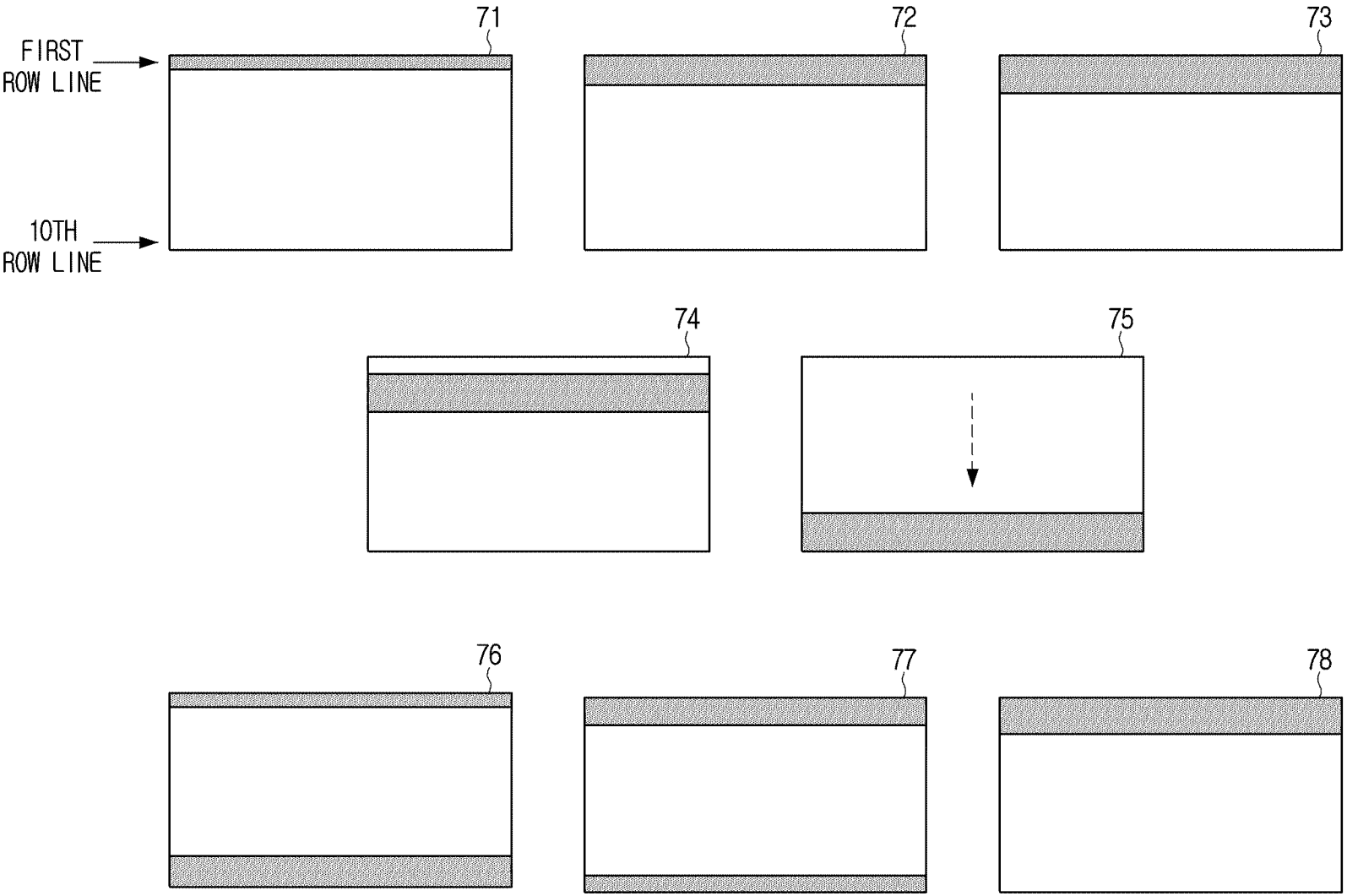
FIG. 7 is a diagram showing a light emitting operation of a display panel according to an embodiment.
Figure 8:
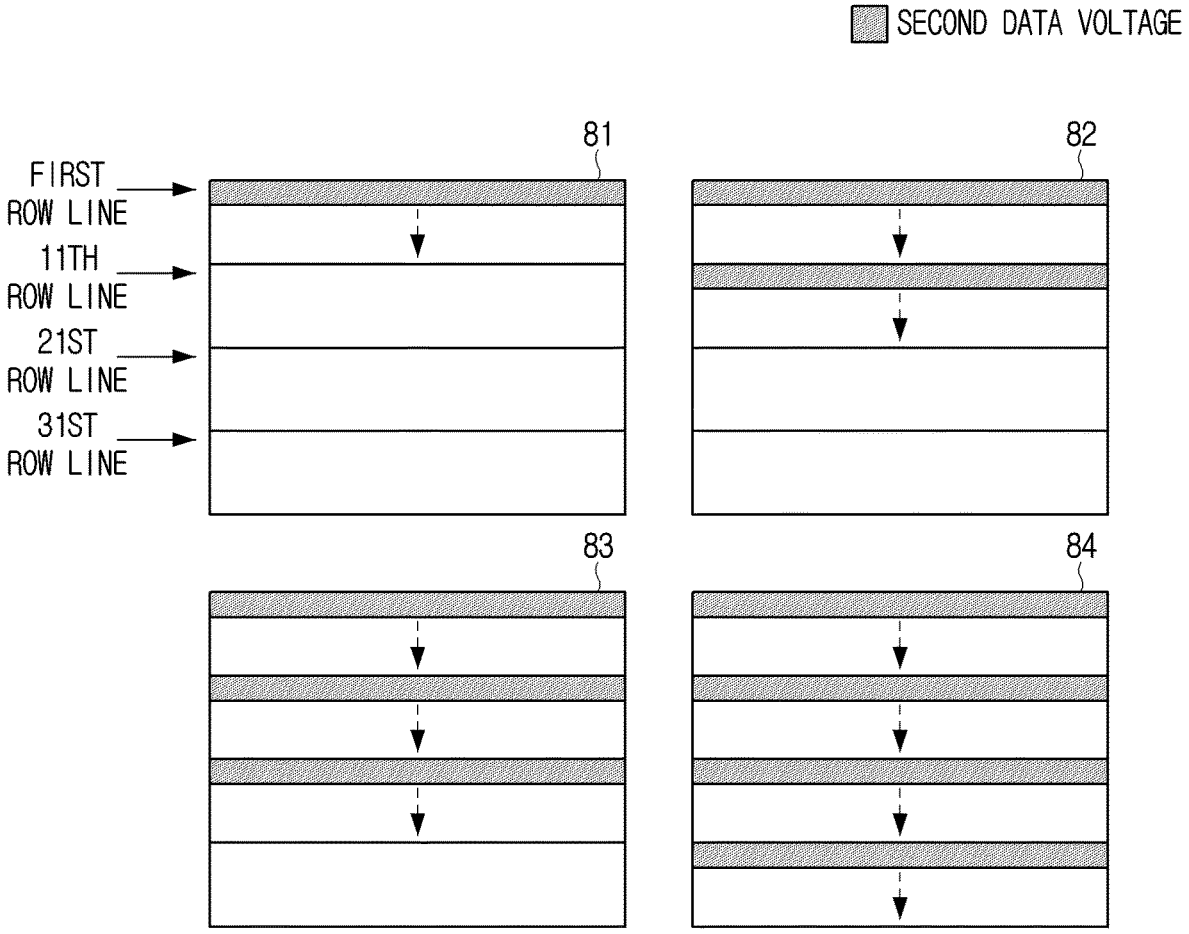
FIG. 8 is a diagram showing a light emitting operation of a display panel according to an embodiment.
Figure 9:
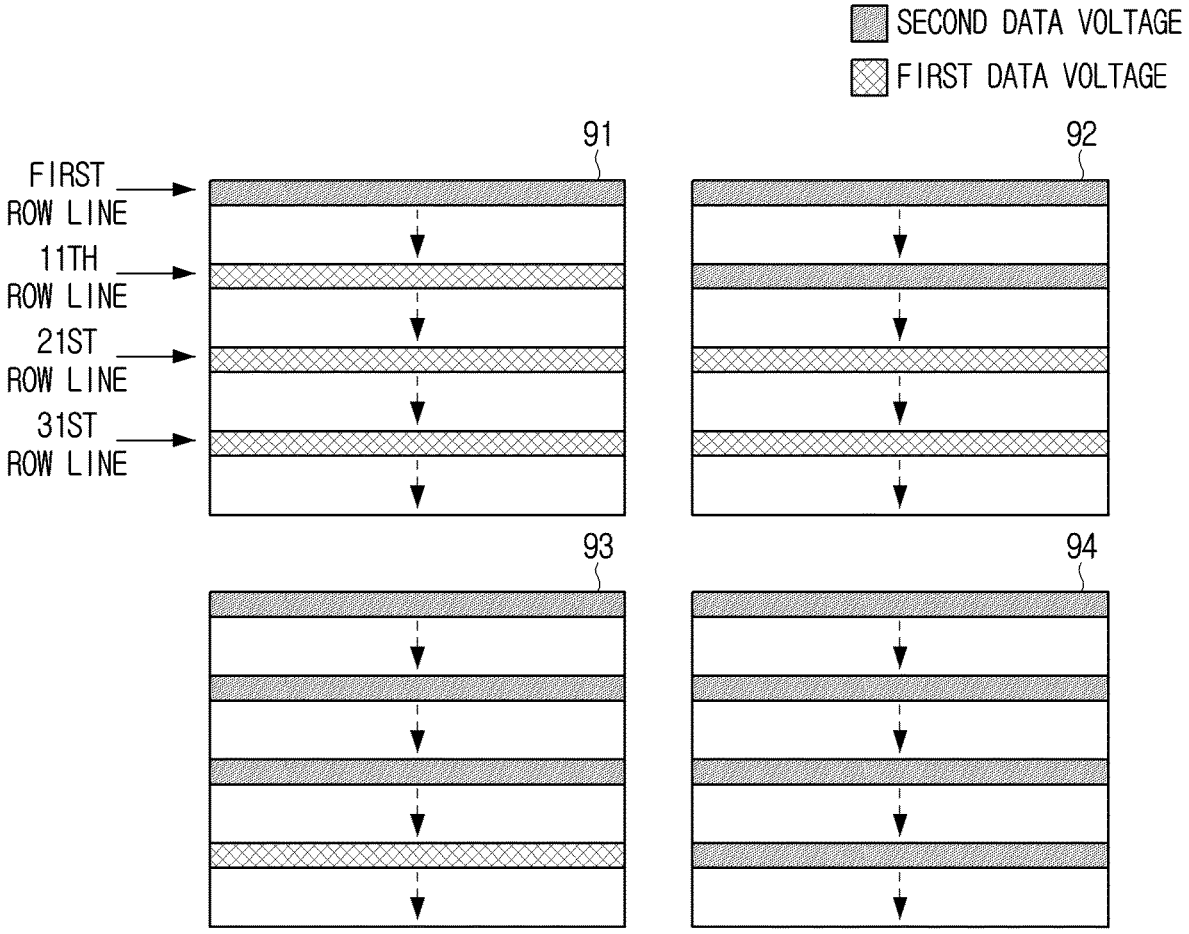
FIG. 9 is a diagram showing a light emitting operation of a display panel according to an embodiment.

Hereinafter, an image displayed on the display panel 100 during one image frame period will be described with reference to FIGS. 7 to 9 together with FIG. 6. FIGS. 7 to 9 are illustrated assuming that a PWM data voltage corresponding to a full white grayscale is set to each sub pixel of the display panel 100 for convenience of explanation.

FIG. 7 shows a light emitting operation of a first row line to a 10th row line of the display panel 100 during a time ① shown in FIG. 6 when the display panel 100 is driven as shown in FIG. 6 during one image frame period.

Specifically, when the first light emission period 62 of the first row line starts, as shown by reference numeral 71 of FIG. 7, the first row line of the display panel 100 starts to emit light (specifically, sub pixels included in a row line emit light, but hereinafter, for convenience of description, it will be abbreviated that the row line emits light).

Thereafter, when a first light emission period of a second row line starts, because the light emission period of the first row line has not ended, as shown by reference numeral 72 of FIG. 7, the first row line and the second row line emit light together.

Thereafter, when a first light emission period of a third row line starts, because the light emission periods of the first and second row lines have not ended, as shown in reference numeral 73 of FIG. 7, the first to third row lines emit light together.

Thereafter, when a first light emission period of a fourth row line starts, because the first light emission period 62 of the first row line ends, as shown by reference numeral 74 of FIG. 7, the first row line stops emitting light, and the second to fourth row lines emit light together.

In this way, light emission of the three row lines sequentially proceeds to the 10th row line. Reference numeral 75 of FIG. 7 denotes that a first light emission period of the 10th row line starts and 8th to 10th row lines emit light.

Thereafter, when the second light emission period 63 of the first row line starts, because a first light emission period of the 8th row line ends, as shown by reference numeral 76 of FIG. 7, the first row line emits light again together with the 9th and 10th row lines.

Thereafter, when a second light emission period of the second row line starts, because the first light emission period of the 9th row line ends, as shown by reference numeral 77 of FIG. 7, the 10th row line, the first row line, and the second row line emit light together.

Finally, when a second light emission period of the third row line starts, the first light emission period of the 10th row line ends, and as shown by reference numeral 78 of FIG. 7, the first to third row lines emit light again.

Thereafter, in the same manner, the light emitting operations of the three row lines are sequentially repeated as described above.

In the above, although the light emitting operation of the first to 10th row lines are described, it may be seen that with regard to the proceeding of the light emission periods shown in FIG. 6 over time, even in the case of the 11th row line to the 20th row line, the 21st row line to the 30th row line, and the 31st row line to the 40th row line, each row line may emit light in the same manner as described through the first to 10th row lines.

However, it may be seen that in the case of the 11th row line to the 20th row line, the 21st row line to the 30th row line, and the 31st row line to the 40th row line, the PWM data voltage which is the basis for light emission is different from the case of the first to 10th row lines.

Hereinafter, light emitting operations of all row lines of the display panel 100 will be described through FIGS. 8 and 9.

FIG. 8 shows a light emitting operation of row lines based on a PWM data voltage (hereinafter referred to as a second PWM data voltage) applied during an image frame period (i.e., a second frame period of FIG. 5) shown in FIG. 6. The order of the light emission periods used in the description of FIGS. 8 and 9 means the order of the light emission periods based on the second PWM data voltage.

The light emitting operation of the row lines based on the PWM data voltage (hereinafter referred to as a first PWM data voltage) applied during a first frame period of FIG. 5 is not shown in FIG. 8.

As described above in FIG. 7, the first to 10th row lines sequentially emit light based on the second PWM data voltage applied to each row line during the first light emission period. Reference numeral 81 in FIG. 8 denotes this.

Thereafter, when the first light emission period of the 11th to 20th row lines proceeds together with the second light emission period of the first to 10th row lines, as shown by reference numeral 82 of FIG. 8, the first to 10th row lines and the 11th to 20th row lines sequentially emit light based on the second PWM data voltage.

Thereafter, when the third light emission period of the first to 10th row lines, the second light emission period of the 11th to 20th row lines, and the first light emission period of the 21st to 30th row lines proceed together, as shown by reference numerals 83 of FIG. 8, the first to 10th row lines, the 11th to 20th row lines, and the 21st to 30th row lines sequentially emit light based on the second PWM data voltage.

Finally, when the fourth light emission period of the first to 10th row lines, the third light emission period of the 11th to 20th row lines, the second light emission period of the 21st to 30th row lines, and the first light emission period of the 31st to 40th row lines proceed together, as shown by reference numeral 84 of FIG. 8, the first to 10th row lines, the 11th to 20th row lines, the 21st to 30th row lines, and the 31st to 40th row lines sequentially emit light based on the second PWM data voltage.

Specifically, according to an embodiment, a plurality of row lines included in the display panel 100 may be divided into a plurality of groups each including consecutive row lines.

In the above example, the first to 10th row lines may be divided into a first group, the 11th to 20th row lines may be divided into a second group, the 21st to 30th row lines may be divided into a third group, and the 31st to 40th row lines may be divided into a fourth group.

The driver 200 may apply the PWM data voltage to the sub pixels included in each row line in the order of row lines from the first row line to the last row line of the plurality of row lines during one image frame period.

That is, as shown in FIG. 6, it may be seen that, during one image frame period (that is, the second frame period of FIG. 5), the driver 200 may apply the PWM data voltage to the sub pixels included in each row line in the order of row lines from the first row line to the 40th row line.

In addition, the driver 200 may drive the display panel 100 such that the sub pixels included in one of the plurality of groups emit light in the order of row lines and then the sub pixels included in each of at least two consecutive groups emit light in the order of row lines, during the one image frame period, based on the applied second PWM data voltage. The at least two consecutive groups may include the one group.

That is, the driver 200 may drive the display panel 100 such that, as shown by reference numeral 81 of FIG. 8, the sub pixels included in the first group emit light in the order of row lines based on the second PWM data voltage and then, as shown by reference numeral 82 of FIG. 8, the sub pixels included in each of the first group and the second group emit light in the order of row lines based on the second PWM data voltage, during one image frame period (that is, the second frame period of FIG. 5).

That is, the driver 200 may drive the display panel 100 such that, as shown by reference numeral 82 of FIG. 8, the sub pixels included in each of the first group and the second group emit light in the order of row lines based on the second PWM data voltage and then, as shown by reference numeral 83 of FIG. 8, the sub pixels included in each of the first group to the third group emit light in the order of row lines based on the second PWM data voltage, during one image frame period (that is, the second frame period of FIG. 5).

That is, the driver 200 may drive the display panel 100 such that, as shown by reference numeral 83 of FIG. 8, the sub pixels included in each of the first group to the third group emit light in the order of row lines based on the second PWM data voltage and then, as shown by reference numeral 84 of FIG. 8, the sub pixels included in each of the first group to the fourth group emit light in the order of row lines based on the second PWM data voltage, during one image frame period (that is, the second frame period of FIG. 5).

FIG. 9 shows a light emitting operation of all row lines of the display panel 100 based on a first PWM data voltage and a second PWM data voltage.

Referring to FIG. 6, it may be seen that while the first light emission period of the first to 10th row lines proceeds in the order of row lines, the light emission period for the 11th to 20th row lines, the 21st to 30th row lines, and the 31st to 40 throw lines also proceeds together in the order of row lines for each group. At this time, the first to 10th row lines emit light based on the second PWM data voltage, the remaining row lines emit light based on the first PWM data voltage, and reference numeral 91 of FIG. 9 shows this.

Referring back to FIG. 6, while the second light emission period for the first to 10th row lines and the first light emission period for the 11th to 20th row lines proceed in the order of row lines, and the light emission period for the 21st to 30th row lines and the 31st to 40th row lines also proceed together in the order of row lines for each group. At this time, the first to 20th row lines emit light based on the second PWM data voltage, and the remaining row lines emit light based on the first PWM data voltage, and reference numeral 92 of FIG. 9 shows this.

Referring back to FIG. 6, while the third light emission period for the first to 10th row lines, the second light emission period for the 11th to 20th row lines, and the first light emission period for the 21st to 30th row lines proceed in the order of row lines, the light emission period for the 31st to 40th row lines also proceed together in the order of row lines. At this time, the first to 30th row lines emit light based on the second PWM data voltage, and the 31st to 40th row lines emit light based on the first PWM data voltage, and reference numeral 93 of FIG. 9 shows this.

Referring back to FIG. 6, in the fourth light emission period for the first to 10th row lines, the third light emission period of the 11th to 20th row lines, the second light emission period of the 21st to 30th row lines, and the first light emission period of the 31st to 40th row lines proceed together in the order of row lines. In this case, all of the first to 40th row lines emit light based on the second PWM data voltage, and reference numeral 94 of FIG. 9 indicates this. Reference numeral 94 of FIG. 9 may be the same as reference numeral 84 of FIG. 8.

Specifically, as described above in FIG. 8, the driver 200 may drive the display panel 100 such that during one image frame period (e.g., the second frame period in FIG. 5), based on the second PWM data voltage, the sub pixels included in one group among the plurality of groups emit light in the order of row lines and then, the sub pixels included in each of at least two consecutive groups emit light in the order of row lines.

At the same time, the driver 200 may drive the display panel 100 such that during the one image frame period (e.g., the second frame period in FIG. 5), the sub pixels included in each of the remaining groups other than at least one group driven based on the second PWM data voltage among the plurality of groups emit light in the order of row lines based on the first PWM data voltage.

In this way, it may be seen that the driver 200 may drive the display panel 100 such that during one image frame period (e.g., the second frame period in FIG. 5), the sub pixels included in each row line of each of the plurality of groups emit light multiple times in a plurality of light emission periods for each row line based on at least one of the first or second PWM data voltage, thereby driving the display panel 100 as described above with reference to FIG. 9.

In FIGS. 3D and 5 through 9, for convenience of description, the case where the display panel 100 includes 40 row lines and the light emission period proceeds four times for each row line is described by way of an example, but the embodiment is not limited thereto, and there may be various embodiments according to the size or implementation example of the display panel 100.

For example, the driver 200 may drive the display panel 100 including 270 row lines in which 480 pixels are arranged for each row line such that the light emission period proceeds 9 times for each row line.

Hereinafter, a specific configuration and operation of the display panel 100 according to an embodiment will be described in detail with reference to FIGS. 10 to 22.

Figure 10:
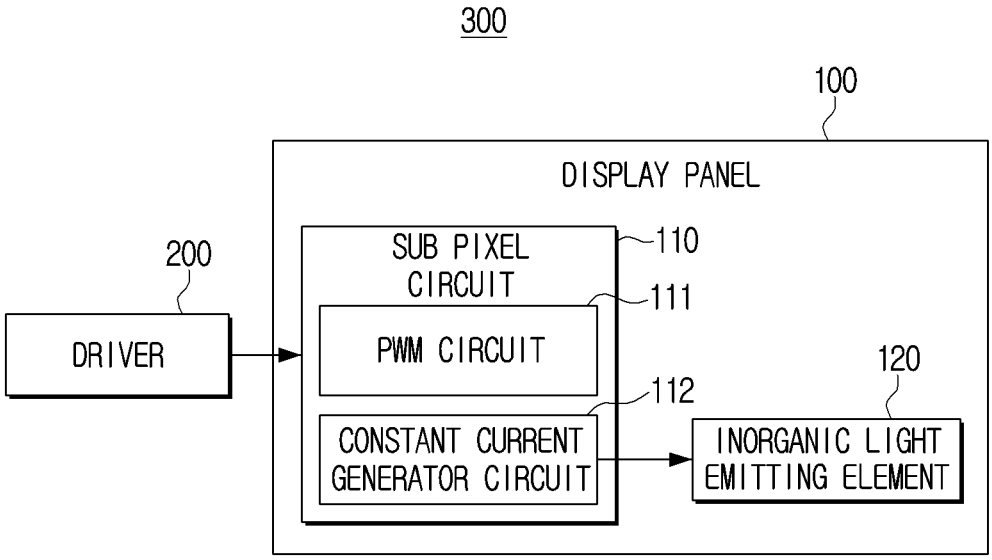
FIG. 10 is a block diagram of a display module according to an embodiment.

FIG. 10 is a block diagram showing a configuration of a display module 300 according to an embodiment. In the description of FIG. 10, descriptions redundant with those described above in FIG. 4 will be omitted.

Referring to FIG. 10, the display module 300 includes the display panel 100 including a sub pixel circuit 110 and an inorganic light emitting element 120, and the driver 200.

The display panel 100 may have a structure in which the sub pixel circuit 110 is formed on a glass and the inorganic light emitting element 120 is disposed on the sub pixel circuit 110, as will be described later. In FIG. 10, only one sub pixel-related configuration included in the display panel 100 is shown for convenience of description, but the sub pixel circuit 110 and the inorganic light emitting element 120 are provided for each sub pixel of the display panel 100 described above.

The inorganic light emitting element 120 may be mounted on the sub pixel circuit 110 to be electrically connected to the sub pixel circuit 110 and emits light based on a driving current provided from the sub pixel circuit 110.

The inorganic light emitting element 120 may include the sub pixels 20-1 to 20-3 of the display panel 100, and may include a plurality of types according to a color of the emitted light. For example, the inorganic light emitting element 120 may include a red (R) inorganic light emitting element that emits red light, a green (G) inorganic light emitting element that emits green light, and a blue (B) inorganic light emitting element that emits blue light.

Accordingly, the type of the above-described sub pixel may be determined according to the type of the inorganic light emitting element 120. That is, the R inorganic light emitting element may include the R sub pixel 20-1, the G inorganic light emitting element may include the G sub pixel 20-2, and the B inorganic light emitting element may include the B sub pixel 20-3.

Here, the inorganic light emitting element 120 may refer to a light emitting element manufactured using an inorganic material, different from an organic light emitting diode (OLED) manufactured using an organic material.

In particular, according to an embodiment, the inorganic light emitting element 120 may be a micro light emitting diode (micro LED or μLED) having a size less than or equal to 100 micrometers (μm).

A display panel in which each sub pixel is implemented as the micro LED is a micro LED display panel. The micro LED display panel is one of flat panel display panels, and includes a plurality of inorganic light emitting diodes (inorganic LEDs) each less than or equal to 100 micrometers. The micro LED display panel may provide better contrast, response time and energy efficiency compared with liquid crystal display (LCD) panel that requires backlighting. The organic light emitting diode (OLED) and the micro LED both have good energy efficiency, whereas the micro LED provides better performance than the OLED in terms of brightness, luminous efficiency, and lifespan.

The inorganic light emitting element 120 may express grayscale values of different brightness according to the magnitude of a driving current provided from the sub pixel circuit 110 or a pulse width of the driving current. Here, the pulse width of the driving current may be referred to as a duty ratio of the driving current or a duration of the driving current.

For example, the inorganic light emitting element 120 may express a brighter grayscale value as the driving current increases. In addition, the inorganic light emitting element 120 may express a brighter grayscale value as the pulse width of the driving current increases (i.e., the duty ratio increases or the duration increases).

The sub pixel circuit 110 provides the driving current to the inorganic light emitting element 120. Specifically, the sub pixel circuit 110 may provide the driving current of which size and duration are controlled to the inorganic light emitting element 120 based on a data voltage (e.g., a constant current generator voltage, a PWM data voltage), and a driving voltage (e.g., a first driving voltage, a second driving voltage) applied from the driver 200 and various control signals.

That is, the sub pixel circuit 110 may control the brightness of light emitted by the inorganic light emitting element 120 by driving the inorganic light emitting element 120 through pulse amplitude modulation (PAM) and/or pulse width modulation (PWM).

To this end, the sub pixel circuit 110 may include a constant current generator circuit 112 for providing a constant current of a certain size to the inorganic light emitting element 120 based on an applied constant current generator voltage, and a PWM circuit 111 for providing the constant current provided by the constant current generator circuit 112 to the inorganic light emitting element 120 for a time corresponding to the applied PWM data voltage. Here, the constant current provided to the inorganic light emitting element 120 becomes the above-described driving current.

Various circuits of the above-described driver 200 may be implemented as a micro or nano sized integrated circuit (IC), and may be mounted in a direction of a mounting surface on which the inorganic light emitting element 120 is mounted, or may be mounted in a direction of an opposite surface to the mounting surface, or may be mounted on a film type substrate connected to the opposite surface to the mounting surface.

According to an embodiment of the disclosure, the driver 200 may apply the same constant current generator voltage to all constant current generator circuits 112 of the display panel 100. Thus, a driving current (that is, a constant current) of the same size is provided to the inorganic light emitting element 120 through the constant current generator circuit 112. Accordingly, a problem of a wavelength change of the LED according to a change in the magnitude of the driving current may be solved.

In addition, the driver 200 may apply a PWM data voltage corresponding to a grayscale value of each sub pixel to each PWM circuit 111 of the display panel 100. Accordingly, the duration of the driving current (i.e., constant current) provided to the inorganic light emitting element 120 of each sub pixel may be controlled through the PWM circuit 111.

Accordingly, grayscale of an image may be expressed.

Although the same constant current generator voltage is applied to one display module 300, a different constant current generator voltage may be applied to the different display module 300. Accordingly, a brightness deviation or a color deviation between display modules that may occur when a plurality of display modules are connected to form one large display apparatus may be compensated by an adjustment of the constant current generator voltage.

In the above, the display module 300 according to various embodiments may be applicable to a wearable device, a portable device, a handheld device, and various electronic products or electric products requiring a display in a single unit.

In addition, the display module 300 according to various embodiments may be applicable to a small display apparatus such as a personal computer monitor, a TV, etc., and a large display apparatus such as a digital signage, an electronic display, etc. through an assembly arrangement of the plurality of display modules 300.

Figure 11:
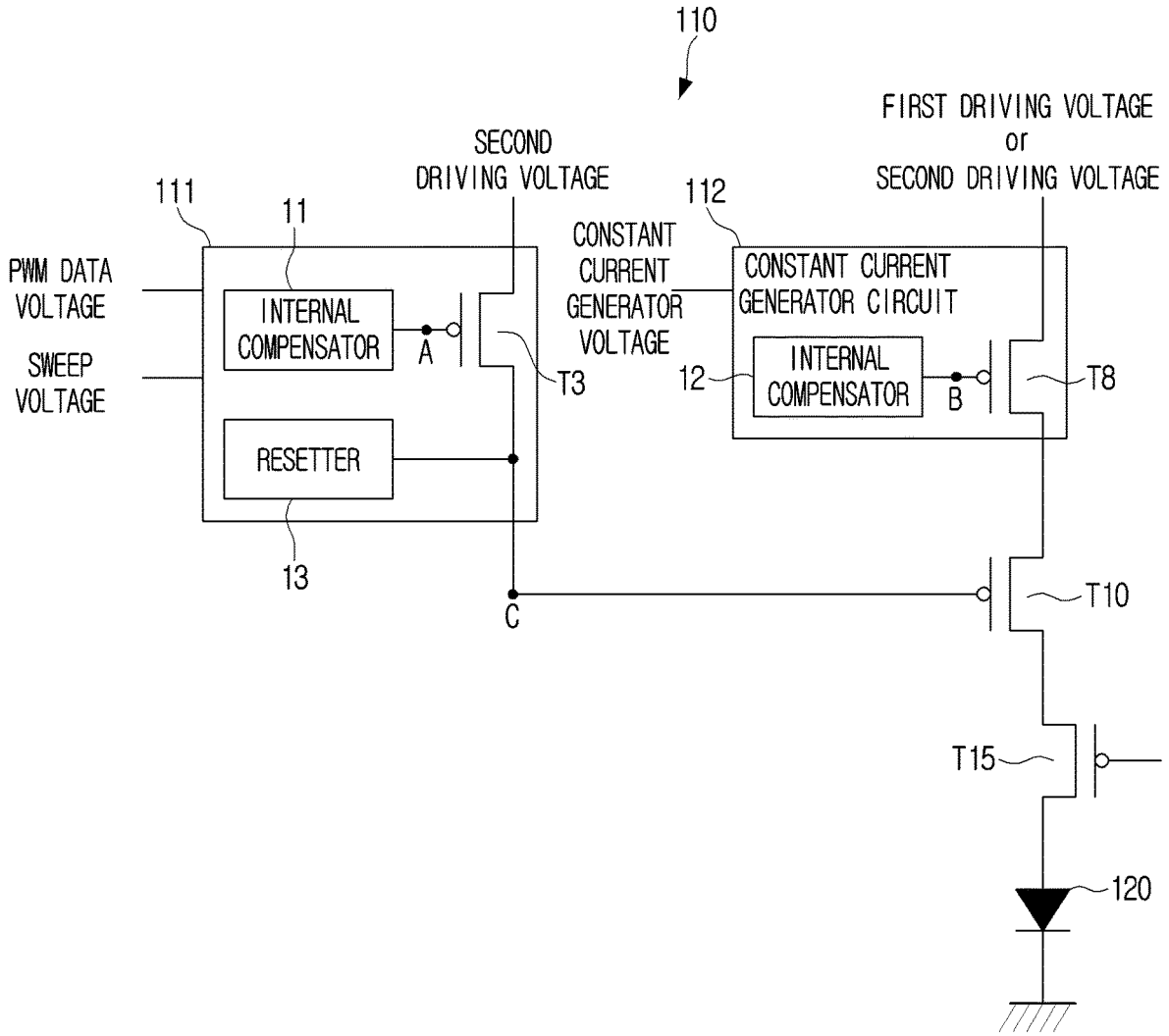
FIG. 11 is a configuration diagram of a sub pixel circuit according to an embodiment.

FIG. 11 is a configuration diagram of a sub pixel circuit according to an embodiment. Referring to FIG. 11, the sub pixel circuit 110 may include a PWM circuit 111, the constant current generator circuit 112, a first switching transistor T10, and a second switching transistor T15.

The constant current generator circuit 112 may include a first driving transistor T8, and provides a constant current having a certain magnitude to the inorganic light emitting element 120 based on a voltage applied between a source terminal and a gate terminal of the first driving transistor T8.

Specifically, when the constant current generator voltage is applied from the driver 200 in a data setting period, the constant current generator circuit 112 may apply the constant current generator voltage having a compensated threshold voltage of the first driving transistor T8 to a gate terminal B of the first driving transistor T8.

A difference in a threshold voltage may exist between the first driving transistors T8 included in the sub pixels of the display panel 100. In this case, the constant current generator circuit 112 of each sub pixel provides a driving current of a magnitude different by the difference in the threshold voltage of the first driving transistor T8 to the inorganic light emitting element 120 even when the same constant current generator voltage is applied, and this appears as a smudge on an image. Therefore, it is necessary to compensate for a threshold voltage deviation of the first driving transistors T8 included in the display panel 100.

To this end, the constant current generator circuit 112 may include an internal compensator 12. Specifically, when the constant current generator voltage is applied, the constant current generator circuit 112 may apply a first voltage to the gate terminal B of the first driving transistors T8 based on the constant current generator voltage and the threshold voltage of the first driving transistor T8 through the internal compensator 12.

Thereafter, in a light emission period, the constant current generator circuit 112 may provide a constant current of a magnitude based on the first driving voltage applied to the source terminal of the first driving transistor T8 and the first voltage applied to the gate terminal of the first driving transistor T8 to the inorganic light emitting element 120 through the first driving transistor T8 that is turned on.

Accordingly, the constant current generator circuit 112 may provide a driving current having a magnitude corresponding to the applied constant current generator voltage to the inorganic light emitting element 120, regardless of the threshold voltage of the first driving transistor T8.

As shown in FIG. 11, in the first switching transistor T10, a source terminal is connected to the drain terminal of the first driving transistor T8, and a drain terminal is connected to the source terminal of the second switching transistor T15. Further, in the second switching transistor T15, a source terminal is connected to a drain terminal of the first switching transistor T10, and a drain terminal is connected to an anode terminal of the inorganic light emitting element 120. Accordingly, the constant current is provided to the inorganic light emitting element 120 when the first switching transistor T10 and the second switching transistor T15 are turned on.

The PWM circuit 111 includes a second driving transistor T3, and controls an on/off operation of the first switching transistor T10 to control a time for the constant current to flow through the inorganic light emitting element 120.

Specifically, when a PWM data voltage is applied from the driver 200 in the data setting period, the PWM circuit 111 may apply the PWM data voltage having a compensated threshold voltage of the second driving transistor T3 to the gate terminal A of the second driving transistor T3.

Because the above-described problem due to the threshold voltage deviation between the first driving transistors T8 may occur in the same manner with respect to the second driving transistor T3, the PWM circuit 111 may also include the internal compensator 11.

Accordingly, when the PWM data voltage is applied, the PWM circuit 111 may apply a second voltage based on the PWM data voltage and the threshold voltage of the second driving transistor T3 to the gate terminal A of the second driving transistor T3 through the internal compensator 11.

Thereafter, in the emission period, when the second driving transistor T3 is turned on based on the second voltage applied to the gate terminal of the second driving transistor T3 and the second driving voltage applied to the source terminal of the second driving transistor T3, the PWM circuit 111 may apply a second driving voltage to the gate terminal of the first switching transistor T10 to turn off the first switching transistor T10, thereby controlling the time for the constant current to flow through the inorganic light emitting element 120.

At this time, the second driving transistor T3 may be turned on because the second voltage applied to the gate terminal of the second driving transistor T3 changes according to a sweep voltage applied to the PWM circuit 111, when the voltage between the gate terminal and the source terminal of the second driving transistor T3 becomes the threshold voltage of the second driving transistor T3. Here, the sweep voltage is a voltage applied from the driver 200 to linearly change the voltage of the gate terminal of the second driving transistor T3, and may be a signal that changes linearly, such as a triangle wave, but is not limited thereto.

Accordingly, the PWM circuit 111 may allow the constant current to flow through the inorganic light emitting element 120 only for a time corresponding to the applied PWM data voltage, regardless of the threshold voltage of the second driving transistor T3.

The PWM circuit 111 may include a resetter 13. The resetter 13 may be a configuration for forcibly turning on the first switching transistor T10. As described above, in order for the constant current to flow through the inorganic light emitting element 120 to emit light, the first switching transistor T10 must be turned on. Accordingly, through the operation of the resetter 13, the first switching transistor T10 may be turned on at the start time of each of a plurality of light emission periods.

The second switching transistor T15 may be turned on/off according to a control signal (Emi_PAM to be described later) of the driver 200. The on/off timing of the second switching transistor T15 may be related to the implementation of a black grayscale, and a detailed description thereof will be given later.

The first driving voltage may be a voltage used when the constant current generator circuit 112 provides a driving current (i.e., a constant current) to the inorganic light emitting element 120 in the light emission period, and the second driving voltage may be a voltage used when the constant current generator circuit 112 sets a data voltage (e.g., a PWM data voltage or a constant current generator voltage) to the sub pixel circuit 110 in a data setting period.

When the driving current flows through the inorganic light emitting element 120, an IR drop occurs, and accordingly, a voltage drop occurs in the first driving voltage. However, for accurate grayscale expression, an accurate data voltage must be set to the sub pixel circuit 110, and to this end, the driving voltage applied to the sub pixel circuit 110 must be stable.

Accordingly, according to an embodiment, in the data setting period, the second driving voltage without the IR drop is applied not only to the PWM circuit 111 but also to the constant current generator circuit 112 which is a configuration that provides the driving current.

Hereinafter, the configuration and operation of the sub pixel circuit 110 according to an embodiment will be described in more detail with reference to FIGS. 12 to 23.

Figure 12:
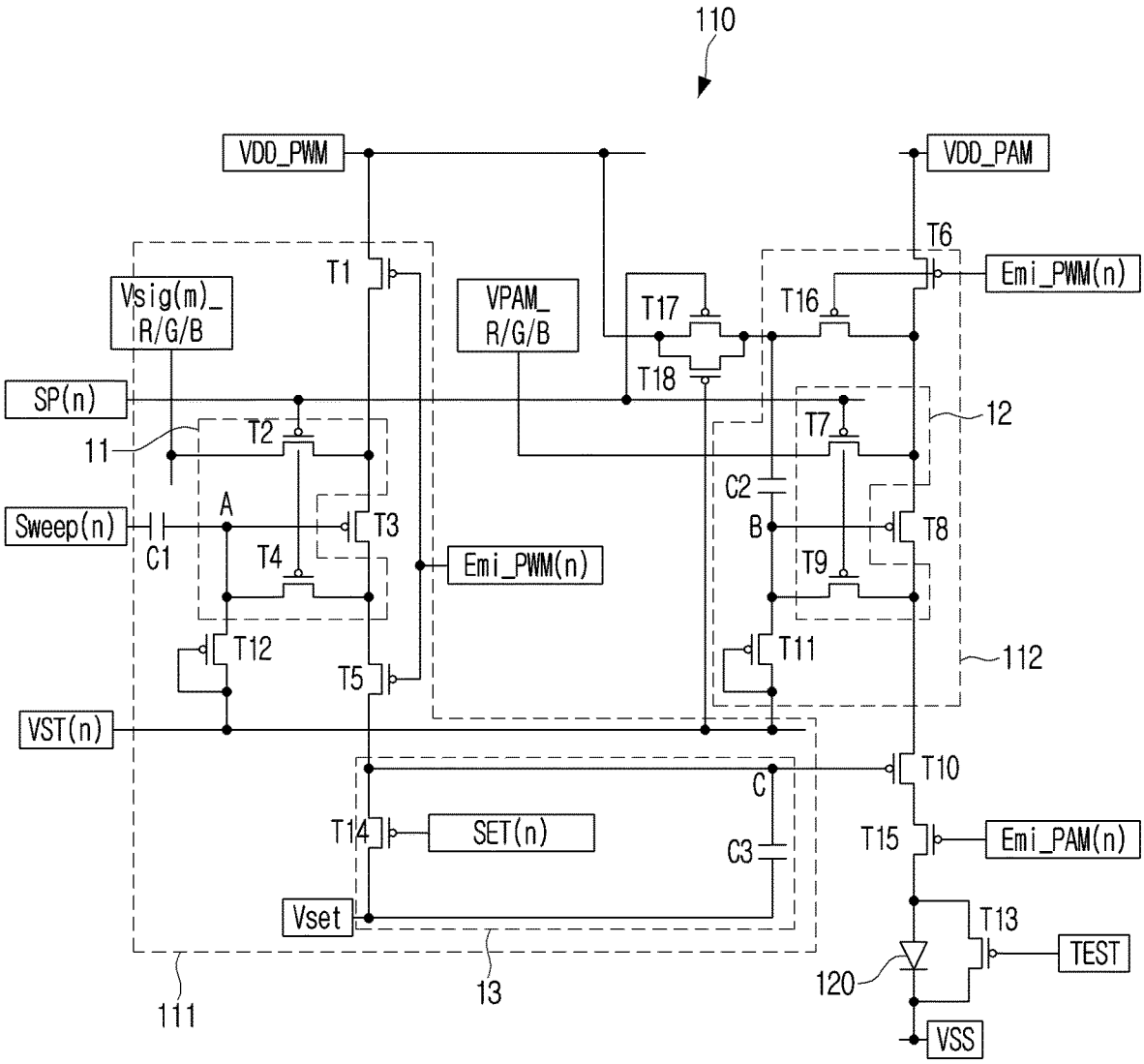
FIG. 12 is a detailed circuit diagram of a sub pixel circuit according to an embodiment.

FIG. 12 is a detailed circuit diagram of the sub pixel circuit 110 according to an embodiment. Referring to FIG. 12, the sub pixel circuit 110 includes the PWM circuit 111, the constant current generator circuit 112, the first switching transistor T10, and the second switching transistor T15. At this time, as described above in FIG. 11, it may be seen that the PWM circuit 111 includes the internal compensator 11 and the resetter 13, and the constant current generator circuit 112 includes the internal compensator 12.

The transistor T17 and the transistor T18 may be included in circuit configurations for applying a second driving voltage VDD_PWM to the constant current generator circuit 112 in a data setting period.

The transistor T13 is a circuit configuration that is turned on according to a TEST voltage and used to confirm whether the sub pixel circuit 110 is abnormal before the inorganic light emitting element 120 is mounted on a TFT layer to be described later and is electrically connected to the sub pixel circuit 110.

In FIG. 12, VDD_PAM denotes a first driving voltage (e.g., +10[V]), VDD_PWM denotes a second driving voltage (e.g., +10[V]), VSS denotes a ground voltage (e.g., 0[V]), and Vset denotes a low voltage (e.g., −3[V]) for turning on the first switching transistor T10. VDD_PAM, VDD_PWM, VSS, Vset, and Test voltages may be applied from the above-described driving voltage providing circuit.

VST (n) denotes a signal applied to the sub pixel circuit 110 to initialize voltages of node A and node B.

SP(n) denotes a signal applied to the sub pixel circuit 110 to set the data voltage.

SET(n) denotes a signal applied to the resetter 13 of the PWM circuit 111 to turn on the first switching transistor T10.

Emi_PWM(n) denotes a signal for turning on the transistors T1 and T5 to apply the second driving voltage VDD_PWM to the PWM circuit 111, and turning on the transistors T6 and T16 to apply the first driving voltage VDD_PAM to the constant current generator circuit 112.

Sweep(n) denotes the sweep voltage. According to an embodiment, the sweep voltage may be a voltage that decreases linearly, but is not limited thereto. For example, when transistors included in the sub pixel circuit 110 are implemented as NMOS, a linearly increasing voltage may be used as the sweep voltage. The sweep voltage may be repeatedly applied in the same form for each light emission period.

Emi_PAM(n) denotes a signal for turning on the second switching transistor T15.

In the above signals, n denotes an n-th row line. As described above, the driver 200 drives the display panel 110 for each row line (or scan line or gate line), and thus the above-described control signals VST(n), SP(n), SET(n), Emi_PWM(n), Sweep(n) and Emi_PAM(n) are applied to all the sub pixel circuits 110 included in the n-th row line in the same order as in FIG. 13 to be described later.

Accordingly, the above-described control signals may be referred to as scan signals or gate signals, and may be applied from the above-described gate driver.

Vsig(m)_R/G/B denotes the PWM data voltage for each of R, G, and B sub pixels of the pixel included in an m-th column line. Specifically, because the above-described gate signals are signals for the n-th row line, Vsig(m)_R/G/B shown in FIG. 12 indicates that the PWM data voltages for each of the R, G, and B sub pixels of a specific pixel disposed at an intersection of the n-th row line and the m-th column line is time divisionally multiplexed and applied.

At this time, Vsig(m)_R/G/B may be applied from the above-described data driver. In addition, Vsig(m)_R/G/B may use, for example, a voltage between +10[V] (black) to +15[V] (full white), but is not limited thereto.

Because the sub pixel circuit 110 shown in FIG. 12 corresponds to one of the R, G, and B sub pixels (e.g., the R sub pixel), only the PWM data voltage for the R sub pixel among the time divisionally multiplexed PWM data voltages is selected and applied to the sub pixel circuit 110 through a MUX circuit.

VPAM_R/G/B denotes a constant current generator voltage for each of the R, G, and B sub pixels included in the display panel 100. As described above, the same constant current generator voltage may be applied to the display panel 100.

However, the same constant current generator voltage may mean that the same constant current generator voltage is applied to the same type of sub pixels included in the display panel 100 but may not mean that the same constant current generator voltage is applied to all different types of sub pixels such as R, G, and B. This is because R, G, and B sub pixels have different characteristics depending on the type of sub pixel. Accordingly, the constant current generator voltage may vary according to the type of sub pixel.

Even in this case, the same constant current generator voltage may be applied to the same type of sub pixels regardless of the column line or row line. Accordingly, according to an embodiment, unlike the PWM data voltage, the constant current generator voltage may be applied directly from the driving voltage providing circuit for each type of sub pixels without using a data driver.

That is, because the same voltage needs to be applied to the same type of sub pixels regardless of the column line or row line, a DC voltage may be used as the constant current generator voltage. Therefore, for example, three types of DC voltages (e.g., +5.1[V], +4.8[V], and +5.0[V]) respectively corresponding to the R, G, and B sub pixels may be directly applied individually to the R, G, and B sub pixel circuits of the display panel 100 respectively from the driving voltage circuit. In this case, a MUX circuit is also unnecessary.

According to an embodiment, when using the same constant current generator voltage for different types of sub pixels exhibits better characteristics, the same constant current generator voltage may be applied to different types of sub pixels.

Figure 13:
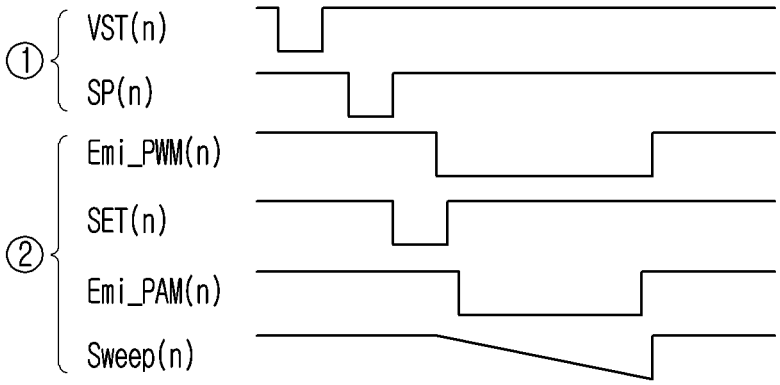
FIG. 13 is a timing diagram of gate signals according to an embodiment.

FIG. 13 is a timing diagram of the gate signals described above in FIG. 12.

In FIG. 13, VST(n) and SP(n)(0) are related to a data setting operation of the sub pixel circuit 110, and Emi_PWM (n), SET(n), Emi_PAM(n) and Sweep(n)(0) are related to a light emitting operation of the sub pixel circuit 110.

As described above, according to an embodiment, during one image frame period, for each row line, the data setting period proceeds once and the light emission period proceeds multiple times.

Accordingly, ① signals are applied to each row line of the display panel 100 once per one image frame, and ② signals are applied to each row line of the display panel 100 multiple times per one image frame.

Figure 14:
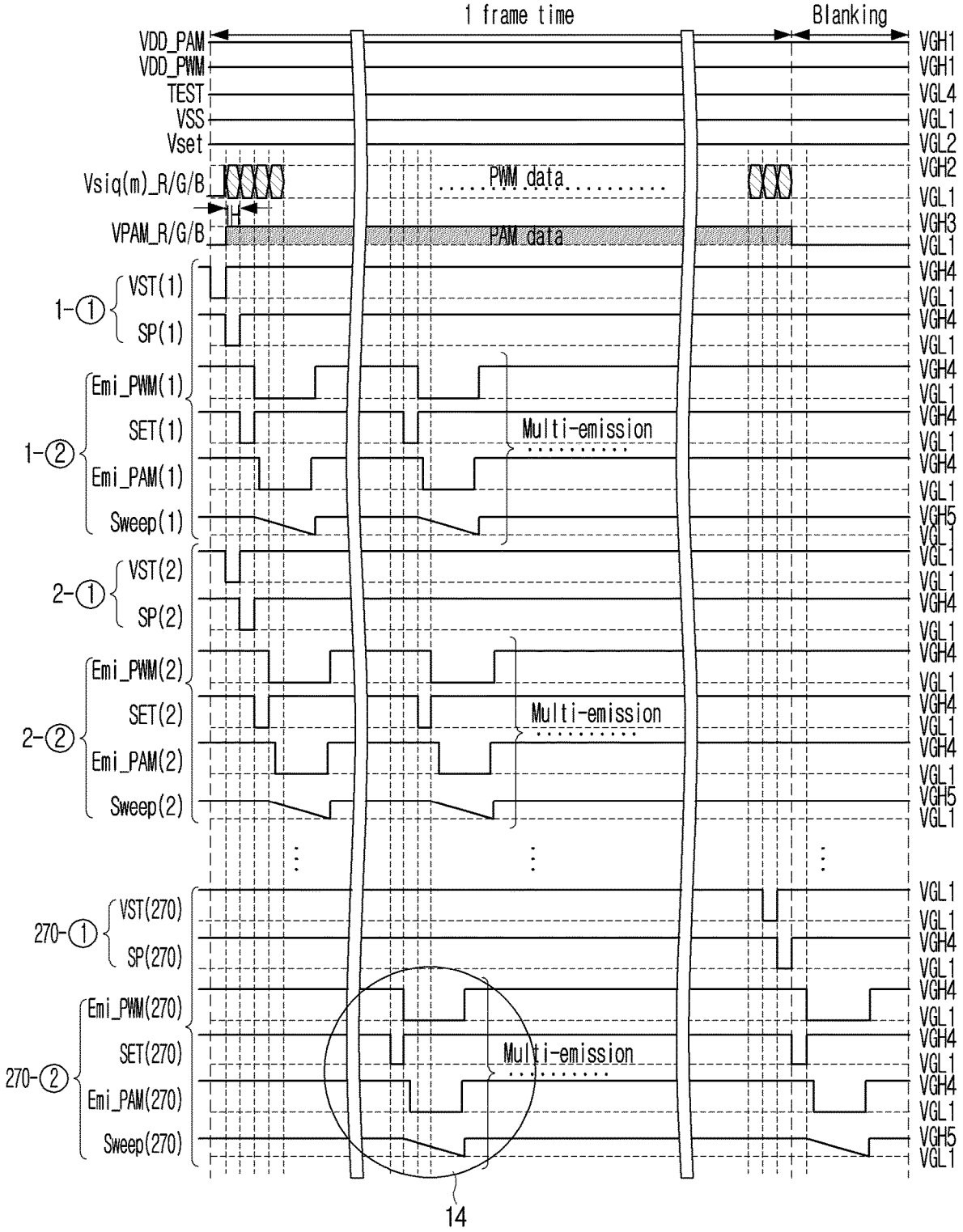
FIG. 14 is a timing diagram of various signals for driving a display panel according to an embodiment.

FIG. 14 is a timing diagram of various signals for driving a display panel 100 during one image frame period according to an embodiment. In FIG. 14, an example in which the display panel 100 includes 270 row lines is shown.

It may be seen that as shown in reference numerals 1-①, 2-① to 270-①, gate signals VST(n) and SP(n) for a data setting operation are applied to each row line once in the order of row lines for one frame, and as shown in reference numerals 1-②, 2-② to 270-②, gate signals Emi_PWM(n), SET(n), Emi_PAM(n) and Sweep(n) for a light emitting operation are applied to each row line multiple times.

As described above, according to an embodiment, some light emission periods (e.g., upper light emission periods with respect to a line connecting the data setting periods in FIG. 6) among light emission periods proceeding in all row lines of the display panel 100 during one image frame period proceed based on the data voltage applied during the one image frame period, and the remaining emission periods (e.g., lower light emission periods with respect to the line connecting the data setting periods in FIG. 6) proceed based on the data voltage applied during a previous image frame period of the one image frame period.

In this regard, it may be seen that among the light emitting operations by the gate signals shown in FIG. 14, the light emitting operation by the gate signals of reference numeral 14 is a light emitting operation based on the data voltage applied in the previous image frame period.

Hereinafter, a detailed operation of the sub pixel circuit 110 according to an embodiment will be described with reference to FIGS. 15 to 23.

Figure 15:
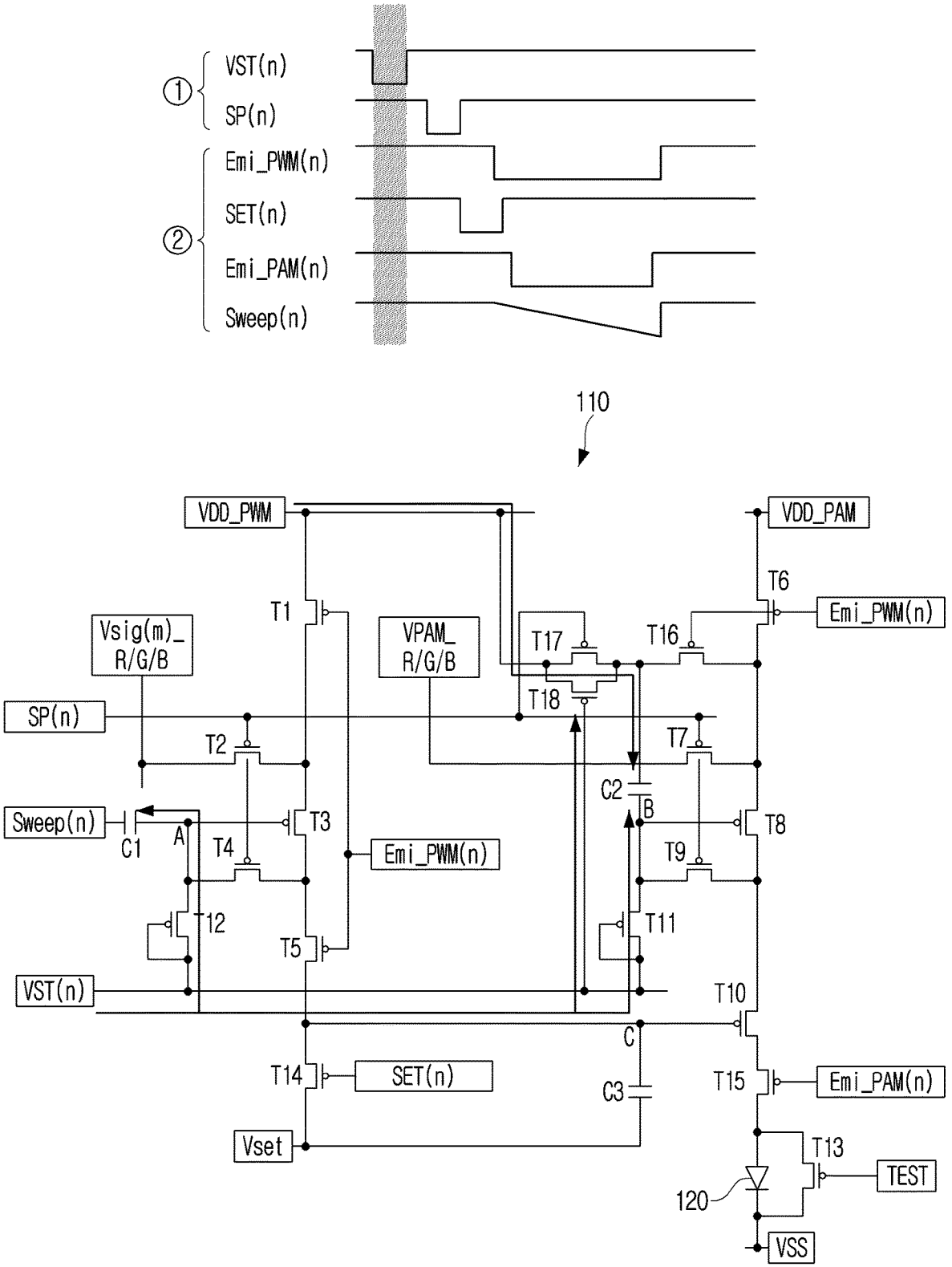
FIG. 15 is a diagram showing an operation of a sub pixel circuit with respect to a gate signal according to an embodiment.

FIG. 15 is a diagram showing an operation of the sub pixel circuit 110 according to the signal VST(n) among gate signals shown in FIG. 13.

When a data setting period starts, the driver 200 may first turn on the first driving transistor T8 included in the constant current generator circuit 112 and the second driving transistor T3 included in the PWM circuit 111.

To this end, the driver 200 may apply a low voltage (e.g., −3[V]) to the sub pixel circuit 110 through the signal VST(n), as shown in FIG. 15.

Accordingly, when the low voltage is applied to a gate terminal (hereinafter referred to as a node A) of the second driving transistor T3 through the turned-on transistor T12, the second driving transistor T3 is turned on. In addition, when the low voltage is applied to a gate terminal (hereinafter referred to as a node B) of the first driving transistor T8 through the turned-on transistor T11, the first driving transistor T8 is turned on.

When the low voltage (e.g., −3[V]) is applied to the sub pixel circuit 110 through the signal VST(n), the transistor T18 may also be turned on. VDD_PWM (hereinafter referred to as a second driving voltage (e.g., +10 [V])) is applied to the other end of a capacitor C2 of which one end connected to the node B through the turned-on transistor T18. In this case, the second driving voltage may be a reference potential for setting the data voltage to be proceeded according to the signal SP(n).

Figure 16:
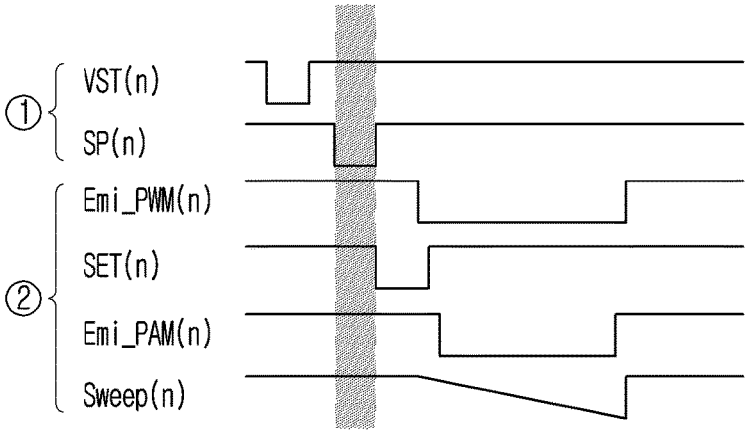
FIG. 16 is a diagram showing an operation of a sub pixel circuit with respect to a gate signal according to an embodiment.
Figure 16:
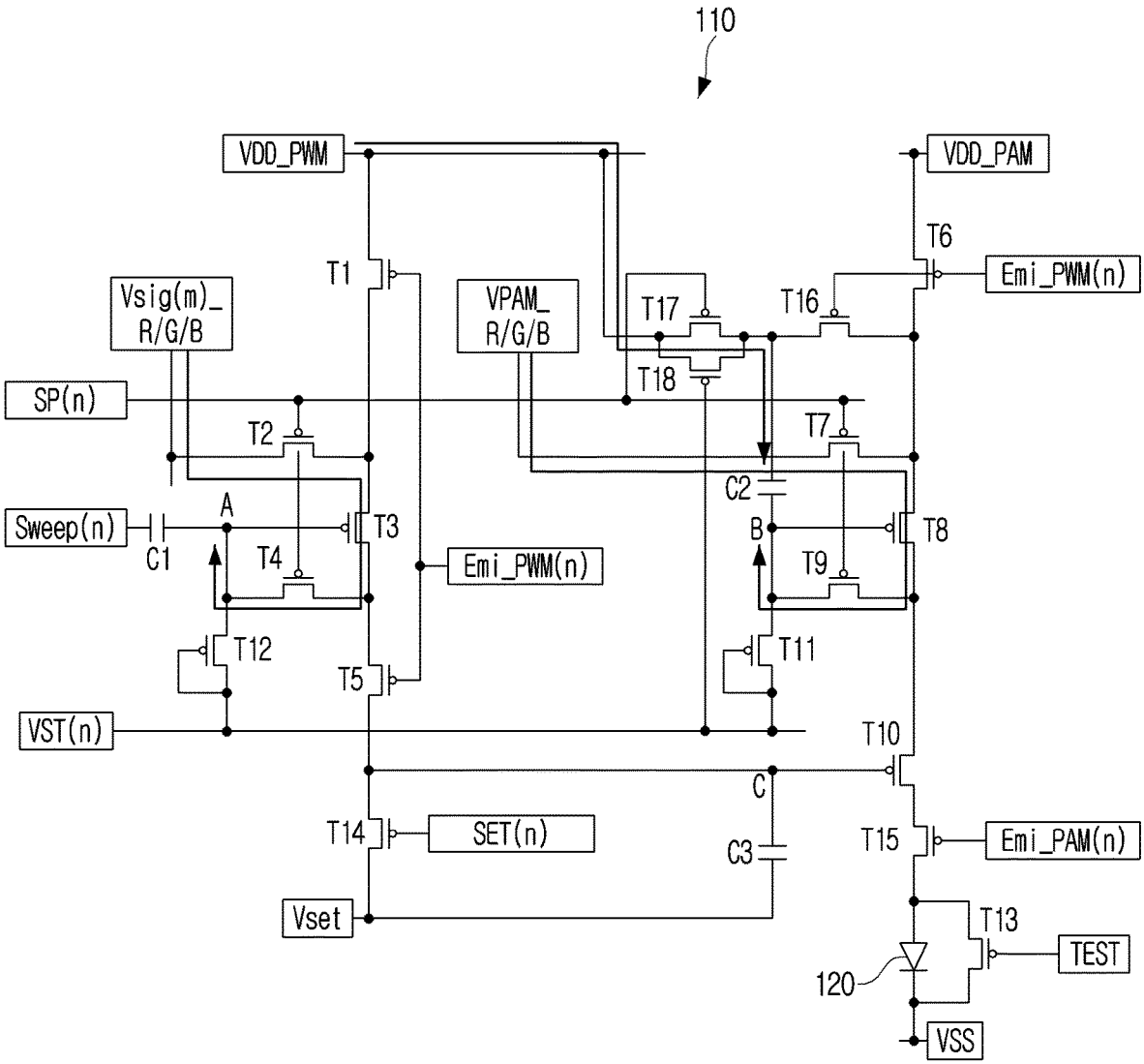

FIG. 16 is a diagram showing an operation of the sub pixel circuit 110 according to the signal SP(n) among gate signals shown in FIG. 13.

In a data setting period, when the first driving transistor T8 and the second driving transistor T3 are turned on through the signal VST(n), the driver 200 inputs a data voltage to each of the nodes A and B.

To this end, the driver 200 may apply a low voltage to the sub pixel circuit 110 through the signal SP(n), as shown in FIG. 16.

When the low voltage is applied to the sub pixel circuit 110 based on the signal SP(n), the transistors T2 and T4 of the PWM circuit 111 are turned on. Accordingly, the PWM data voltage Vsig(m)_R/G/B) may be applied to the node A through the turned-on transistor T2 and the second driving transistor T3 in an on state, and the turned-on transistor T4.

At this time, the PWM data voltage applied from the driver 200 is not set to the node A as it is, but the PWM data voltage having the compensated threshold voltage of the second driving transistor T3 (i.e., a voltage obtained by summing the PWM data voltage and the threshold voltage of the second driving transistor T3) is set to the node A.

Specifically, when the transistor T2 and the transistor T4 are turned on according to the signal SP(n), the PWM data voltage applied to the source terminal of the transistor T2 is input to the internal compensator 11. At this time, because the second driving transistor T3 is in a fully turned-on state through the signal VST(n), the input PWM data voltage starts to be input to the node A while passing through the transistor T2, the second driving transistor T3, and the transistor T4 sequentially. That is, the voltage of the node A starts to rise from the low voltage.

However, the voltage of the node A does not rise to the input PWM data voltage, but rises only to a voltage corresponding to the sum of the PWM data voltage and the threshold voltage of the second driving transistor T3. This is because at a time when the PWM data voltage starts to be input to the internal compensation circuit 11, because the voltage of the node A is sufficiently low (e.g., −3[V]), the second driving transistor T3 is fully turned on, current flows sufficiently and the voltage of the node A rises smoothly, but as the voltage of the node A increases, a voltage difference between the gate terminal (the node A) and the source terminal of the second driving transistor T3 As is reduced, the flow of current decreases. As a result, when the voltage difference between the gate terminal and the source terminal of the second driving transistor T3 reaches the threshold voltage of the second driving transistor T3, the second driving transistor T3 is turned off and the flow of current stops.

That is, because the PWM data voltage is applied to the source terminal of the second driving transistor T3 through the turned-on transistor T2, the voltage of the node A rises to only the sum of the PWM data voltage and the threshold voltage of the second driving transistor T3.

When the low voltage is applied to the sub pixel circuit 110 through the signal SP(n), the transistors T7 and T9 of the constant current generator circuit 111 are also turned on. Accordingly, the constant current generator voltage VPAM_R/G/B may be applied to the B node through the turned-on transistor T7, the first driving transistor T8 in the on state, and the turned-on transistor T9.

At this time, the constant current generator voltage applied from the driver 200 is not set to the node B as it is, but for the same reason as described above in the description of the node A, PWM data voltage having the compensated threshold voltage of the first driving transistor T8 (that is, a voltage obtained by summing the constant current generator voltage and the threshold voltage of the first driving transistor T8) is set to the node B.

When the low voltage is applied to the sub pixel circuit 110 through the signal SP(n), the transistor T17 is also turned on. Because the second driving voltage is applied to the other end of the capacitor C through the turned-on transistor T17, the reference potential of each data voltage applied to the node A and the node B is maintained.

Figure 17:
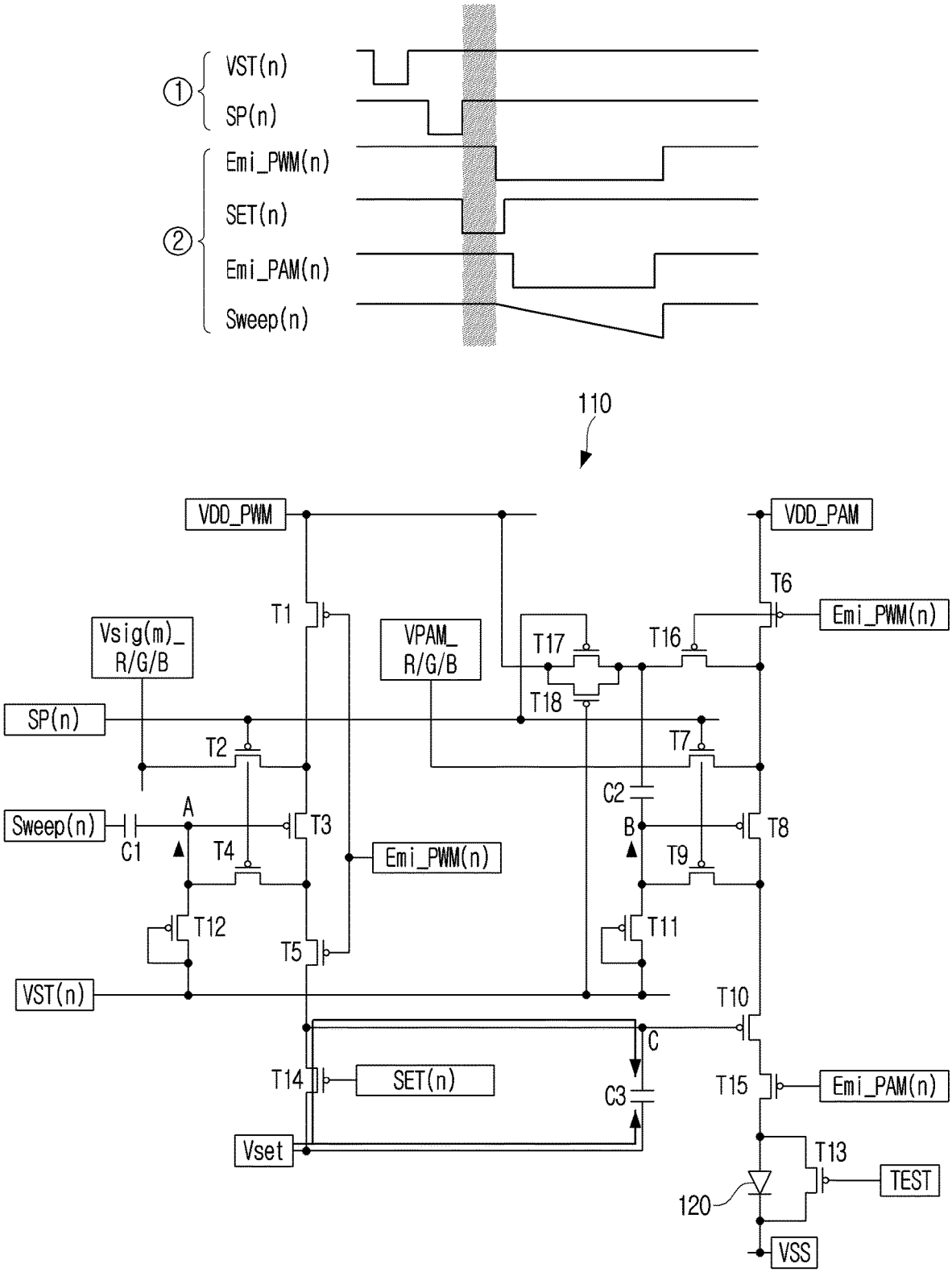
FIG. 17 is a diagram showing an operation of a sub pixel circuit with respect to a gate signal according to an embodiment.

FIG. 17 is a diagram showing an operation of the sub pixel circuit 110 according to the signal SET(n) among gate signals shown in FIG. 13. In particular, FIG. 17 shows the operation of the sub pixel circuit 110 according to the signal SET(n) in a first light emission period that proceeds after a data setting period progresses for one row line.

When setting of the respective data voltages to the constant current generator circuit 112 and the PWM circuit 111 is completed, the driver 200 first turns on the first switching transistor T10 in order to emit an inorganic light emitting element.

To this end, the driver 200 applies a low voltage to the sub pixel circuit 110 (specifically, the resetter 13 of the PWM circuit 111) through the signal SET(n), as shown in FIG. 17.

Accordingly, the voltage Vset is charged in the capacitor C3 through the turned-on transistor T14. As described above, because Vset is a low voltage (e.g., −3[V]), when the Vset voltage is charged in the capacitor C3, the low voltage is applied to the gate terminal (hereinafter referred to as a node C) of the first switching transistor T10 such that the first switching transistor T10 is turned on.

Before the signal Emi_PWM(n) is applied, the resetter 13 may operate independently from the remaining circuit configurations. Therefore, the low voltage may be applied through the signal SET(n) earlier than the time shown in FIG. 13 according to an embodiment.

Figure 18:
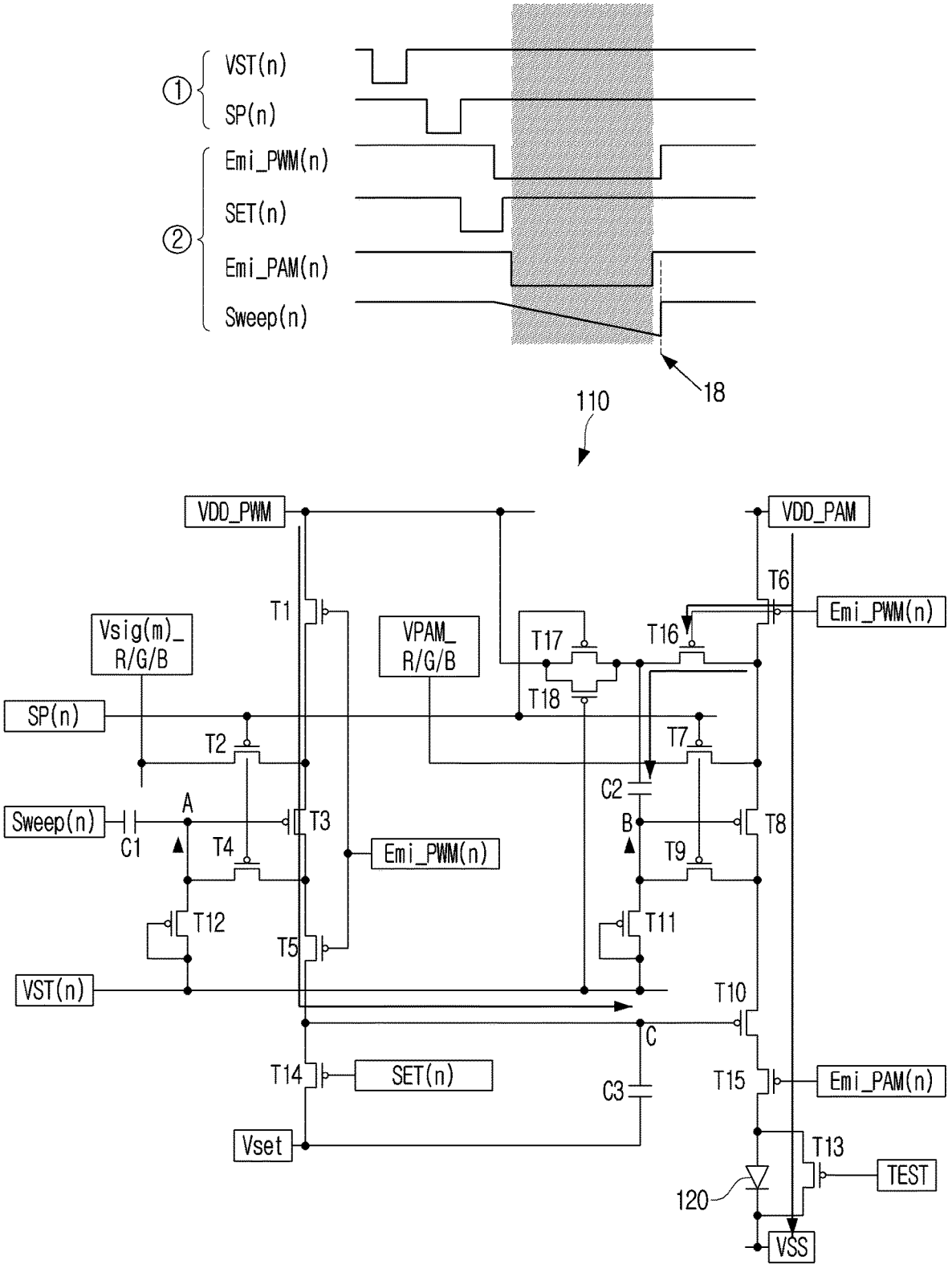
FIG. 18 is a diagram showing an operation of a sub pixel circuit with respect to a gate signal according to an embodiment.

FIG. 18 is a diagram showing an operation of the sub pixel circuit 110 according to signals Emi_PWM(n), Emi_PAM (n), and Sweep(n) among gate signals shown in FIG. 13.

When a low voltage is applied to the node C based on the signal SET(n) and the first switching transistor T10 is turned on, the driver 200 may power the inorganic light emitting element 120 based on the voltage set to the node A and node B.

To this end, the driver 200 may apply the low voltage to the sub pixel circuit 110 through the signals Emi_PWM(n) and Emi_PAM(n), and apply a sweep voltage to the sub pixel circuit 110 through the signal Sweep(n).

First, the operation of the constant current generator circuit 112 according to signals applied from the driver 200 will be described below.

The constant current generator circuit 112 may provide a constant current to the inorganic light emitting element 120 based on the voltage set to the node B.

Specifically, because the low voltage may be applied to the gate terminal through the signals Emi_PWM(n) and Emi_PAM(n), the transistor T6 and the second switching transistor T15 are turned on. As described above, the first switching transistor T10 is in an on state according to the signal SET(n). In addition, as described above, in a state in which the voltage that is the sum of the constant current generator voltage (e.g., +5[V]) and the threshold voltage of the first driving transistor T8 is applied to the node B, because the voltage VDD_PAM (hereinafter, referred to as a first driving voltage (e.g., +10 [V])) is applied to the source terminal of the first driving transistor T8 through the turned-on transistor T6 according to the signal Emi_PWM(n), a voltage less than the threshold voltage of the first driving transistor T8 is applied between the gate terminal and the source terminal of the first driving transistor T8, and thus the first driving transistor T8 is also turned on (for reference, in the case of a PMOSFET, the threshold voltage has a negative value, PMOSFET is turned on when a voltage less than the threshold voltage is applied between the gate terminal and the source terminal, and is turns off when a voltage exceeding the threshold voltage is applied).

Accordingly, the first driving voltage may be applied to an anode terminal of the inorganic light emitting element 120 through the turned-on transistor T6, first driving transistor T8, first switching transistor T10, and second switching transistor T15 and a potential difference exceeding a forward voltage Vf is generated at both ends of the inorganic light emitting element 120. Accordingly, the driving current (i.e., the constant current) may flow through the inorganic light emitting element 120 and the inorganic light emitting element 120 starts to emit light. In this regard, the magnitude of the driving current (i.e., the constant current) that emits the inorganic light emitting element 120 may have a magnitude corresponding to the constant current generator voltage.

Because the driving current must be provided to the inorganic light emitting element 120 in the light emission period, the driving voltage applied to the constant current generator circuit 112 changes from the second driving voltage to the first driving voltage. Specifically, as shown in FIG. 18, when the low voltage is applied to the transistors T6 and T16 according to the signal Emi_PWM(n), the first driving voltage is applied to the other end of the capacitor C2 through the turned-on transistors T6 and T16.

At this time, as described above in the description of FIG. 11, when the driving current flows through the inorganic light emitting element 120, a voltage drop occurs in the first driving voltage due to an IR drop generated in the transistor T6 and the first driving transistor T8.

However, even though the voltage drop occurs in the first driving voltage, it is coupled by a voltage corresponding to a difference between the second driving voltage and the first driving voltage, and thus the voltage of the node B also drops, irrespective of a voltage drop amount (i.e., an IR drop amount) of the first driving voltage, the voltage between the gate terminal and the source terminal of the first driving transistor T8 always remains the same. Therefore, according to the sub pixel circuit 110 according to an embodiment, it may be seen that there is no problem because the voltage drop of the first driving voltage is compensated.

Next, the operation of the PWM circuit 111 according to signals applied from the driver 200 will be described as follows.

The PWM circuit 111 may control a light emission time of the inorganic light emitting element 120 based on the voltage set to the node A. Specifically, the PWM circuit 111 may control an off operation of the first switching transistor T10 based on the voltage set to the node A, thereby controlling a driving time of the constant current provided by the constant current generator circuit 112 to the inorganic light emitting element 120, and accordingly, the light emission time of the inorganic light emitting element 120 may be controlled.

As described above, when the constant current generator circuit 112 may provide the constant current to the inorganic light emitting element 120, the inorganic light emitting element 120 starts to emit light.

At this time, referring to FIG. 18, even though the transistor T1 and the transistor T5 are turned on according to the signal Emi_PWM(n), the second driving voltage is not applied to the node C because the second driving transistor T3 is in an off state. Accordingly, the first switching transistor T10 remains in an on state, and the constant current flows through the inorganic light emitting element 120.

Specifically, when the transistor T1 is turned on according to the signal Emi_PWM(n), the second driving voltage (e.g., +10[V]) is applied to the source terminal of the second driving transistor T3 through the turned-on transistor T1 according to the signal Emi_PWM(n).

As described above, when a voltage between +10[V] (black) to +15[V] (full white) is used as the PWM data voltage, assuming that the threshold voltage of the second driving transistor T3 is −1[V], because a voltage between +9[V] (black) to +14[V] (full white) is set to the node A, a voltage −1[V] to +4[V] equal to or higher than the threshold voltage −1[V] of the second driving transistor T3 is applied between the gate terminal and the source terminal of the second driving transistor T3.

Therefore, unless the PWM data voltage corresponding to the black grayscale is set to the node A, when the second driving voltage is applied to the source terminal of the second driving transistor T3 (i.e., the low voltage is applied to the sub pixel circuit 110 according to the signal Emi_PWM(n)), the second driving transistor T3 is in the off state, and the first switching transistor T10 remains in an on state as long as the second driving transistor T3 remains in an off state, and thus the inorganic light emitting element 120 maintains light emission (in a case where the PWM data voltage corresponding to the black grayscale is set to the node A, when the second driving voltage is applied to the source terminal of the second driving transistor T3, the second driving transistor T3 is immediately in the on state).

However, when the voltage of the node A changes and a voltage equal to or less than the threshold voltage −1[V] of the second driving transistor T3 is applied between the gate terminal and the source terminal of the second driving transistor T3, the second driving transistor T3 is turned on, and the second driving voltage is applied to the node C, and thus the first switching transistor T10 is turned off. Accordingly, the constant current no longer flows through the inorganic light emitting element 120, and the inorganic light emitting element 120 stops emitting light.

Specifically, referring to FIG. 18, when the low voltage is applied to the sub pixel circuit 110 according to the signal Emi_PWM(n), it may be seen that the sweep voltage is also applied through the signal Sweep(n). In this regard, the sweep voltage may be a voltage that linearly decreases from +15[V] to +10[V], but is not limited thereto.

Because a change in the sweep voltage is coupled to the node A through the capacitor C1, the voltage of the node A changes according to the change in the sweep voltage.

When the voltage of the node A decreases according to the change of the sweep voltage and becomes the voltage corresponding to the sum of the second driving voltage and the threshold voltage of the second driving transistor T3 (that is, when the voltage equal to or less than the threshold voltage of the second driving transistor T3 is applied between the gate terminal and the source terminal of the second driving transistor T3), the second driving transistor T3 is turned on.

Accordingly, the second driving voltage which is a high voltage is applied to the node C through the turned-on first transistor T1, second driving transistor T3, and the transistor T5, and thus the first switching transistor T10 is turned off.

In this way, the PWM circuit 111 may control the light emission time of the inorganic light emitting element 120 based on the voltage set to the node A.

Figure 19:
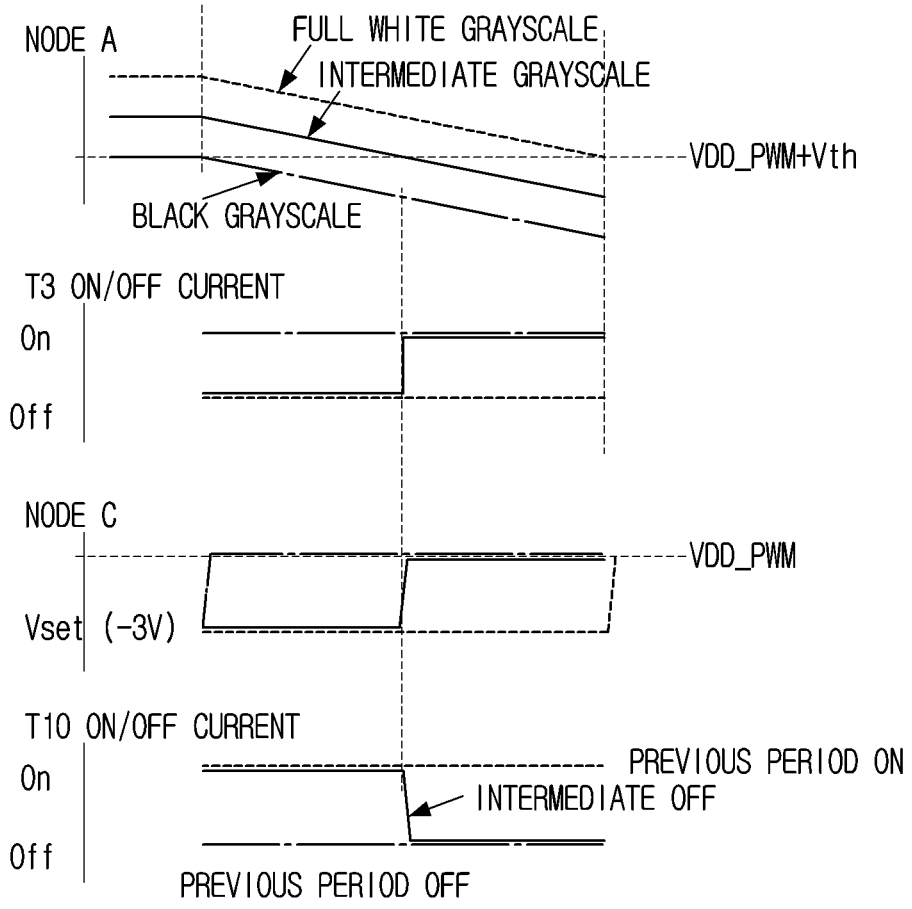
FIG. 19 is a diagram showing an operation of a sub pixel circuit for each grayscale according to an embodiment.

FIG. 19 is a diagram showing each operation of the sub pixel circuit 110 when PWM data voltages corresponding to a full white grayscale, an intermediate grayscale, and a black grayscale are set to the node A.

Specifically, FIG. 19 shows a change in the voltage of the node A according to a change in the sweep voltage, an on/off change in the second driving transistor T3 according to the change in the voltage of the node A, a change in the voltage of the node C according to the on/off change in the second driving transistor T3, and an on/off change in the first switching transistor T10 according to the change in the voltage of the node C, according to an embodiment.

With regard to the case where the PWM data voltage corresponding to the intermediate grayscale is set to the node A, as described above, before the voltage of the node A changes according to the sweep voltage and becomes a voltage corresponding to the sum of the second driving voltage VDD_PWM and the threshold voltage Vth of the second driving transistor T3, the second driving transistor T3 remains in an off state and the voltage Vset is maintained in the Node C. Accordingly, it may be seen that the first switching transistor T10 remains in an on state.

However, after the voltage of the node A continuously changes according to the sweep voltage and becomes the voltage corresponding to the sum of the second driving voltage VDD_PWM and the threshold voltage Vth of the second driving transistor T3, the second driving transistor T3 is turned on and the second driving voltage VDD_PWM is applied to the node C, and accordingly, it may be seen that the first switching transistor T10 is turned off.

When the PWM data voltage corresponding to the full white grayscale is set to the node A, even though the voltage of the node A changes according to the sweep voltage, during a light emission period (specifically, while a low voltage is applied through the signal Emi_PWM(n)), the voltage of the node A does not fall below the voltage corresponding to the sum of the second driving voltage VDD_PWM and the threshold voltage Vth of the second driving transistor T3.

Therefore, when the PWM data voltage corresponding to the full white grayscale is set to the node A, the second driving transistor T3 remains in the off state during the entire light emission period, and accordingly, the voltage Vset which is the low voltage is maintained in the node C. Thus, the first switching transistor T10 remains in the on state.

When the PWM data voltage corresponding to the black grayscale is set to the node A, the voltage of the node A is less than or equal to the voltage the sum of the second driving voltage VDD_PWM and the threshold voltage Vth of the second driving transistor T3 from the beginning and has a value less than or equal to the voltage corresponding to the sum of the second driving voltage VDD_PWM and the threshold voltage Vth of the second driving transistor T3 in the entire light emission period.

Accordingly, when the PWM data voltage corresponding to the black grayscale is set to the node A, the second driving voltage is applied to the node C during the entire light emission period, and accordingly, during the entire light emission period, the first switching transistor T10 remains in the off state.

When the application of the low voltage to the sub pixel circuit 110 through the signals Emi_PWM(n) and Emi_PAM (n) is completed and the application of the sweep voltage is completed according to the Sweep(n) signal, the corresponding light emission period ends.

At this time, as shown in reference numeral 18 of FIG. 18, it may be seen that when the light emission period ends (specifically, when the application of the low voltage is completed through the signal Emi_PWM(n)) the sweep voltage is restored to the voltage before linear change.

As described above, because the change in the sweep voltage is coupled to the node A through the capacitor C1, when the sweep voltage is restored as described above, the voltage of the node A that has linearly changed according to the sweep voltage is also restored.

Accordingly, according to an embodiment, the voltage of node A linearly changed according to the sweep voltage during the first light emission period is restored according to the sweep voltage before a second light emission period which is a next light emission period starts.

Specifically, the voltage of the node A becomes the voltage of the sum of the PWM data voltage and the threshold voltage Vth of the second driving transistor T3 during a data setting period, changes linearly according to the change in the sweep voltage during the light emission period, and when the light emission period ends, is restored to the voltage of the sum of the PWM data voltage and the threshold voltage Vth of the second driving transistor T3 according to the restoration of the sweep voltage. Accordingly, the same light emitting operation is possible in the next light emission period.

Figure 20:
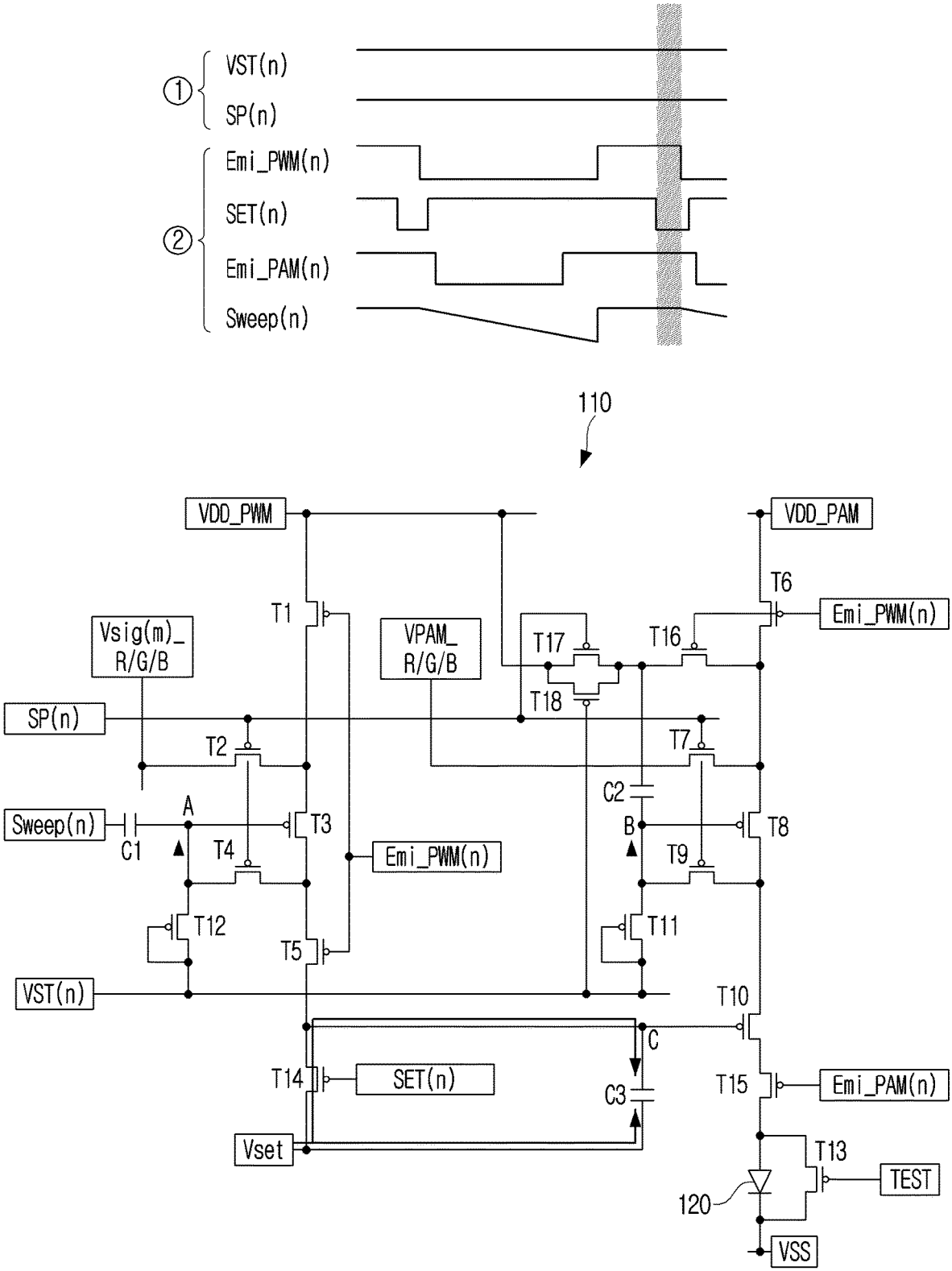
FIG. 20 is a diagram showing an operation of a sub pixel circuit with respect to a gate signal according to an embodiment.

FIG. 20 is a diagram showing a reset operation of the node C in second and subsequent emission periods among a plurality of emission periods for one row line.

According to an embodiment, as described above, the plurality of light emission periods proceed for each row line during one image frame. In this regard, in order for the inorganic light emitting element 120 to emit light during the light emission periods, as described above in FIGS. 17 and 18, the first switching transistor T10 must be in an on state first.

However, as described above with reference to FIG. 18, as a light emission period proceeds, the second driving voltage is applied to the node C, and thus the first switching transistor T10 is in an off state. Therefore, in order to proceed a next light emission period, the voltage of the Node C needs to be reset to a low voltage.

To this end, when the next light emission period starts, the driver 200 applies the low voltage to the resetter 13 of the PWM circuit 111 through the signal SET(n), as shown in FIG. 20.

Accordingly, the Vset voltage is charged in the capacitor C3 through the turned-on transistor T14. As described above, because Vset is a low voltage (e.g., −3[V]), when the voltage Vset is charged in the capacitor C3, the low voltage is applied to a gate terminal (hereinafter referred to as the node C) of the first switching transistor T10, and thus the first switching transistor T10 is turned on.

Thereafter, the driver 200 may control a light emitting operation of the inorganic light emitting element 120 during the next light emission period as described with reference to FIG. 18.

As described above, according to an embodiment, during one image frame period, for each row line, the data setting period proceeds once and the light emission period proceeds multiple times. Therefore, because the data setting period does not proceed in the second and subsequent light emission periods for one row line, in the timing diagram of FIG. 20, unlike FIG. 17, the gate signals VST(n) and SP(n) for data setting are not shown.

Figure 21:
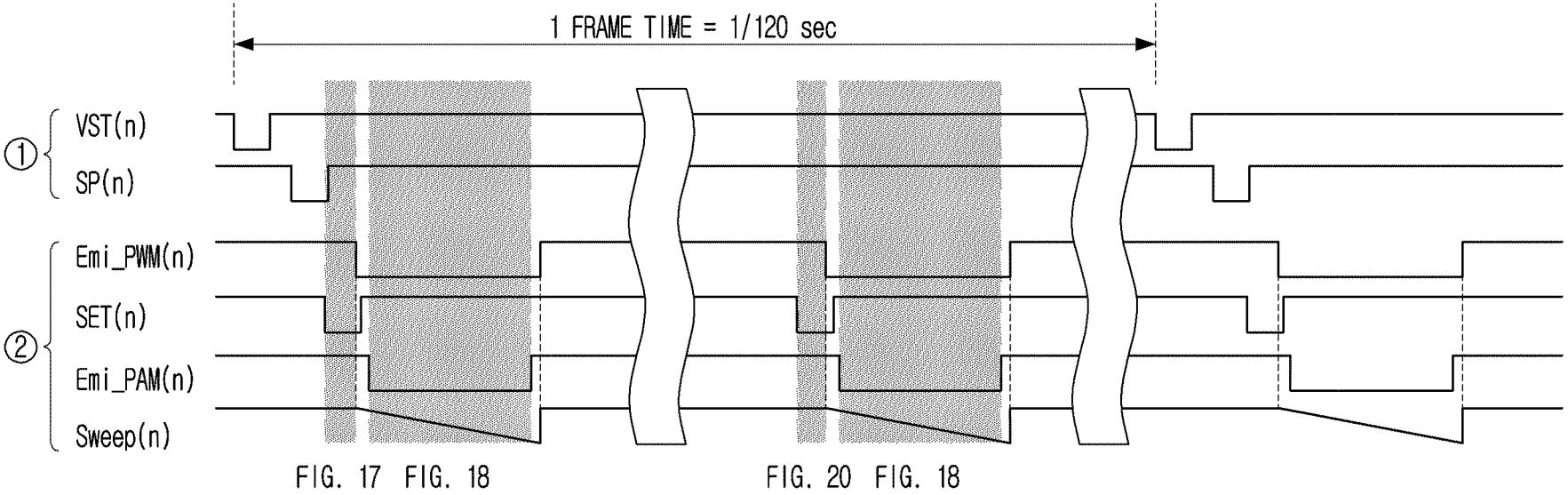
FIG. 21 is a diagram showing gate signals applied during one frame time according to an embodiment.

FIG. 21 is a diagram showing gate signals applied to the sub pixel circuit 110 included in one row line during one frame time, according to an embodiment.

For example, assuming an embodiment in which nine light emission periods proceed for one row line, the driver 200 applies the signals VST(n) and SP(n) once for one frame time, as shown in FIG. 21 to proceed once a data setting period.

Thereafter, the driver 200 drives the sub pixel circuits 110 in a first light emission period as described above with reference to FIGS. 17 and 18, and repeatedly drives the sub pixel circuits 110 in each of a second light emission period to a 9th light emission period as described above with reference to FIGS. 20 and 18.

Figure 22:
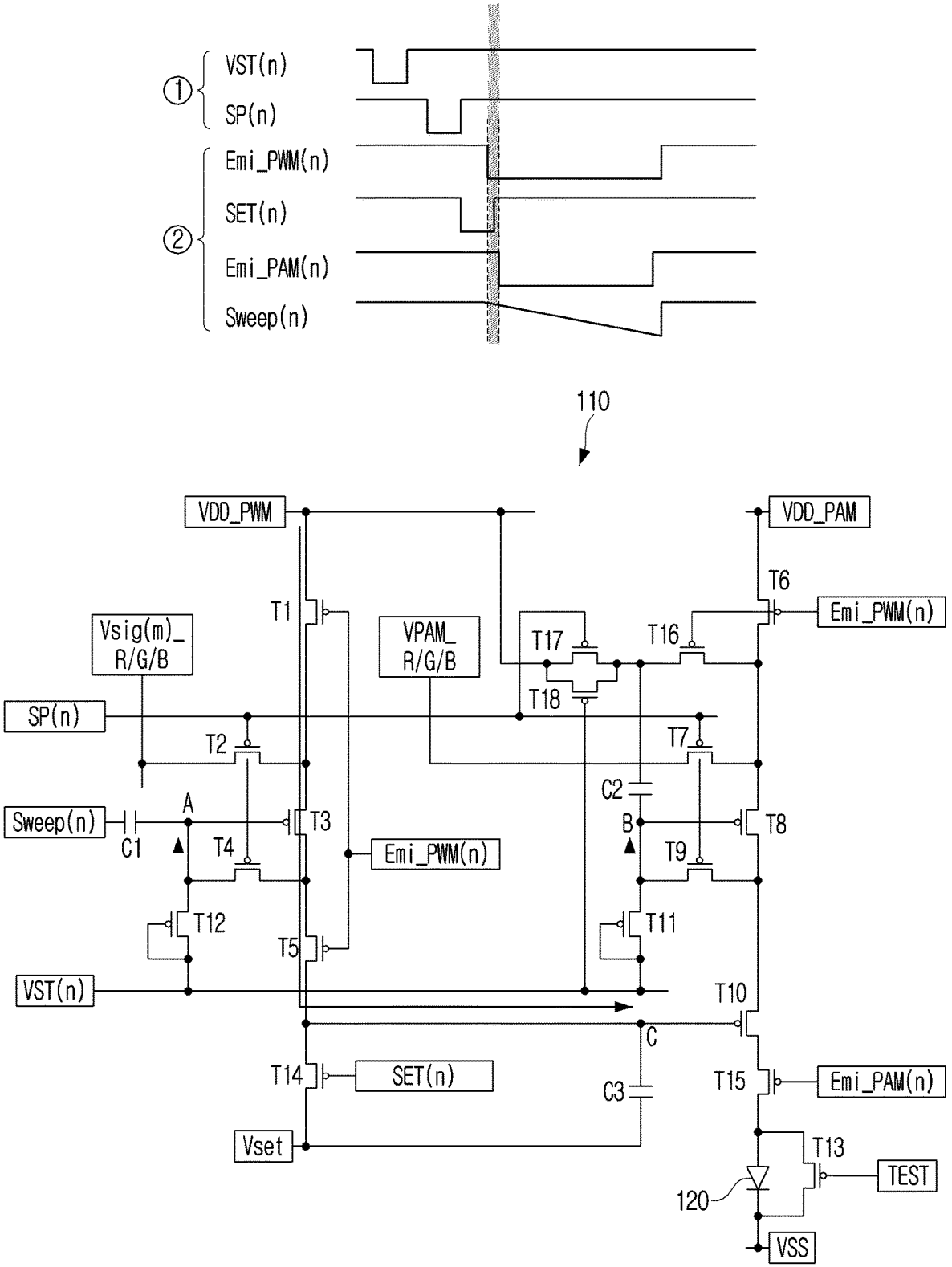
FIG. 22 is a diagram showing an operation of a sub pixel circuit related to implementation of a black grayscale according to an embodiment.
Figure 23:
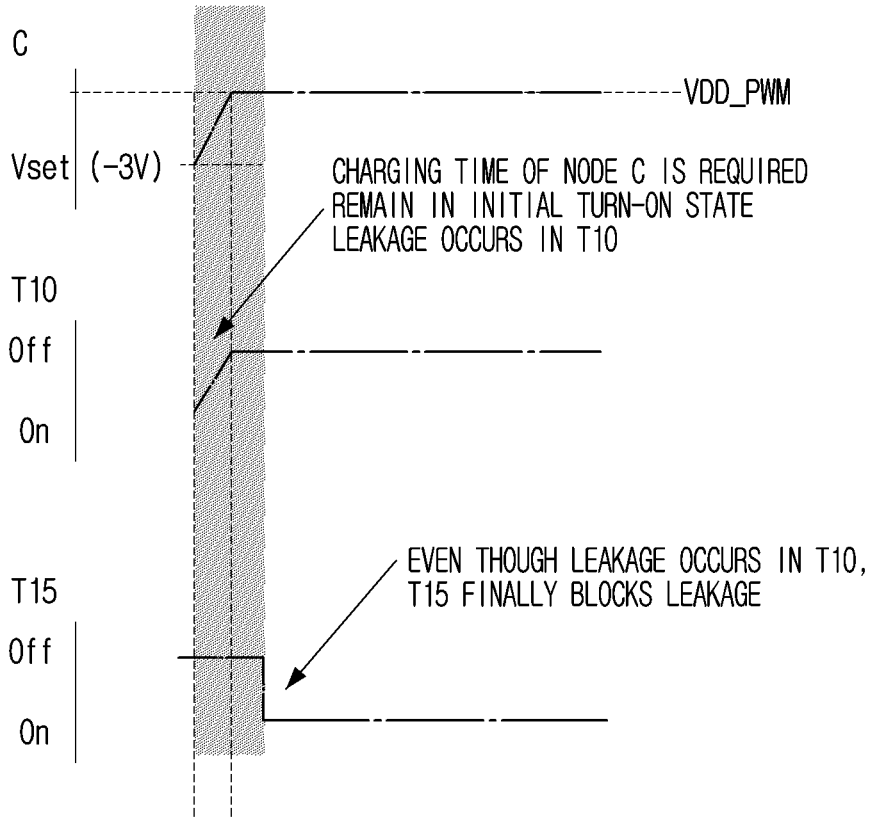
FIG. 23 is a diagram showing an operation of a sub pixel circuit related to implementation of a black grayscale according to an embodiment.

FIGS. 22 and 23 are diagrams showing an operation of the sub pixel circuit 110 related to implementation of a black grayscale.

Referring to a timing diagram of FIG. 22, it may be seen that there is a difference between a time when a low voltage starts to be applied to the signal Emi_PWM(n) and the time when the low voltage is applied to the signal Emi_PAM(n). This is also the same in timing diagrams of the gate signals shown in FIGS. 13 to 18, 21, and 22.

In this way, the difference between the time when the low voltage starts to be applied to the signal Emi_PWM(n) and the time when the low voltage is applied to the signal Emi_PAM(n) is to implement the black grayscale.

Specifically, when a data voltage corresponding to the black grayscale is set to the node A, as described above, at the time when the low voltage is applied through the signal Emi_PAM(n) (that is, at a time when the second driving voltage is applied to the source terminal of the second driving transistor T3), the second driving transistor T3 is immediately turned on.

Therefore, theoretically, at the time when the low voltage is applied through the signal Emi_PAM(n), the second driving voltage is applied to the node C through the turned-on transistor T1, second driving transistor T3, and transistor T5, and thus, the first switching transistor T10 needs to be immediately turned off (when the first switching transistor T10 is immediately turned off, the driving current (i.e., the constant current) does not flow through the inorganic light emitting element 120 at all, and the black grayscale is expressed).

However, actually, as shown in FIG. 23, a charging time of the second driving voltage VDD_PWM is required for the node C, and thus the first switching transistor T10 is not immediately turned off. Specifically, after the second driving voltage is applied to the node C and charging starts, until a voltage capable of turning off the first switching transistor T10 is charged to the node C, the first switching transistor T10 remains in an on state, and accordingly, a leakage of the constant current occurs in the first switching transistor T10.

As a result, when the first switching transistor T10 and the inorganic light emitting element 120 are directly connected without the second switching transistor T15, even though the data voltage corresponding to the black grayscale is set to the node A, the constant current leaked in the first switching transistor T10 flows through the inorganic light emitting element 120 for a certain period of time, and thus an accurate black grayscale may not be implemented.

Accordingly, according to the embodiment, the second switching transistor T15 may be disposed between the first switching transistor T10 and the inorganic light emitting element 120. In addition, the driver 200 may control the second switching transistor T15 to turn on after a predetermined period of time has elapsed from the time when the second driving voltage is applied to the source terminal of the second driving transistor T3. Here, the predetermined period of time may be a period of time equal to or more than a period of time during which the voltage of the node C is charged from the voltage Vset to the voltage capable of turning off the first switching transistor T10.

In this case, even though the data voltage corresponding to the black grayscale is set at the node A, a leakage current generated when the first switching transistor T10 is not immediately turned off may be blocked by the second switching transistor T15. Accordingly, the accurate black grayscale may be implemented.

Hereinafter, various embodiments of a method of driving the display panel 100 as shown in FIGS. 3B and 3C will be described with reference to FIGS. 24A through 29.

Figure 24A:
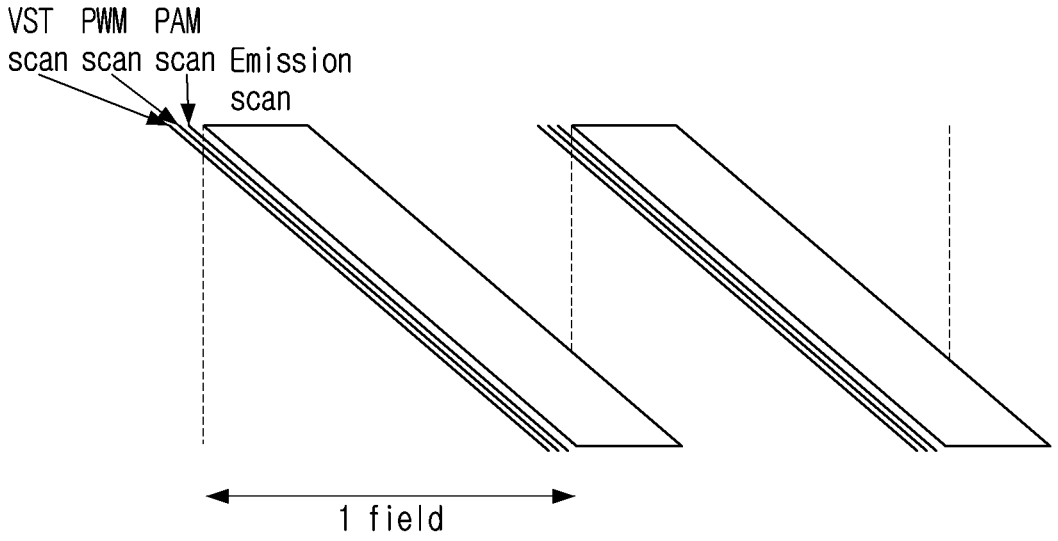
FIG. 24A is a diagram showing a method of driving a display panel according to an embodiment of the disclosure according to an embodiment.

FIG. 24A shows a concept in which the display panel 100 is driven during two image frame periods in the same manner as in FIG. 3B. In each frame of FIG. 24A, the vertical axis indicates a row line and the horizontal axis indicates time.

In FIG. 24A, VST denotes a control signal for an initialization operation of the sub pixel circuit 110, PWM denotes a control signal for setting a PWM data voltage, PAM denotes a control signal for setting a constant current generator voltage, and Emission denotes a control signal for a light emitting operation of the inorganic light emitting element 120 based on the set PWM data voltage and constant current generator voltage.

In FIG. 24A, "scan" described together with each of the control signals indicates that the corresponding control signals are sequentially applied in the order of row lines.

Referring to FIG. 24A, the driver 200 may drive the display panel 100 such that data voltages (the PWM data voltage and the constant current generator voltage) are applied to sub pixels included in each row line of the display panel 100 in the order of row lines, and the sub pixels included in each of the row lines of the display panel 100 emit light in the order of row lines based on the applied data voltages.

In this regard, the driver 200 may drive the display panel 100 such that a data voltage setting operation for all row lines is performed during the entire image frame period. In this case, because the light emitting operation of the inorganic light emitting element 120 is performed in each row line after the data voltage is set, the light emitting operation of some row lines may be performed in a next image frame period, as shown in FIG. 24A.

Figure 24B:
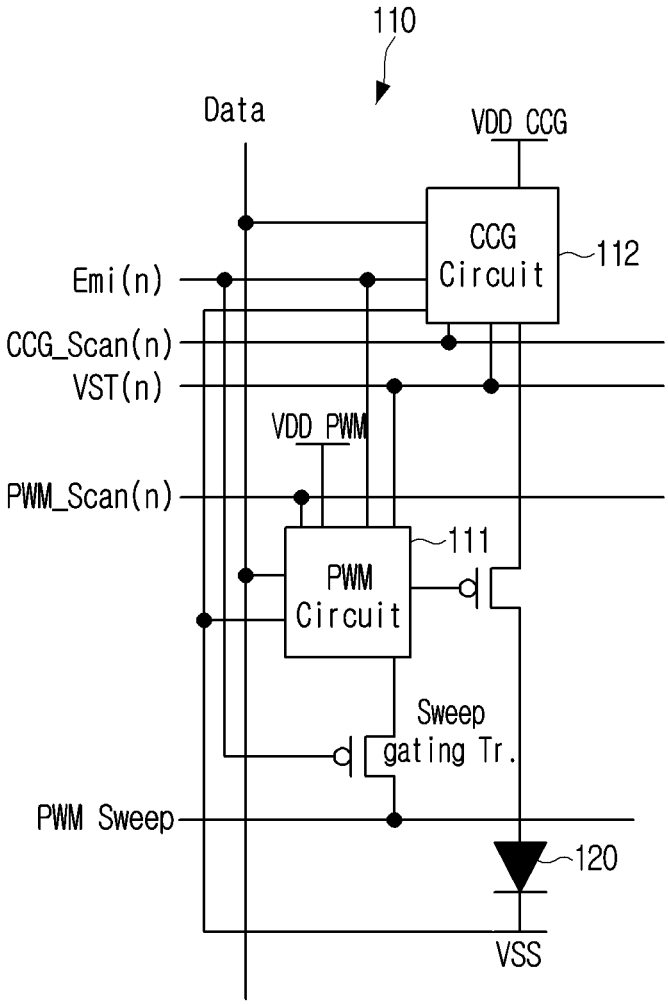
FIG. 24B is a block diagram of a sub pixel circuit according to an embodiment.
Figure 24C:
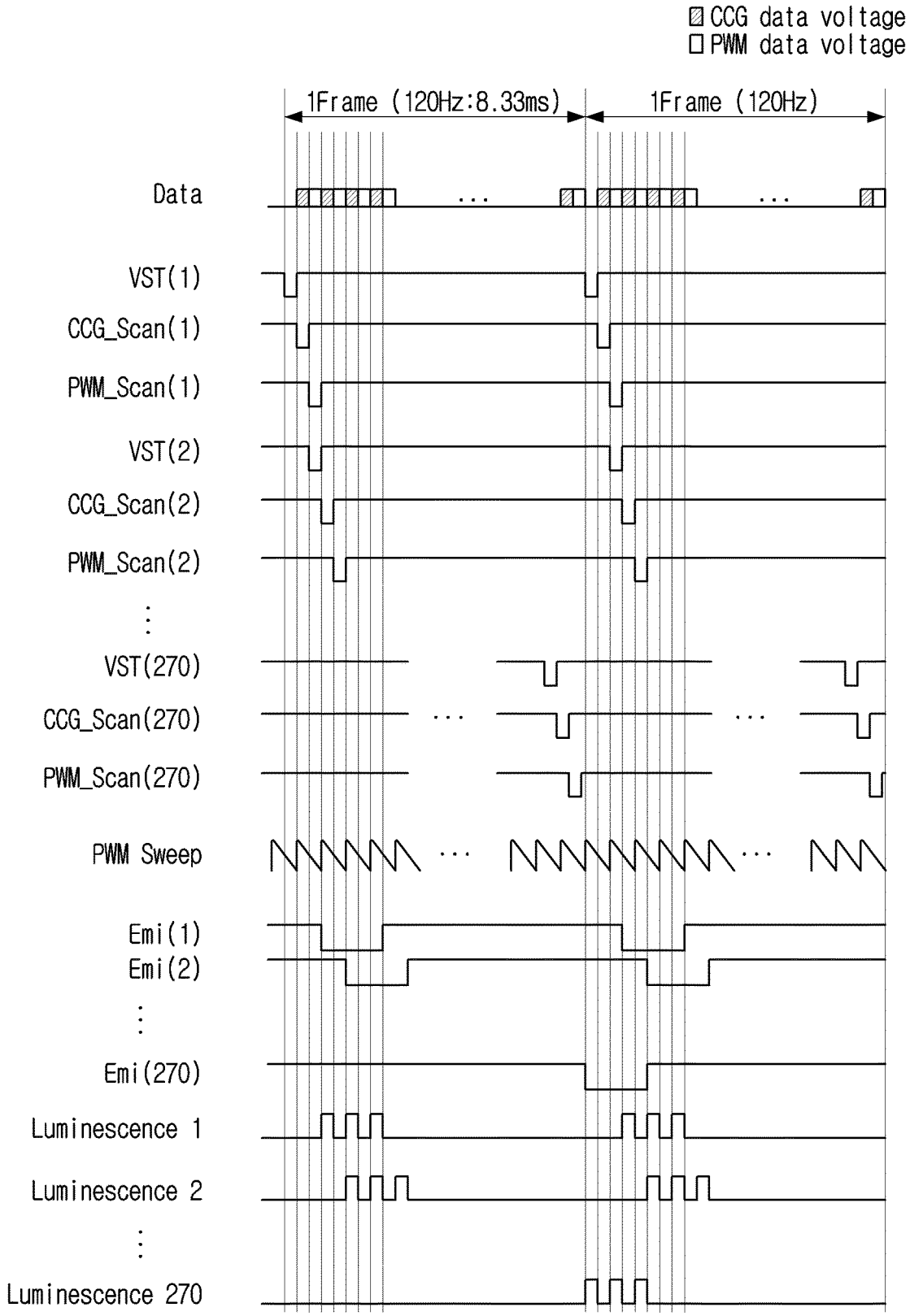
FIG. 24C is a timing diagram of various control signals for driving the sub pixel circuit shown in FIG. 24B.

FIG. 24B is a block diagram of the sub pixel circuit 110 according to an embodiment, and FIG. 24C is a timing diagram of various control signals for driving the sub pixel circuit 110 shown in FIG. 24B.

Figure 24D:
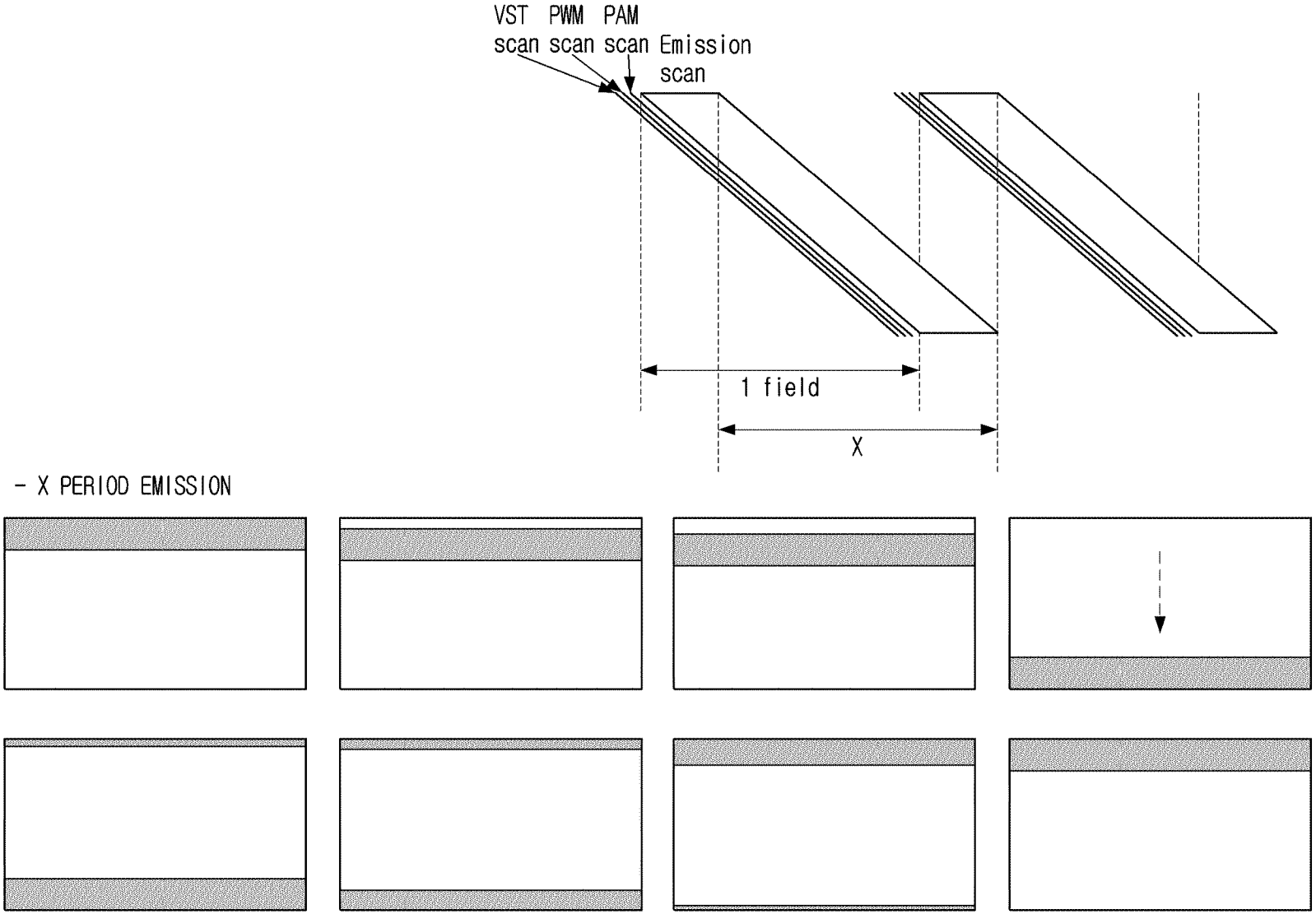
FIG. 24D is a diagram showing a light emitting operation of a display panel according to an embodiment.

According to an embodiment, the driver 200 may drive the sub pixel circuits 110 included in each row line as shown in FIG. 24C, thereby driving the display panel 100 as shown in FIG. 24A FIG. 24D is a diagram showing an image displayed on the display panel 100 when the display panel 100 is driven as shown in FIG. 24A.

Specifically, FIG. 24D shows a light emitting operation of the display panel 100 during an X period when a PWM data voltage corresponding to a full white grayscale is set in each sub pixel of the display panel 100.

Referring to FIG. 24D, as described above, it may be seen that sub pixels included in each row line of the display panel 100 sequentially emit light in the order of row lines.

Figure 25A:
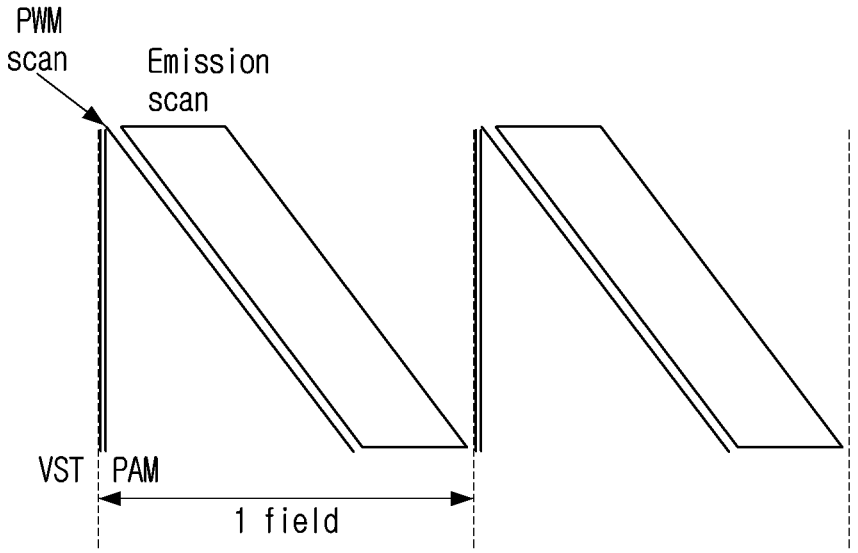
FIG. 25A illustrates a driving method of a display panel according to an embodiment.

FIG. 25A shows a concept in which the display panel 100 is driven during two image frame periods in the same manner as in FIG. 3C. In each frame of FIG. 25A, the vertical axis indicates a row line and the horizontal axis indicates time.

In FIG. 25A, unlike the driving method shown in FIG. 24A, it may be seen that the control signal VST and the control signal PAM are not sequentially applied to the display panel 100 in the order of row lines, but are simultaneously applied collectively. Accordingly, the expression "scan" is also not described.

That is, according to the driving method shown in FIG. 25A, an initialization operation and a constant current generator voltage setting operation are simultaneously performed in all sub pixel circuits 110 of the display panel 100 collectively.

The PWM data voltage setting operation and the light emitting operation are sequentially performed in the order of row lines, similar to that shown in FIG. 24A. Accordingly, in the example shown in FIG. 25A, the driver 200 may drive the display panel 100 such that the PWM data voltage is applied to the sub pixels included in each row line of the display panel 100 in order of row lines, and the sub pixels included in each of row lines of the display panel 100 emit light in the order of row lines based on the applied data voltage.

In this regard, the driver 200 may drive the display panel 100 such that the data voltage setting operation and the light emitting operation for all row lines are completed during one image frame time. In this case, as shown in FIG. 25A, the light emitting operation of all row lines is completed within the corresponding image frame time.

Figure 25B:
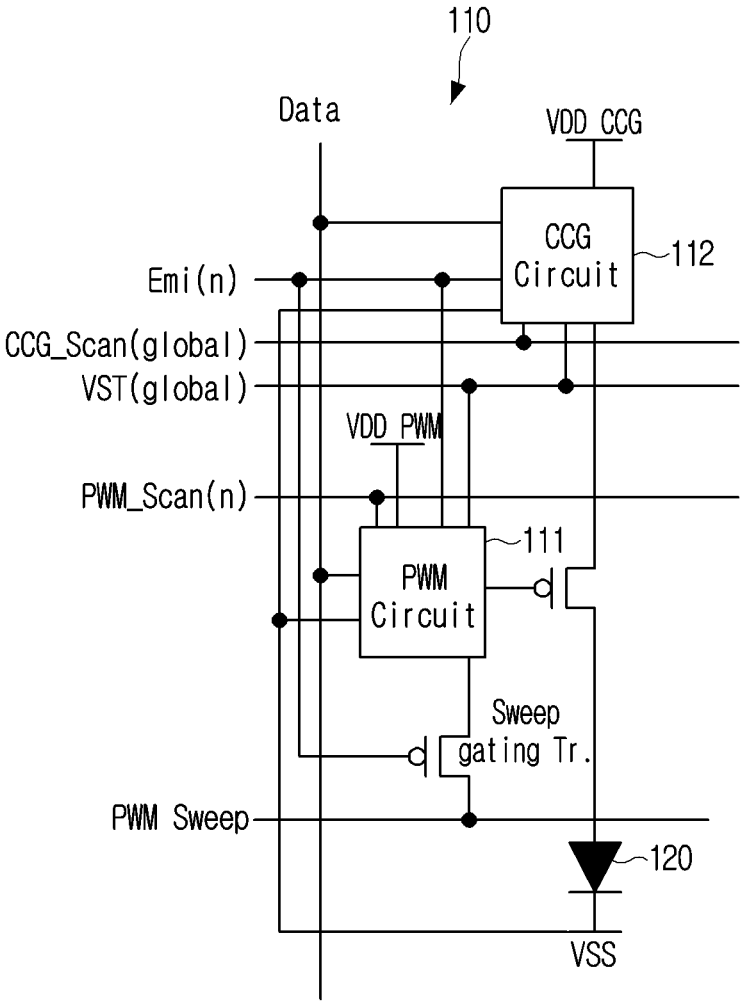
FIG. 25B is a block diagram of a sub pixel circuit according to an embodiment.
Figure 25C:
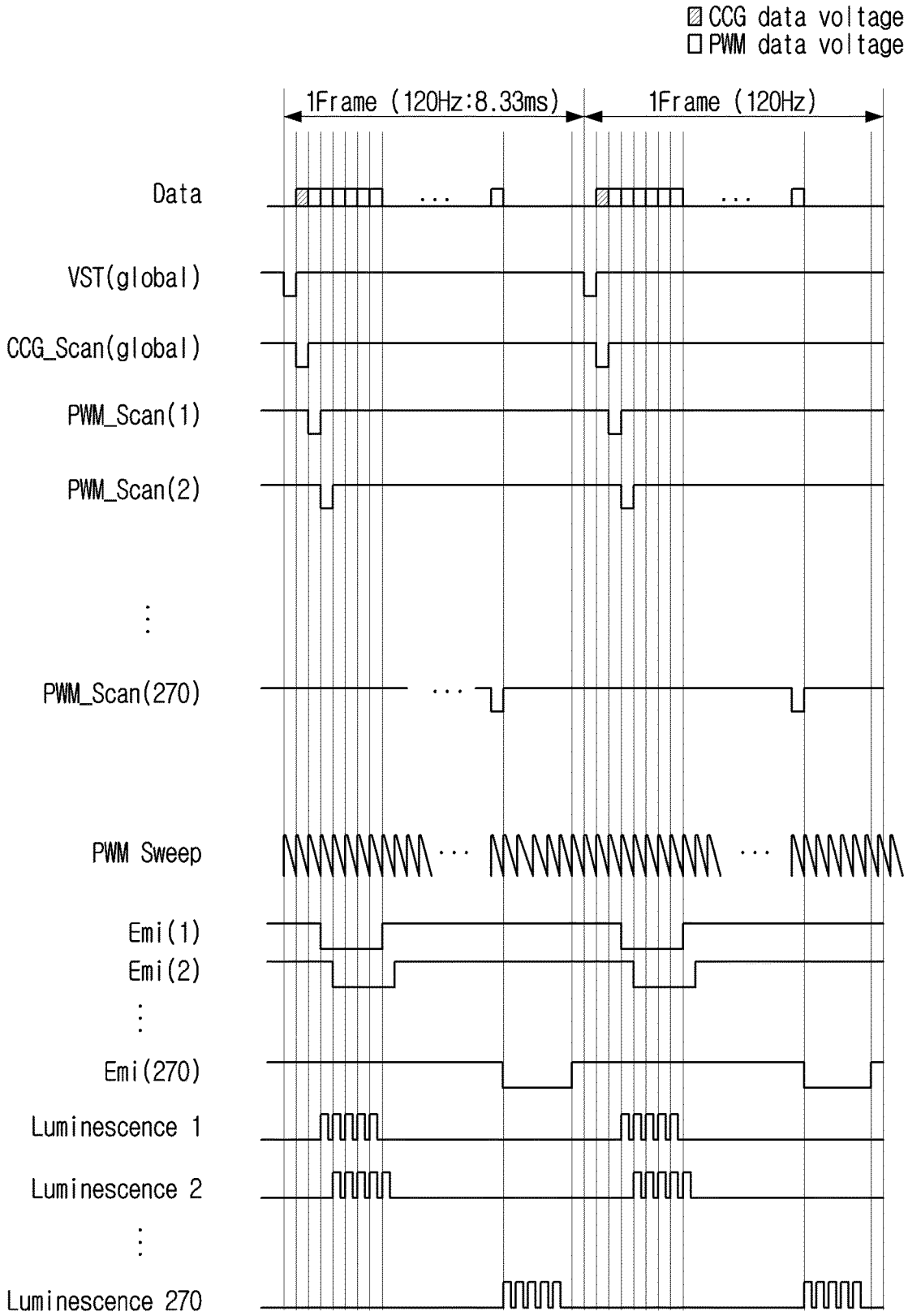
FIG. 25C is a timing diagram of various control signals for driving the sub pixel circuit shown in FIG. 25B.

FIG. 25B is a block diagram of the sub pixel circuit 110 according to an embodiment, and FIG. 25C is a timing diagram of various control signals for driving the sub pixel circuit 110 shown in FIG. 25B.

Referring to FIGS. 25B and 25C, unlike FIGS. 24B and 24C, it may be seen that the signal VST and the signal CCG_Scan are globally input. The driver 200 may drive the display panel 100 as shown in FIG. 25A by driving the sub pixel circuits 110 included in each row line as shown in FIG. 25C.

Figure 25D:
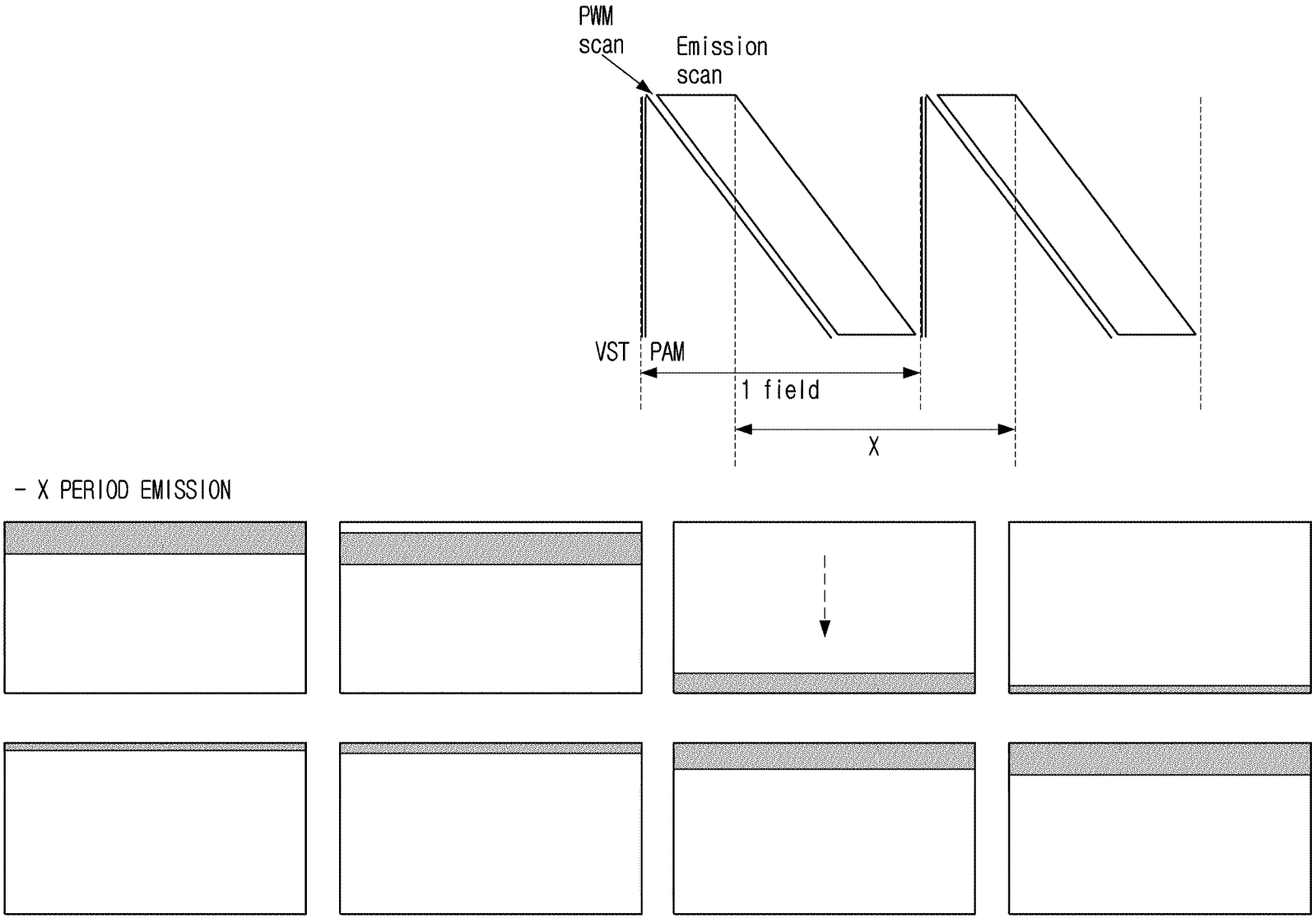
FIG. 25D is a diagram showing a light emitting operation of a display panel according to an embodiment.

FIG. 25D is a diagram showing an image displayed on the display panel 100 when the display panel 100 is driven as shown in FIG. 25A.

Specifically, FIG. 25D shows a light emitting operation of the display panel 100 during an X period when a PWM data voltage corresponding to a full white grayscale is set to each sub pixel of the display panel 100.

Referring to FIG. 25D, as described above, it may be seen that sub pixels included in each row line of the display panel 100 sequentially emit light in the order of row lines. However, in the case of the driving method shown in FIG. 25A, because the light emitting operation of all row lines is completed within the corresponding image frame time, unlike FIG. 24D, the light emitting operation based on the data voltage applied in one image frame period does not extend to a next image frame period.

Referring to FIGS. 24B and 25B, the sub pixel circuit 110 includes a sweep gating transistor Tr, and it may be seen that a PWM sweep signal is applied to the PWM circuit 111 while the sweep gating transistor is turned on according to the control signal Emi(n).

At this time, the PWM sweep signal is a periodic signal in which the sweep voltage linearly changing between two voltages is repeated, as shown in FIGS. 24C and 25C.

Figure 26:
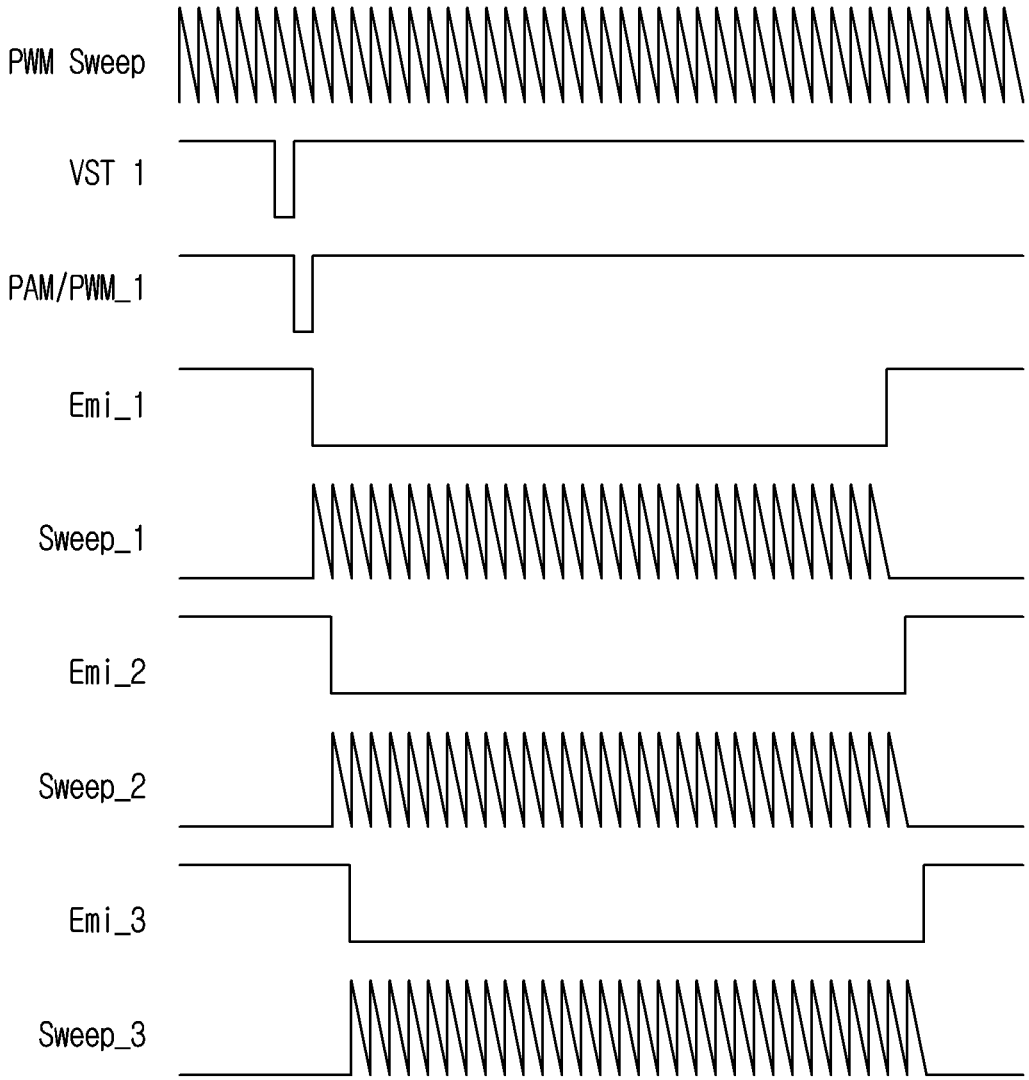
FIG. 26 is a diagram showing a sweep gating operation according to an embodiment.

Accordingly, according to an embodiment, while the sweep gating transistor is turned on according to the signal Emi(n), a plurality of consecutive sweep voltages gated in the PWM sweep signal are applied to the PWM circuit 111. FIG. 26 shows such a sweep gating operation.

According to an embodiment of the disclosure, because the light emitting operation of the inorganic light emitting element 120 based on the data voltage is performed once per one sweep voltage, during the light emission period for each row line (i.e., while a low voltage is applied through the signal Emi(n)), it may be seen that the inorganic light emitting elements 120 included in the corresponding row line emit light a plurality of times.

Figure 27A:
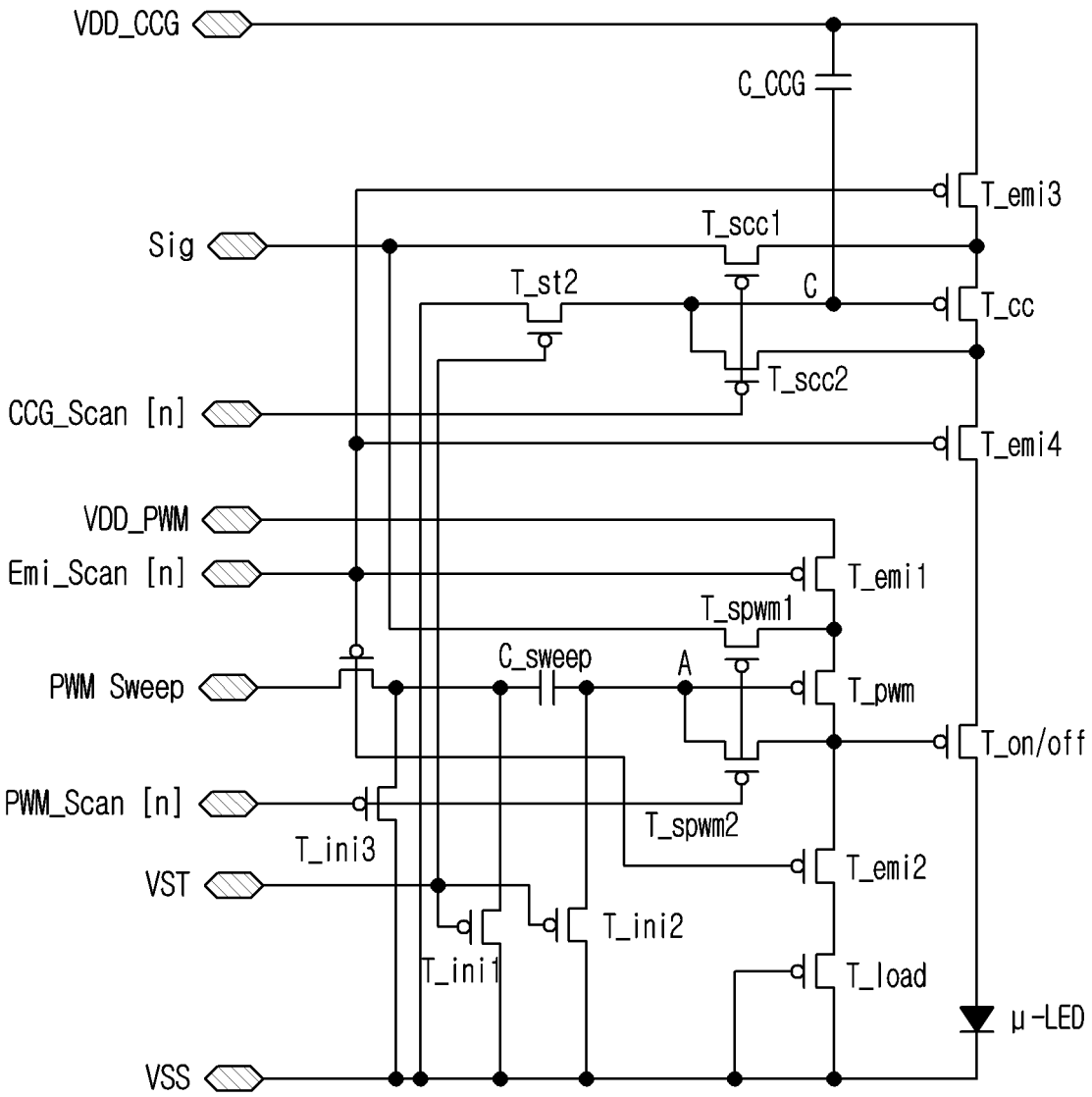
FIG. 27A is a detailed circuit diagram of a sub pixel circuit according to an embodiment.
Figure 27B:
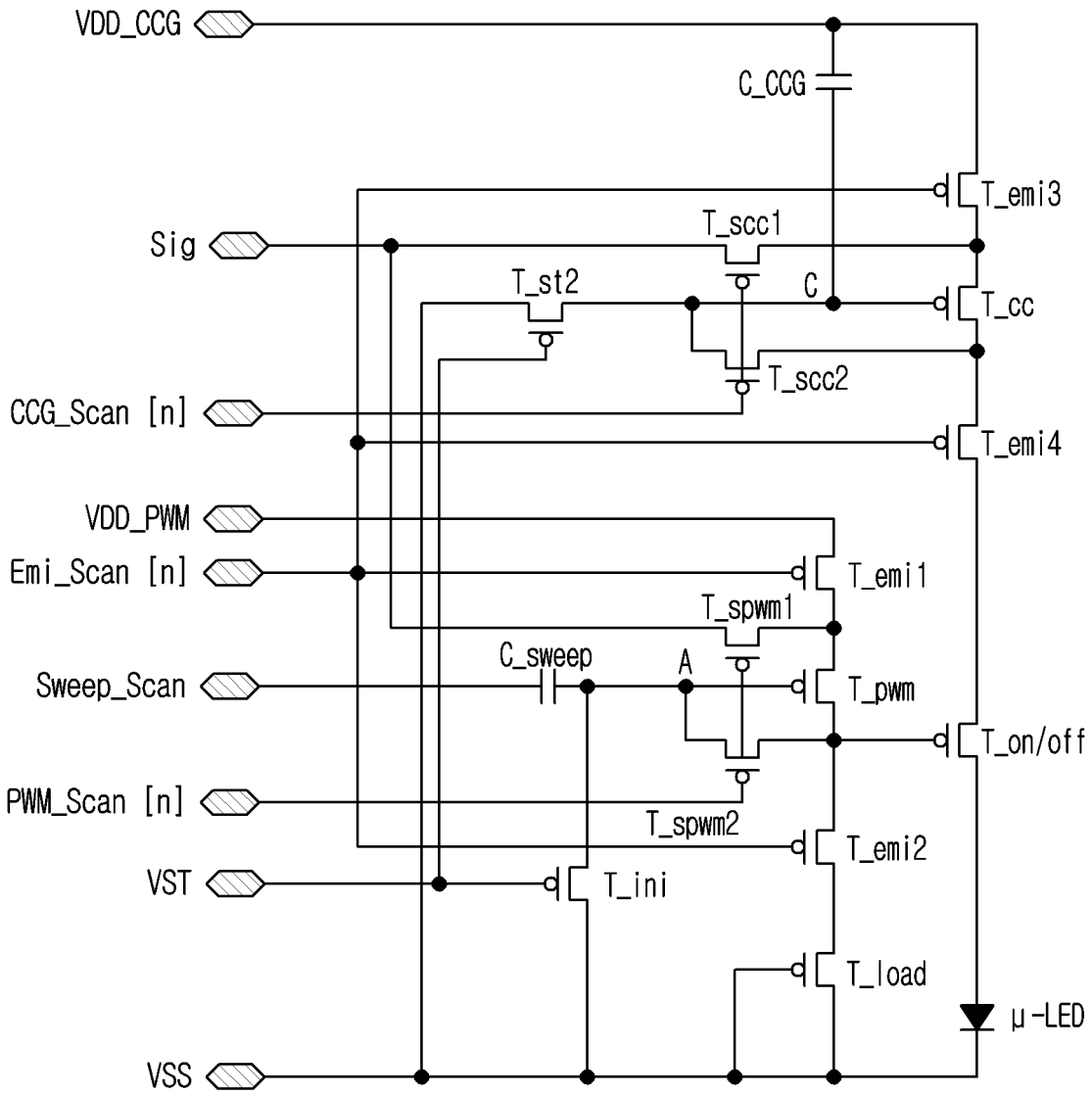
FIG. 27B is a detailed circuit diagram of a sub pixel circuit according to an embodiment.

FIGS. 27A and 27B are detailed circuit diagrams of the sub pixel circuit 110 according to various embodiments.

The above-described sweep gating method may be implemented by designing a gating circuit inside the sub pixel circuit 110 or may be implemented to receive a sweep signal gated through an externally separate sweep gate driver circuit.

FIG. 27A shows an embodiment of the sub pixel circuit 110 including a sweep gating circuit therein, and FIG. 27B shows an embodiment of the sub pixel circuit 110 configured to receive a sweep signal gated in accordance with a light emission period from a sweep gate driver.

When a plurality of display modules 300 are combined to implement one large display apparatus, distortion of an image may problematically occur on a boundary part of upper and lower display modules.

Figure 28A:
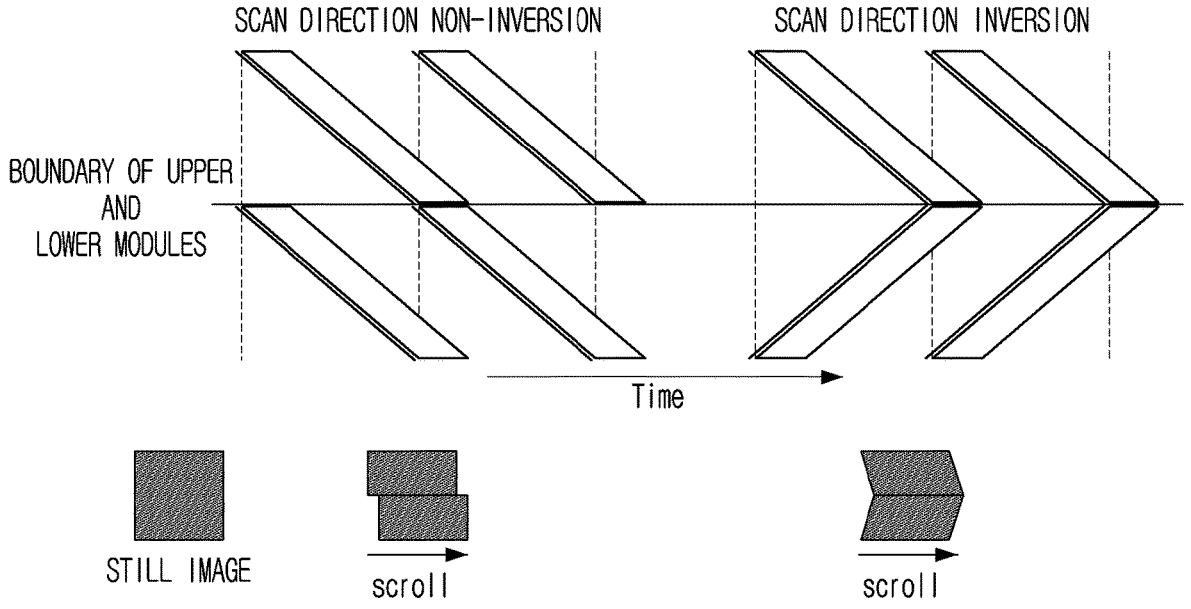
FIG. 28A is a diagram showing distortion of an image occurring on a boundary part of a display module and a solving method thereof according to an embodiment.

FIG. 28A is a diagram showing distortion of an image occurring on a boundary part of upper and lower display modules and a solving method thereof in the driving method of FIG. 24A.

As shown on the left side of FIG. 28A, when the upper and lower display modules 300 are driven as they are as shown in FIG. 28A, distortion of the image may occur on the boundary part of the module.

Accordingly, according to an embodiment, as shown on the right side of FIG. 28A, the driver 200 drives the lower display module 300 by inverting a scan direction of the lower display module 300, thereby preventing a distortion phenomenon of the image that occurs on the boundary part of the module.

In this regard, the scan direction may be reversed by changing a driving order of the row lines (specifically, by reversely driving the gate driver). Therefore, for example, when the display module 300 includes 270 row lines, the driver 200 drives the upper display module 300 sequentially from a first row line to a 270th row line, and drives the lower display module 300 sequentially from the 270th row line to the first row line, thereby preventing the distortion phenomenon of the image that occurs on the boundary part of the module.

Because the same row line is driven at the same time on the boundary part of the left and right display modules, distortion of the image does not occur.

Figure 28B:
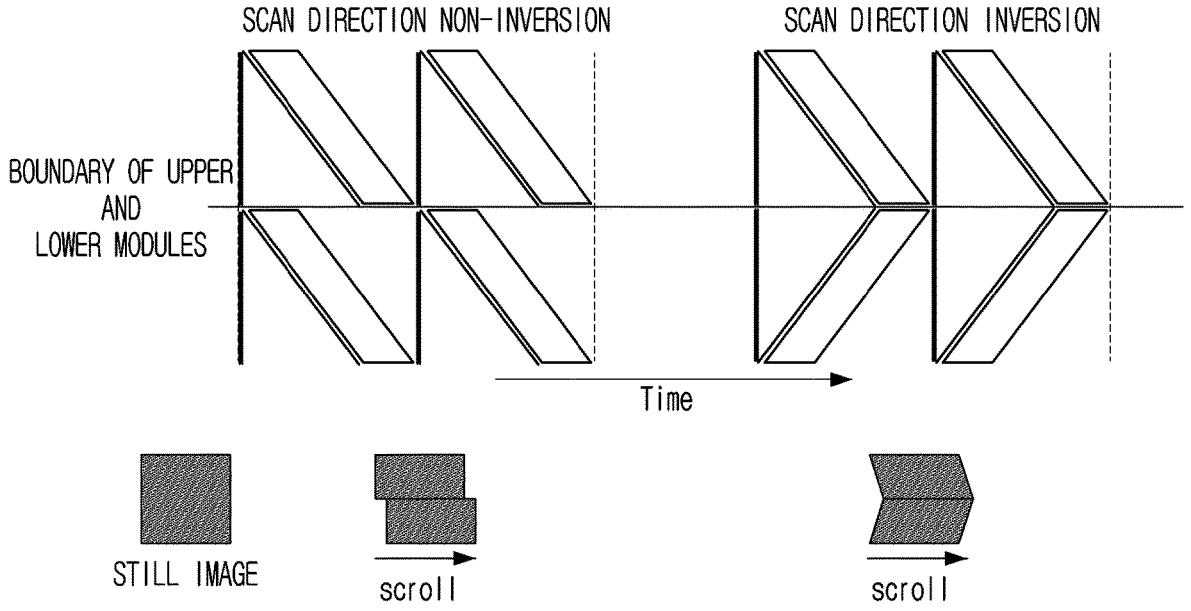
FIG. 28B is a diagram showing distortion of an image occurring on a boundary part of a display module and a solving method thereof according to an embodiment.

FIG. 28B is a diagram showing distortion of an image occurring on a boundary part of upper and lower display modules and a solving method thereof in the driving method of FIG. 25A. Because the principle is the same as that of FIG. 28A, redundant descriptions are omitted.

Figure 29:
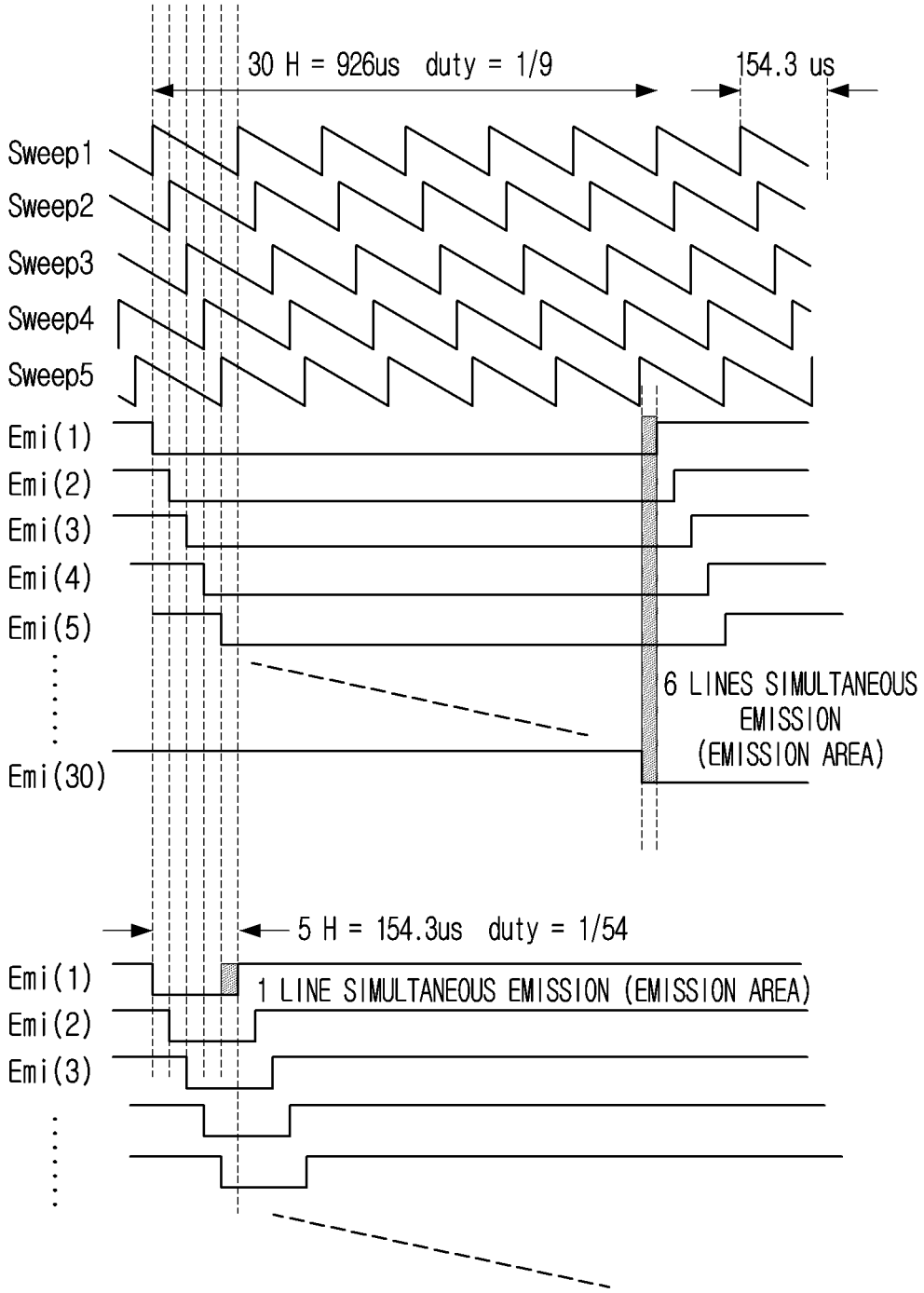
FIG. 29 is a diagram showing a method of driving a display panel using a plurality of sweep signals according to an embodiment.

FIG. 29 is a diagram showing a method of driving the display panel 100 using a plurality of sweep signals according to an embodiment.

According to an embodiment, as described above, a single sweep signal (PWM Sweep) is not used by gating in all sub pixel circuits, but a plurality of sweep signals with a time difference in a linearly changing period are gated and used. FIG. 29 shows an example in which five sweep signals with the time difference are used in the linearly changing period.

Figure 30A:
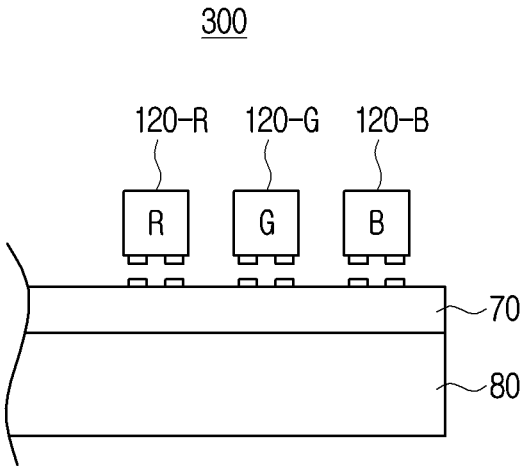
FIG. 30A is a cross-sectional view of a display module according to an embodiment.

FIG. 30A is a cross-sectional view of a display module according to an embodiment. In FIG. 30A, for convenience of explanation, only one pixel included in the display module 300 is shown.

According to FIG. 30A, the display module 300 includes a glass substrate 80, a TFT layer 70, and inorganic light emitting elements R, G, and B 120-R, 120-G, and 120-B. In this regard, the above-described sub pixel circuit 110 is implemented as a thin film transistor (TFT), and may be included in the TFT layer 70 on the glass substrate 80.

Each of the inorganic light emitting elements R, G, and B 120-R, 120-G, and 120-B is mounted in the TFT layer 70 so as to be electrically connected to the corresponding sub pixel circuit 110 to configure the above-described sub pixel.

Although not shown in the drawing, the sub pixel circuit 110 providing a driving current to the inorganic light emitting elements 120-R, 120-G, and 120-B is present in the TFT layer 70 for each of the inorganic light emitting elements 120-R, 120-G, and 120-B, and each of the inorganic light emitting elements 120-R, 120-G, and 120-B may be mounted or disposed in the TFT layer 70 to be electrically connected to the corresponding sub pixel circuit 110.

FIG. 30A shows an example in which the inorganic light emitting elements R, G, and B 120-R, 120-G, and 120-B are flip chip type micro LEDs. However, the embodiment is not limited thereto, and the inorganic light emitting elements R, G, and B 120-R, 120-G, and 120-B may be horizontal type or vertical type micro LEDs according to an embodiment.

Figure 30B:
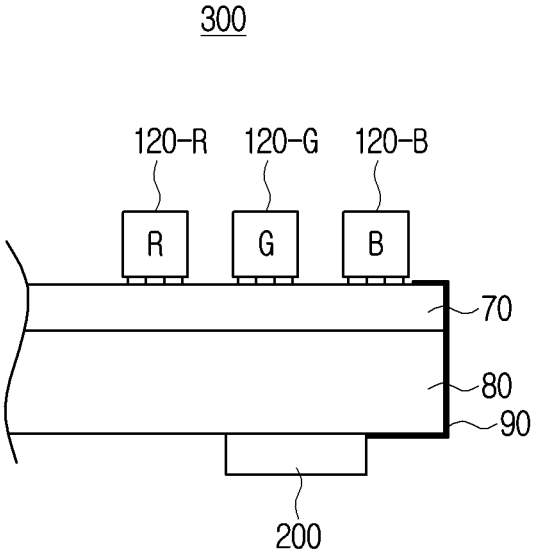
FIG. 30B is a cross-sectional view of a display module according to an embodiment.

FIG. 30B is a cross-sectional view of a display module according to another embodiment of the disclosure.

Referring to FIG. 30B, the display module 300 includes the TFT layer 70 formed on one surface of the glass substrate 80, the inorganic light emitting elements R, G, and B 120-R, 120-G, and 120-B mounted on the TFT layer 70, the driver 200, and a connection wiring 90 for electrically connecting the sub pixel circuit 110 formed in the TFT layer 70 and the driver 200.

As described above in FIG. 4, according to an embodiment, at least some of various circuits of the driver 200 may be implemented in the form of separate chips to be disposed on the rear surface of the glass substrate 80, and may be connected to the sub pixel circuits 110 formed in the TFT layer 70 through the connection wiring 90.

In this regard, referring to FIG. 30B, it may be seen that the sub pixel circuits 110 included in the TFT layer 70 may be electrically connected to the driver 200 through the connection wiring 90 formed in an edge (or a side surface) of a TFT panel (hereinafter, the TFT layer 70 and the glass substrate 80 are collectively referred to as a TFT panel).

In this way, the reason for forming the connection wiring 90 in the edge region of the display panel 100 and connecting the sub pixel circuits 110 included in the TFT layer 70 and the driver 200 is that when a hole penetrating the glass substrate 80 is formed to connect the sub pixel circuits 110 and the driver 200, there may be a problem such as cracking occurring in the glass substrate 80 due to a temperature difference between the manufacturing process of the TFT panels 70 and 80 and a process of filling the hole with a conductive material.

Figure 30C:
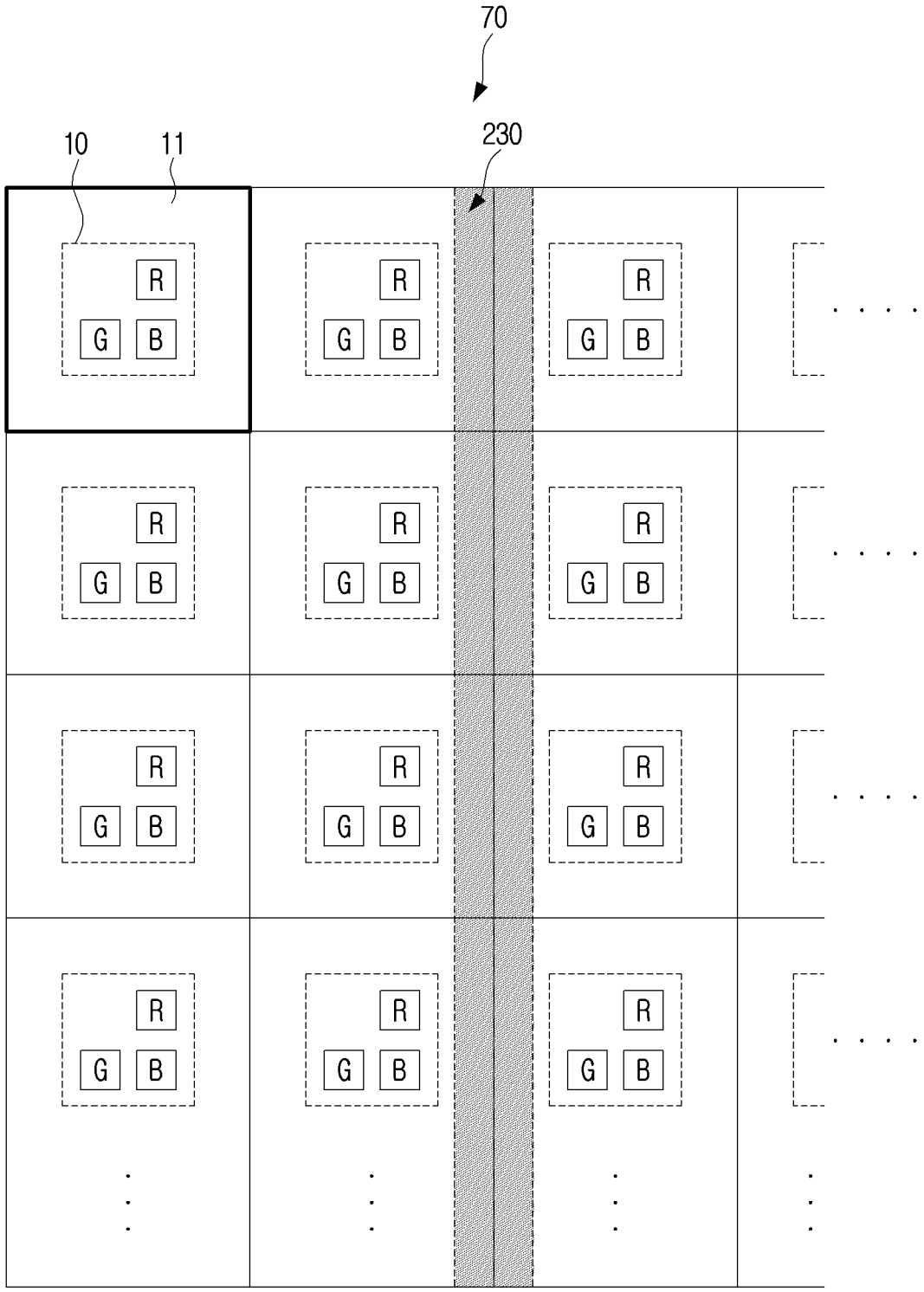
FIG. 30C is a plan view of a TFT layer according to an embodiment of the disclosure.

As described above in FIG. 4, according to another embodiment, at least some of the various circuits of the driver 200 may be formed in a TFT layer together with sub pixel circuits formed in the TFT layer in the display panel 100 and connected to the sub pixel circuits. FIG. 30C shows this embodiment.

FIG. 30C is a plan view of the TFT layer 70 according to an embodiment. Referring to FIG. 30C, it may be seen that a remaining region 11 is present other than a region (in this region, the sub pixel circuits 110 respectively corresponding to the R, G, and B sub pixels included in a pixel 10 are present) occupied by one pixel 10 in the TFT layer 70.

As described above, because the remaining regions 11 are present in the TFT layer 70, some of the various circuits of the driver 200 described above may be formed in the remaining regions 11.

FIG. 30C shows an example in which a gate driver circuit 230 is implemented in the remaining region 11 of the TFT layer 70. As such, a structure in which the gate driver circuit 230 is formed in the TFT layer 70 may be referred to as a gate in panel (GIP) structure, but the name is not limited thereto.

FIG. 30C is merely an example, and a circuit that may be included in the remaining region 11 of the TFT layer 70 is not limited to the gate driver circuit 230. According to an embodiment, the TFT layer 70 may further include a MUX circuit for selecting R, G, and B sub pixels, an electrostatic discharge (ESD) protection circuit for protecting the sub pixel circuit 110 from static electricity, a sweep voltage providing circuit, etc.

Figure 31A:
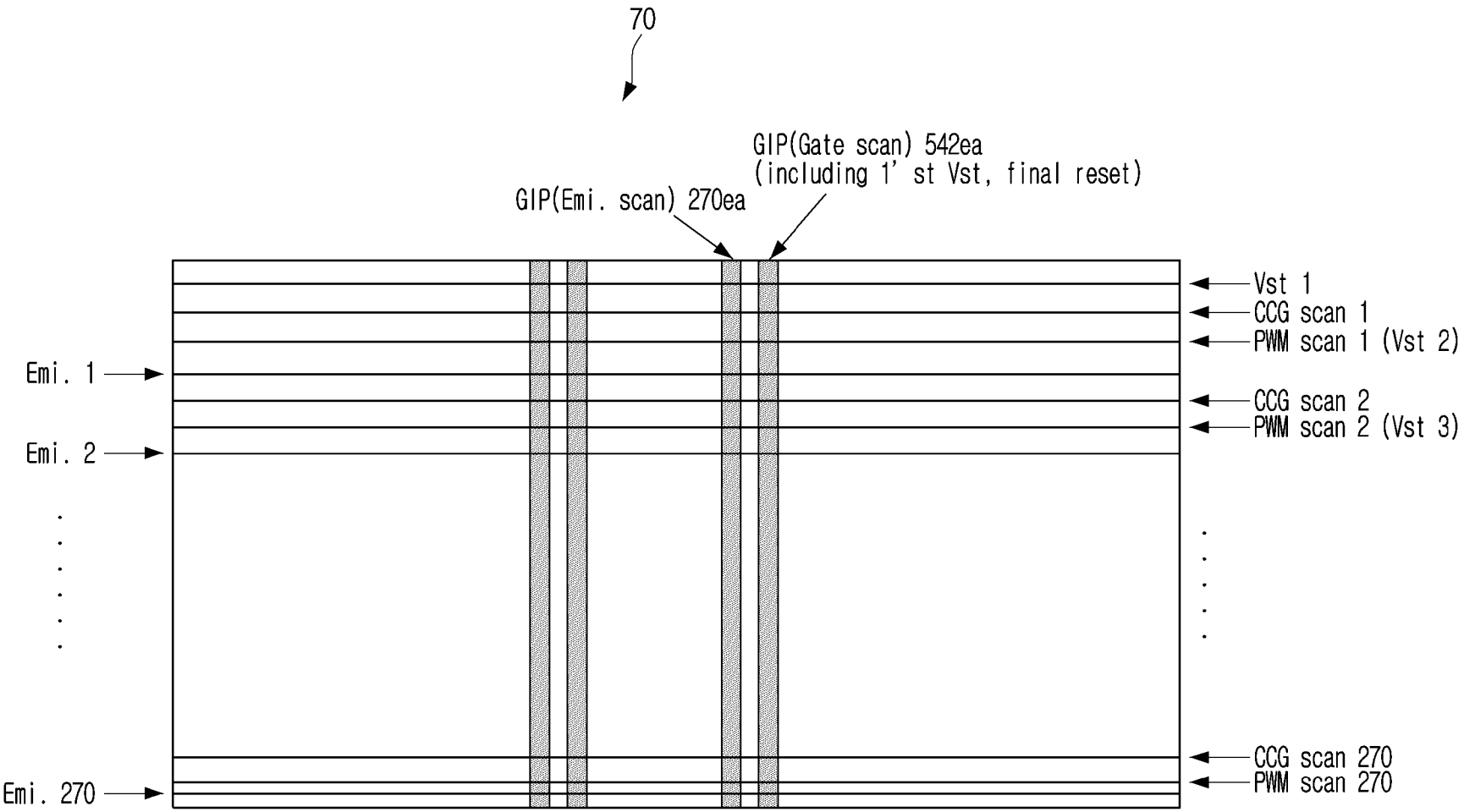
FIG. 31A is a diagram showing an example in which a gate driver is formed in a TFT layer according to an embodiment.
Figure 31B:
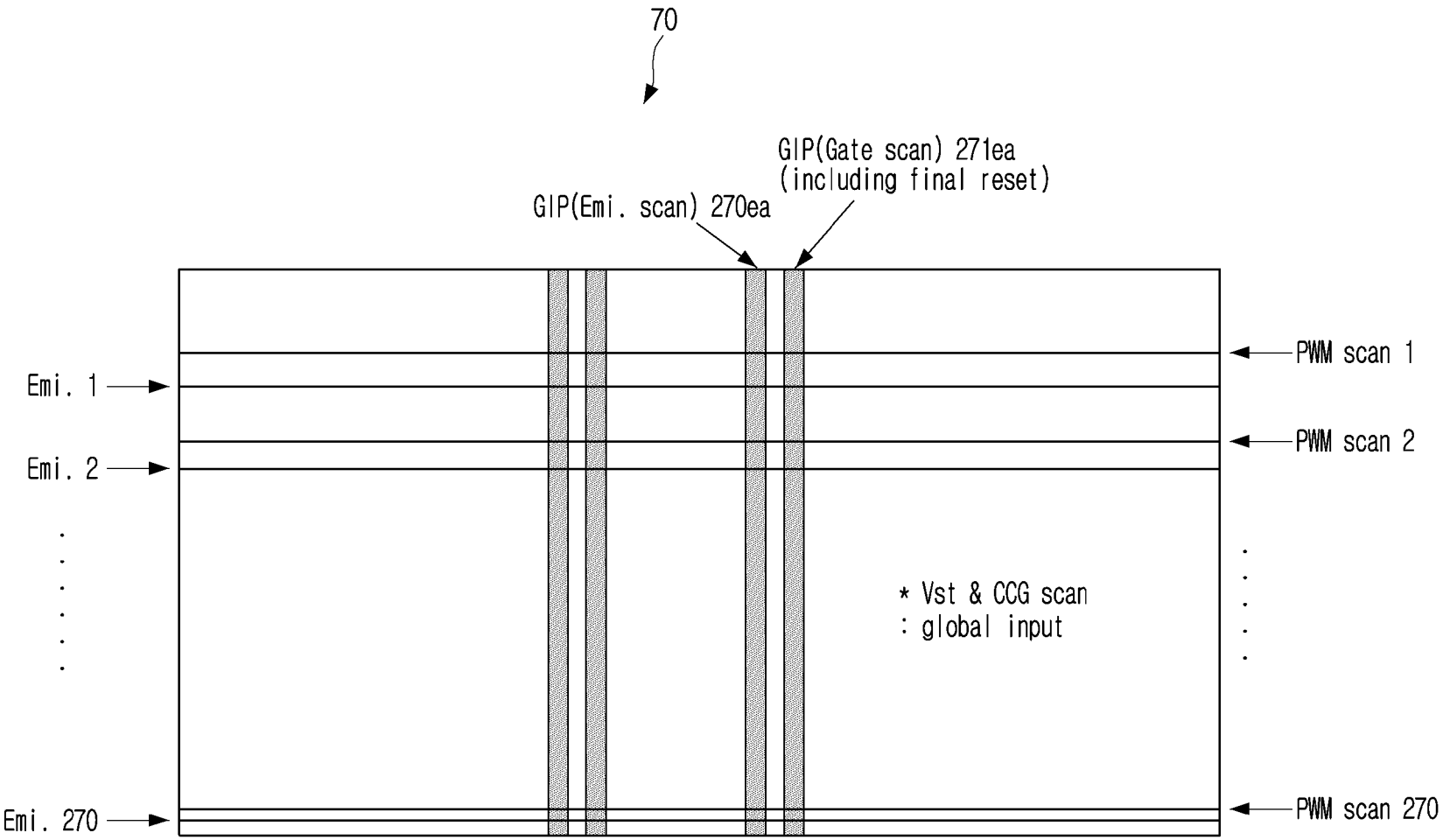
FIG. 31B is a diagram showing an example in which a gate driver is formed in a TFT layer according to an embodiment.
Figure 31C:
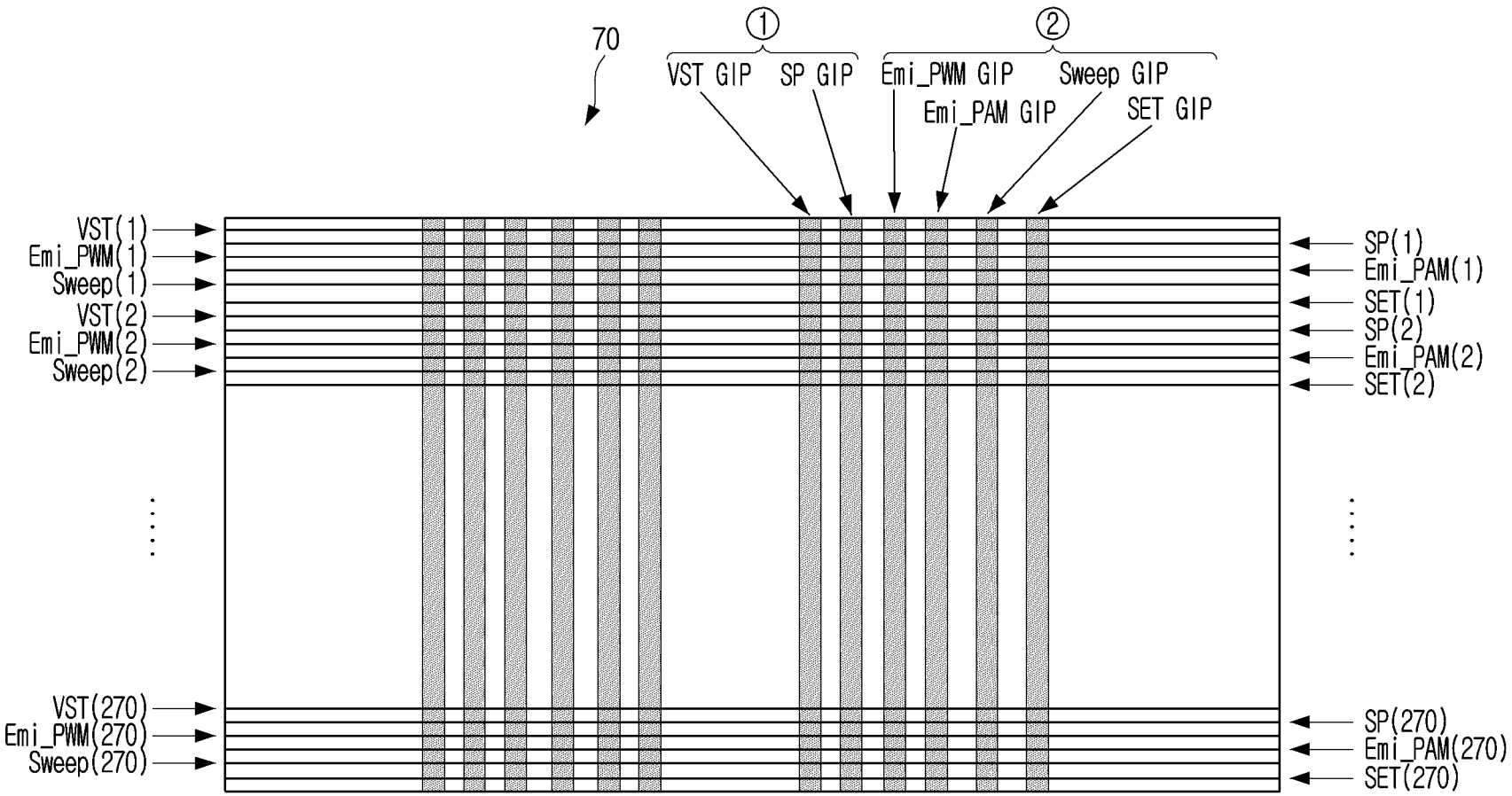
FIG. 31C is a diagram showing an example in which a gate driver is formed in a TFT layer according to an embodiment.

FIGS. 31A to 31C are diagrams showing a GIP structure according to various embodiments.

FIG. 31A shows an example in which a gate driver for providing various gate signals shown in FIG. 24C is formed in the TFT layer 70. As shown, in the case of the display panel 100 including 270 row lines, 542 gate driver circuits for three gate signals VST(n), CCG_Scan(n), and PWM_Scan(n) related to data setting and 270 gate driver circuits for the gate signal Emi(n) related to a light emitting operation may be formed or disposed on the TFT layer 70.

At this time, the reason why the 542 gate driver circuits are required to generate three gate signals related to data setting is that the signal PWM_Scan(n) is used as the signal VST(n) of a next row line as shown in FIG. 24C, and two gate drivers are additionally required to generate the signal VST(1) and a last reset signal.

FIG. 31B shows an example in which a gate driver for providing various gate signals shown in FIG. 25C is formed in the TFT layer 70. In the case of the driving method shown in FIGS. 25A to 25D, as described above, the signal VST and the signal CCG_scan are global inputs.

Therefore, as shown, in the case of the display panel 100 including 270 row lines, 271 gate driver circuits (including one gate driver circuit for generating the last reset signal) for generating the gate signal PWM_Scan(n) related to PWM data setting and 270 gate driver circuits for the gate signal Emi(n) related to a light emitting operation may be formed or disposed in the TFT layer 70.

FIG. 31C shows an example in which a gate driver for providing various gate signals shown in FIG. 14 is formed in the TFT layer 70.

According to an embodiment, as shown in FIG. 31C, gate driver circuits for the gate signals VST(n) and SP(n) related to a data setting operation and gate driver circuits for the gate signals Emi_PWM(n), SET(n), Emi_PAM(n), and Sweep(n) related to a light emitting operation may be formed or disposed in the TFT layer 70.

Referring to FIGS. 31A to 31C, it may be seen that the same gate driver circuits are disposed one by one in left and right symmetry. This is called double feeding, through which an RC delay value generated when gate signals are transmitted to each region of the display panel 100 may be minimized, and the uniformity of an RC delay for each region may increase.

The number of gate driver circuits described above is merely an example, and implementation examples are not limited to the described number. That is, depending on how the gate driver circuit is designed or how the gate signals output from the gate driver circuit are connected between row lines, different implementations are possible.

Figure 32:
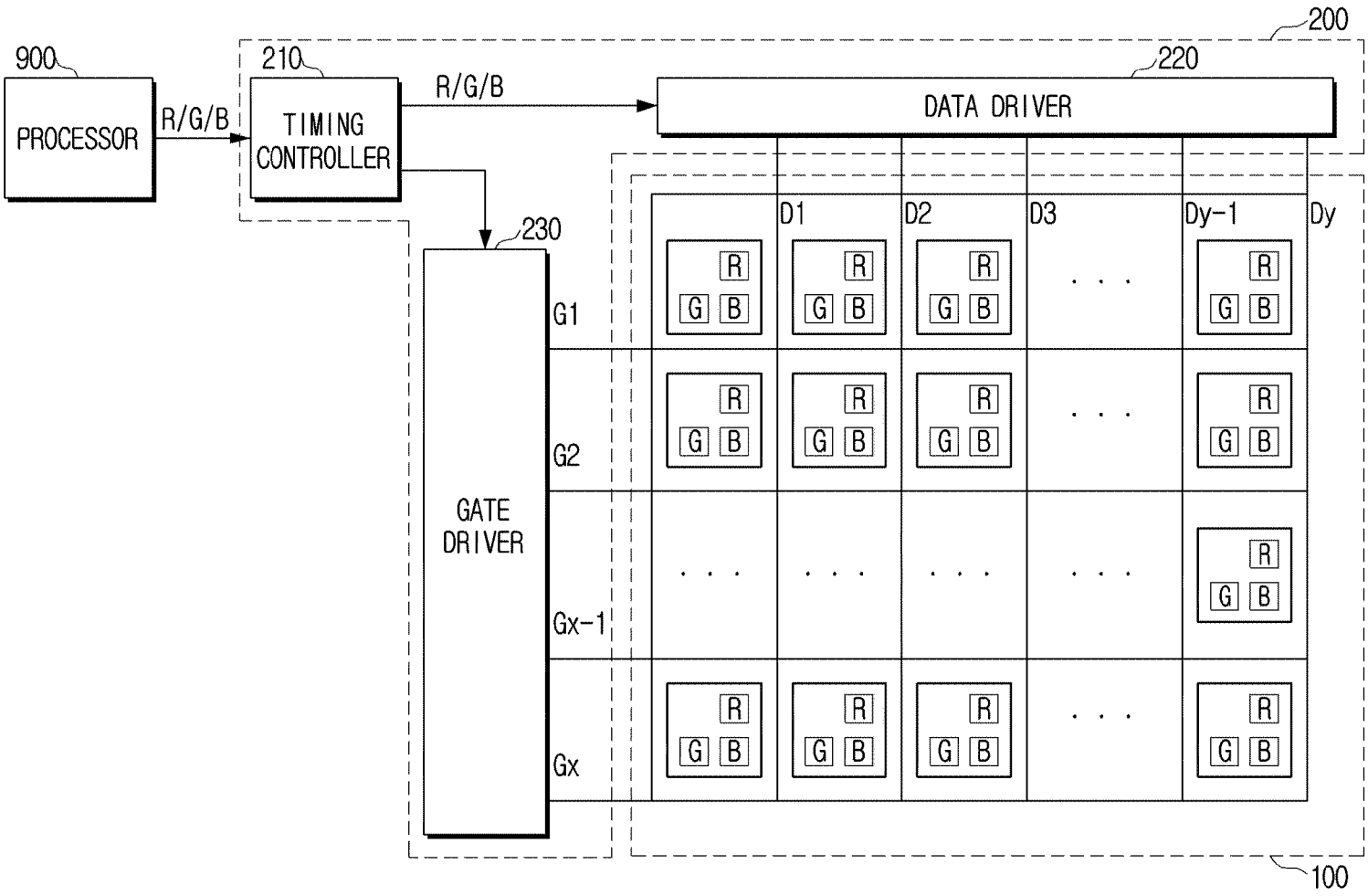
FIG. 32 is a configuration diagram of a display apparatus according to an embodiment.

FIG. 32 is a configuration diagram of a display apparatus 1000 according to an embodiment.

Referring to FIG. 32, the display apparatus 1000 includes the display panel 100, the driver 200, and a processor 900.

The display panel 100 includes a plurality of pixels, and each pixel includes a plurality of sub pixels.

Specifically, the display panel 100 may be formed in a matrix form such that gate lines G1 to Gx and data lines D1 to Dy intersect with each other, and each pixel may be formed in a region provided at the intersection.

At this time, each pixel may include three sub pixels such as R, G, and B, and each sub pixel included in the display panel 100 may include, as described above, the inorganic light emitting element 120 of a corresponding color and the sub pixel circuit 110.

Here, the data lines D1 to Dy are lines for applying a data voltage (in particular, a PWM data voltage) to each sub pixel included in the display panel 100, and the gate lines G1 to Gx are lines for selecting pixels (or sub pixels) included in the display panel 100 for each line. Accordingly, the data voltage applied through the data lines D1 to Dy may be applied to the pixel (or sub pixel) of the selected row line through the gate signal.

In this regard, according to an embodiment, a data voltage to be applied to a pixel connected to each data line may be applied to each of the data lines D1 to Dy. At this time, because one pixel includes a plurality of sub pixels (e.g., R, G, and B sub pixels), data voltages (i.e., an R data voltage, a G data voltage, and a B data voltage) to be respectively applied to the R, G, and B sub pixels included in one pixel may be time-divided and applied to the respective sub pixels through one data line. The data voltages that are time-divided and applied through one data line as described above may be applied to the respective sub pixels through a MUX circuit.

According to embodiments, a separate data line may be provided for each of the R, G, and B sub pixels. In this case, the R data voltage, the G data voltage, and the B data voltage do not need to be time-divided and applied, and the corresponding data voltages may be simultaneously applied to the corresponding sub pixels through each data line.

In FIG. 32, for convenience of illustration, only one set of gate lines such as G1 to Gx is shown. However, the actual number of gate lines may vary depending on a driving method of the sub pixel circuit 110 included in the display panel 100. For example, as shown in FIG. 31C, six gate lines VST, SP, Emi_PWM, Emi_PAM, Sweep, and SET may be provided for one row line.

The driver 200 drives the display panel 100 under the control of the processor 900 and may include a timing controller 210, a data driver 220, a scan driver 230, and the like.

The timing controller 210 may receive an input signal IS, a horizontal synchronization signal Hsync, a vertical synchronization signal Vsync, and a main clock signal MCLK from the outside, generate and provide an image data signal, a scan control signal, a data control signal, a light emission control signal or the like to the display panel 100, the source driver 220, the gate driver 230, and the like.

In addition, the timing controller 210 may apply a control signal, that is, a MUX signal, for selecting each of the R, G, and B sub pixels, to a MUX circuit (not shown). Accordingly, a plurality of sub pixels included in a pixel of the display panel 100 may be selected through the MUX circuit (not shown).

The data driver 220 (or a source driver) is a means for generating a data signal (in particular, a PWM data voltage), and generates a data signal by receiving image data of an R/G/B component from the processor 900. In addition, the data driver 220 may apply the generated data signal to each sub pixel circuit 110 of the display panel 100 through the data lines D1 to Dy.

The gate driver 230 (or a scan driver) may select pixels disposed in a matrix form in units of row lines to generate various gate signals (e.g., VST, SP, Emi_PWM, Emi_PAM, Sweep, SET, etc.) for driving the selected pixels and apply the generated gate signals to the display panel 100 through the gate lines G1 to Gx. In particular, according to an embodiment of the disclosure, the gate driver 230 may sequentially apply the generated gate signals in the order of row lines.

Although not shown in the drawings, the driver 200 may further include a driving voltage providing circuit for providing various driving voltages (e.g., the first driving voltage VDD_PAM, the second driving voltage VDD_PWM, a ground voltage VSS, the reset voltage Vset, the test voltage TEST, the constant current generator voltage VPAM_R/G/B, etc.) to the sub pixel circuit 110 included in the display panel 100, a clock signal providing circuit for providing a clock signal to the gate driver circuit 230 or the data driver circuit 220, the MUX circuit, a sweep voltage providing circuit, an ESD protection circuit, and the like.

The processor 900 controls the overall operation of the display apparatus 1000. In particular, the processor 900 may drive the display panel 100 by controlling the driver 200.

To this end, the processor 900 may be implemented as at least one of a central processing unit (CPU), a microcontroller, an application processor (AP), a communication processor (CP), or an ARM processor.

In FIG. 32, the processor 900 and the timing controller 210 are described as separate components, but according to an embodiment, an embodiment in which only one of the two components is included in the display apparatus 1000 and the included component performs even a function of the other component.

Figure 33:
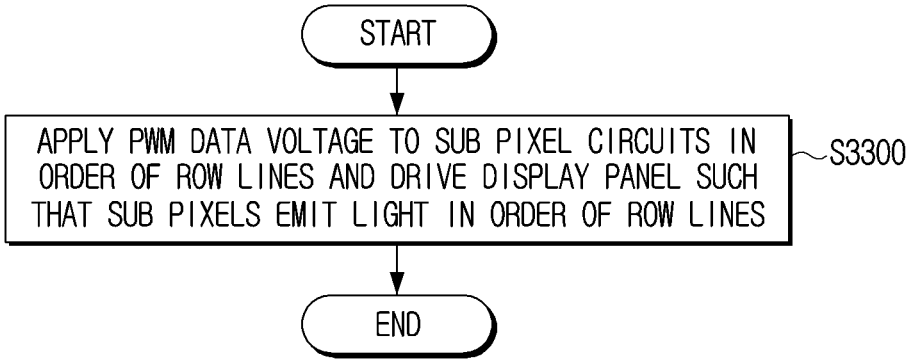
FIG. 33 is a flowchart of a driving method of a display module according to an embodiment.

FIG. 33 is a flowchart of a driving method of the display module 300 according to an embodiment.

Here, the display module 300 may include the display panel 100 in which a plurality of pixels each including a plurality of sub pixels are disposed on a plurality of row lines.

In this regard, as shown in FIG. 33, the display module 300 may apply a PWM data voltage to the sub pixels included in each row line of the display panel 100 in the order of row lines, and drive the display panel 100 such that the sub pixels included in at least some consecutive row lines among the plurality of row lines emit light for a time corresponding to the applied PWM data voltage in the order of row lines (S3300).

Specifically, the display module 300 may apply the PWM data voltage to the sub pixels included in each row line during a data setting period for each row line, and drive the display panel 100 such that the sub pixels included in the at least some consecutive row lines emit light for the time corresponding to the applied PWM data voltage in a plurality of light emission periods for each row line.

Here, a first light emission period of the plurality of light emission periods is temporally consecutive with a data setting period, and each of the plurality of light emission periods may have a predetermined time interval.

The plurality of row lines of the display panel 100 may be divided into a plurality of groups each including consecutive row lines. In this regard, the display module 300 may apply a first PWM data voltage to the sub pixels included in each row line in the order of row lines from a first row line to a last row line of the plurality of row lines during a first image frame period, and drive the display panel 100 such that during the first image frame period, sub pixels included in one of the plurality of groups emit light in the order of row lines, and then sub pixels included in each of the at least two consecutive groups emit light in the order of row lines based on the applied first PWM data voltage. At this time, the at least two consecutive groups include the one group.

In addition, the display module 300 may apply a second PWM data voltage to the sub pixels included in each row line in the order of row lines from the first row line to the last row line of the plurality of row lines during a previous second image frame period of the first image frame period, and drive the display panel 100 such that during the first image frame period, sub pixels included in each of the remaining groups except for at least one group driven based on the first PWM data voltage among the plurality of groups emit light in the order of row lines based on the second PWM data voltage.

In addition, the display module 300 may drive the display panel 100 such that during the first image frame period, the sub pixels included in each row line of each of the plurality of groups emit light multiple times in the plurality of light emission periods for each row line based on at least one of the first PWM data voltage or the second PWM data voltage.

According to various embodiments, it is possible to prevent the wavelength of light emitted by the inorganic light emitting element from varying according to a grayscale.

In addition, it is possible to easily correct a spot or color that may appear in an image displayed on the display panel due to a deviation between sub pixel circuits. In particular, even when a large-area display panel is formed by combining module type display panels, it is possible to more easily correct a difference in brightness or color between display panel modules.

In addition, it is possible to design a more optimized driving circuit, and drive stably and efficiently the inorganic light emitting element. In particular, it is possible to reduce the power consumption of the display panel to display an image.

In addition, it is possible to contribute to the miniaturization and light weighting of the display panel.

In the above, an example in which the sub pixel circuit 110 is implemented as a P-type TFT is shown, but the above-described various embodiments may be applied to an N-type TFT.

In addition, in various embodiments, the TFT constituting the TFT layer (or the TFT panel) is not limited to a specific structure or type, that is, the TFT cited in the various examples of the disclosure is a low temperature poly silicon (LTPS) TFT, an oxide TFT, a poly silicon or a-silicon TFT, an organic TFT, a graphene TFT, etc. may also be implemented, and a P-type (or N-type) MOSFET only may be manufactured in a Si wafer CMOS process and applied.

Further, an example in which the sub pixel circuit 110 is implemented using a TFT layer is described above. However, the embodiment is not limited thereto. That is, according to another embodiment of the disclosure, the sub pixel circuit 110 may be implemented in the form of a micro IC without using a TFT layer. In this regard, the micro IC may be implemented in a sub pixel unit or in a pixel unit, and may be mounted on a substrate together with the inorganic light emitting element 120. Meanwhile, the location where the micro IC is mounted may be, for example, around the corresponding inorganic light emitting element 120, but is not limited thereto.

Various embodiments of the disclosure may be implemented as software including instructions stored in a machine-readable storage medium (e.g., a computer). The machine is a device capable of calling the stored instructions from a storage medium and operating according to the called instructions, and may include an electronic apparatus (e.g., the display apparatus 1000) according to the embodiments.

When the command is executed by a processor, the processor may perform a function corresponding to the command directly or by using other components under the control of the processor. The command may include code generated or executed by a compiler or an interpreter. The machine-readable storage medium may be provided in the form of a non-transitory storage medium. Here, 'non-transitory' merely means that the storage medium does not include a signal and is tangible, but does not distinguish semi-permanent or temporary storage of data in the storage medium.

According to an embodiment, the method according to various embodiments may be provided by being included in a computer program product. The computer program product may be traded between sellers and buyers as commodity. The computer program product may be distributed in the form of machine-readable storage medium (e.g., compact disc read only memory (CD-ROM)) or through an application store (e.g., Play Store™) online. In case of online distribution, at least a part of the computer program product may be temporarily stored or temporarily generated in a storage medium such as a server of a manufacturer, a server of an application store, or a memory of a relay server.

Each of the elements (e.g., a module or a program) according to various embodiments may include a singular entity or plural entities, and some sub-elements of the above-described sub-elements are omitted, or other sub-elements may be further included in various embodiments. Alternatively or additionally, some elements (e.g., a module or a program) may be integrated into a single entity to perform functions performed by each corresponding element prior to integration identically or similarly. Operations performed by modules, programs, or other elements according to various embodiments may be sequentially, in parallel, repeatedly or heuristically executed, or at least some operations may be executed in a different order or omitted, or other operations may be added.

The above description is to merely explain the technical idea of the disclosure, and those of ordinary skill in the art to which the disclosure pertains will be able to make various modifications and variations without departing from the essential feature of the disclosure. Further, the example embodiments discussed in the disclosure are not intended to limit but to explain the technical idea of the disclosure, and the scope of the technical idea of the disclosure is not limited by these embodiments. Accordingly, the scope of protection of the disclosure should be interpreted by the claims below, and all technical ideas within the scope equivalent thereto should be interpreted as being included in the scope of the disclosure.

What is claimed is:

1. A display module comprising:

a display panel comprising a plurality of pixels each comprising a plurality of sub pixels, the plurality of pixels being disposed on row lines of the display panel, and each of the plurality of sub pixels including an inorganic light emitting element; and a driver configured to be electrically connected to the display panel, and to drive the display panel, wherein the driver is further configured to:

sequentially apply a pulse width modulation (PWM) data voltage to the sub pixels of the display panel in an order of the row lines; and drive the display panel such that inorganic light emitting elements of sub pixels included in at least two consecutive row lines among the row lines emit light based on the applied PWM data voltage, and wherein the inorganic light emitting elements of sub pixels included in the at least two consecutive row lines sequentially emit light in an order of the at least two consecutive row lines, wherein the driver is further configured to:

apply the PWM data voltage to sub pixels included in each of the row lines during a data setting period for each of the row lines; and drive the display panel such that the inorganic light emitting elements of the sub pixels included in each of the at least two consecutive row lines emit light for a time corresponding to the applied PWM data voltage within each of a plurality of light emission periods for each of the at least two consecutive row lines.

2. The display module as claimed in claim 1, wherein a first light emission period of the plurality of light emission periods is temporally consecutive with the data setting period, and wherein each of the plurality of light emission periods has a predetermined time interval.

3. The display module as claimed in claim 1, wherein the row lines of the display panel are divided into a plurality of groups, each group comprising consecutive row lines, wherein the driver is further configured to:

sequentially apply a second PWM data voltage to the sub pixels included in each of the row lines from a first row line to a last row line of the row lines of the display panel during a second image frame period; and drive the display panel during the second image frame period based on the applied second PWM data voltage such that sub pixels included in a first group of the plurality of groups sequentially emit light in an order of row lines of the first group, and then sub pixels included in each of a plurality of consecutive groups sequentially emit light in an order of row lines of each group of the plurality of consecutive groups, and wherein the plurality of consecutive groups comprise the first group.

4. The display module as claimed in claim 3, wherein the driver is further configured to:

sequentially apply a first PWM data voltage to the sub pixels included in each of the row lines from the first row line to the last row line of the row lines of the display panel during a first image frame period before the second image frame period; and drive the display panel during the second image frame period based on the first PWM data voltage such that sub pixels included in each of other groups excluding at least one group driven based on the second PWM data voltage among the plurality of groups, sequentially emit light in an order of row lines of each group of the other groups.

5. The display module as claimed in claim 4, wherein the driver is further configured to drive the display panel during the second image frame period such that the sub pixels included in each of the row lines of each of the plurality of groups emit light multiple times during the plurality of light emission periods for each of the row lines based on one or more of the first PWM data voltage and the second PWM data voltage.

6. The display module as claimed in claim 1, wherein each of the plurality of sub pixels further comprises:

a sub pixel circuit configured to control a light emission time of the inorganic light emitting element during each of the plurality of light emission periods according to driving of the driver, and wherein each sub pixel circuit comprises:

a constant current generator circuit configured to provide a constant current to the inorganic light emitting element based on an applied constant current generator voltage; and a PWM circuit configured to provide the constant current to the inorganic light emitting element for the time corresponding to the applied PWM data voltage.

7. The display module as claimed in claim 6, wherein the constant current generator circuit comprises a first driving transistor, and, based on the constant current generator voltage being applied, the constant current generator circuit is configured to apply a first voltage based on the applied constant current generator voltage and a threshold voltage of the first driving transistor to a gate terminal of the first driving transistor, and wherein the PWM circuit comprises a second driving transistor, and, based on the PWM data voltage being applied, the PWM circuit is configured to apply a second voltage based on the applied PWM data voltage and a threshold voltage of the second driving transistor to a gate terminal of the second driving transistor.

8. The display module as claimed in claim 7, wherein the constant current generator circuit further comprises:

a first transistor connected between a drain terminal and the gate terminal of the first driving transistor; and a second transistor comprising a drain terminal connected to a source terminal of the first driving transistor and a gate terminal connected to the gate terminal of the first transistor, and wherein during a state in which the constant current generator voltage is applied through a source terminal of the second transistor while the first and second transistors are turned on, the constant current generator circuit is further configured to apply the first voltage to the gate terminal of the first driving transistor through the turned-on first driving transistor.

9. The display module as claimed in claim 7, wherein the PWM circuit further comprises:

a third transistor connected between a drain terminal and the gate terminal of the second driving transistor; and a fourth transistor having a drain terminal connected to a source terminal of the second driving transistor and a gate terminal connected to a gate terminal of the third transistor, and wherein during a state in which the PWM data voltage is applied through a source terminal of the fourth transistor while the third and fourth transistors are turned on, the PWM circuit is further configured to apply the second voltage to the gate terminal of the second driving transistor through the turned-on second driving transistor.

10. The display module as claimed in claim 7, wherein the constant current generator circuit is further configured to provide the inorganic light emitting element with the constant current, the constant current having a magnitude based on a first driving voltage applied to a source terminal of the first driving transistor and the first voltage applied to the gate terminal of the first driving transistor.

11. The display module as claimed in claim 7, wherein the sub pixel circuit comprises a first switching transistor having a gate terminal connected to a drain terminal of the second driving transistor and a source terminal connected to a drain terminal of the first driving transistor, wherein the constant current generator circuit is further configured to, during a state in which a first driving voltage is applied to the source terminal of the first switching transistor through the first driving transistor, provide the constant current to the inorganic light emitting element through the turned-on first switching transistor, and wherein the PWM circuit is further configured to, during a state in which the second driving transistor is turned on based on the second voltage applied to the gate terminal of the second driving transistor and a second driving voltage applied to a source terminal of the second driving transistor, apply the second driving voltage to the gate terminal of the first switching transistor to turn off the first switching transistor.

12. The display module as claimed in claim 11, wherein the second driving transistor is configured to turned on once the second voltage applied to the gate terminal of the second driving transistor changes according to a sweep voltage applied to the PWM circuit and a voltage between the gate terminal and the source terminal of the second driving transistor becomes a threshold voltage of the second driving transistor.

13. The display module as claimed in claim 11, wherein the sub pixel circuit further comprises a second switching transistor having a source terminal connected to a drain terminal of the first switching transistor and a drain terminal connected to an anode terminal of the inorganic light emitting element, and wherein the second switching transistor is configured to turned on once a predetermined time elapses from a time when the second driving voltage is applied to the source terminal of the second driving transistor.

14. The display module as claimed in claim 11, wherein the PWM circuit further comprises a resetter configured to turn on the first switching transistor before the first driving voltage is applied to the source terminal of the first switching transistor through the first driving transistor.

15. The display module as claimed in claim 14, wherein a voltage of the gate terminal of the second driving transistor, that has linearly changed according to a sweep voltage in a first light emission period among the plurality of light emission periods, is restored to the second voltage by the sweep voltage before a second light emission period after the first light emission period among the plurality of light emission periods, and wherein the resetter is further configured to, based on the second light emission period beginning, turn on the first switching transistor that is turned off in the first light emission period.

16. The display module as claimed in claim 11, wherein the constant current generator circuit is driven based on the second driving voltage during the data setting period and is driven based on the first driving voltage during the plurality of light emission periods.

17. A method of driving a display module, the display module including a display panel having a plurality of pixels each including a plurality of sub pixels, the plurality of pixels being disposed on row lines of the display panel and each of the plurality of sub pixels including an inorganic light emitting element, the method comprising:

sequentially applying a pulse width modulation (PWM) data voltage to the sub pixels of the display panel in a sequential order of the row lines; and driving the display panel such that inorganic light emitting elements of sub pixels included in at least two consecutive row lines among the row lines emit light based on the applied PWM data voltage, wherein the inorganic light emitting elements of sub pixels included in the at least two consecutive row lines sequentially emit light in an order of the at least two consecutive row lines, wherein the method further comprises:

applying the PWM data voltage to sub pixels included in each of the row lines during a data setting period for each of the row lines; and driving the display panel such that the inorganic light emitting elements of the sub pixels included in each of the at least two consecutive row lines emit light for a time corresponding to the applied PWM data voltage within each of a plurality of light emission periods for each of the at least two consecutive row lines.

* * * * *